US006716805B1

(12) United States Patent
Sherry et al.

(10) Patent No.: US 6,716,805 B1
(45) Date of Patent: Apr. 6, 2004

(54) HARD SURFACE CLEANING COMPOSITIONS, PREMOISTENED WIPES, METHODS OF USE, AND ARTICLES COMPRISING SAID COMPOSITIONS OR WIPES AND INSTRUCTIONS FOR USE RESULTING IN EASIER CLEANING AND MAINTENANCE, IMPROVED SURFACE APPEARANCE AND/OR HYGIENE UNDER STRESS CONDITIONS SUCH AS NO-RINSE

(75) Inventors: Alan Edward Sherry, Cincinnati, OH (US); Nicola John Policicchio, Mason, OH (US); Cynthia Elaine Cella, Fairfield, OH (US); Jeffrey Lawrence Flora, Mason, OH (US); Toan Trinh, Maineville, OH (US); Joseph Paul Morelli, Kirkland, WA (US)

(73) Assignee: The Procter & Gamble Company, Cincinnati, OH (US)

( * ) Notice: Subject to any disclaimer, the term of this patent is extended or adjusted under 35 U.S.C. 154(b) by 103 days.

(21) Appl. No.: 09/671,718

(22) Filed: Sep. 27, 2000

Related U.S. Application Data

(60) Provisional application No. 60/156,286, filed on Sep. 27, 1999.

(51) Int. Cl.[7] ..... C11D 17/00

(52) U.S. Cl. ..... 510/295; 510/438; 510/470; 510/499; 510/504; 510/505; 510/506; 401/138; 401/139; 15/208; 15/209.1

(58) Field of Search ..... 510/295, 438, 510/470, 499, 504, 505, 506; 401/138, 139; 15/208, 209.1

(56) References Cited

U.S. PATENT DOCUMENTS

| | | | | |
|---|---|---|---|---|
| 3,965,519 | A | | 6/1976 | Hermann |
| 4,189,395 | A | | 2/1980 | Bland |
| 4,240,760 | A | | 12/1980 | Levine |
| 4,298,649 | A | | 11/1981 | Meitner |
| 4,426,417 | A | | 1/1984 | Meitner et al. |
| 4,429,014 | A | | 1/1984 | Isner et al. |
| 4,436,780 | A | | 3/1984 | Hotchkiss et al. |
| 4,473,611 | A | | 9/1984 | Haq |
| 4,515,703 | A | | 5/1985 | Haq |
| 4,525,411 | A | | 6/1985 | Schmidt |
| 4,540,505 | A | | 9/1985 | Frazier |
| 4,600,620 | A | | 7/1986 | Lloyd et al. |
| 4,601,938 | A | | 7/1986 | Deacon et al. |
| 4,606,842 | A | | 8/1986 | Keyes |
| 4,615,937 | A | | 10/1986 | Bouchette |
| 4,624,890 | A | | 11/1986 | Lloyd et al. |
| 4,627,931 | A | * | 12/1986 | Malik ..... 252/153 |
| 4,627,936 | A | | 12/1986 | Gould et al. |
| 4,666,621 | A | | 5/1987 | Clark et al. |
| 4,725,489 | A | * | 2/1988 | Jones et al. ..... 428/289 |
| 4,735,739 | A | | 4/1988 | Floyd et al. |
| 4,741,944 | A | | 5/1988 | Jackson et al. |
| 4,769,022 | A | | 9/1988 | Chang et al. |
| 4,775,582 | A | | 10/1988 | Abba et al. |
| 4,778,048 | A | | 10/1988 | Kaspar et al. |
| 4,781,974 | A | | 11/1988 | Bouchette et al. |
| 4,797,310 | A | | 1/1989 | Barby et al. |
| 4,837,079 | A | | 6/1989 | Quantrille et al. |
| 4,858,780 | A | | 8/1989 | Odaka et al. |
| 4,904,524 | A | | 2/1990 | Yoh |
| 4,906,513 | A | | 3/1990 | Kebbell et al. |
| 4,931,201 | A | | 6/1990 | Julemont |
| 5,057,361 | A | | 10/1991 | Sayovitz et al. |
| 5,126,068 | A | | 6/1992 | Burke et al. |
| 5,252,245 | A | | 10/1993 | Garabedian, Jr. et al. |
| 5,264,269 | A | | 11/1993 | Kakiuchi et al. |
| 5,342,534 | A | | 8/1994 | Skrobala et al. |
| 5,437,807 | A | | 8/1995 | Garabedian, Jr. et al. |
| 5,468,423 | A | | 11/1995 | Garabedian, Jr. et al. |
| 5,507,968 | A | | 4/1996 | Palaikis |
| 5,514,369 | A | | 5/1996 | Salka et al. |
| 5,522,942 | A | | 6/1996 | Graubart et al. |
| 5,523,024 | A | | 6/1996 | Garabedian, Jr. et al. |

(List continued on next page.)

FOREIGN PATENT DOCUMENTS

| | | |
|---|---|---|
| CA | 1 182 373 | 2/1985 |
| CA | 1 196 620 | 11/1985 |
| EP | 0 377 500 A2 | 7/1990 |
| EP | 0 750 063 A1 | 12/1996 |
| JP | 08162132 | 1/1998 |
| WO | WO 96/14835 | 5/1996 |
| WO | WO 97/25106 | 7/1997 |
| WO | WO 97/25404 | 7/1997 |
| WO | WO 97/40814 | 11/1997 |
| WO | WO 98/03713 | 1/1998 |
| WO | WO 98/26040 | 6/1998 |
| WO | WO 98/55569 A1 | 12/1998 |

*Primary Examiner*—Necholus Ogden
(74) *Attorney, Agent, or Firm*—Thibault Fayette; Jason J. Camp; Kim William Zerby

(57) ABSTRACT

The present invention provides preferred, preferably liquid, hard surface cleaning compositions, compositions with cleaning liquid composition on a substrate, compositions used with absorbent pads and implements and devices for making the process of cleaning hard surfaces and/or maintaining their appearance and hygiene easier and more effective. These compositions, along with specific instructions for use are advantageous for removal of and/or prevention of buildup of soils commonly encountered on floors, glass surfaces, counters, walls, showers and/or tubs, said compositions comprising hydrophilic polymers to render the cleaned surface hydrophilic and to improve the appearance when the surface is either not rinsed, or when the composition is incompletely removed, specific surfactant, preferably surfactant selected to minimize spotting/filming, optionally specific organic cleaning solvents to provide cleaning and wetting particularly in applications where levels of non-volatiles need to be minimized, and, optionally, anti-bacterial agents for preserving or surface activity and optionally perfumes for aesthetics.

12 Claims, No Drawings

U.S. PATENT DOCUMENTS 5,585,342 A 12/1996 Choy et al.
5,605,749 A 2/1997 Pike et al.
5,656,361 A 8/1997 Vogt et al.
5,691,289 A 11/1997 Purcell et al.
5,702,992 A 12/1997 Martin et al.
5,714,448 A 2/1998 Choy et al.
5,736,500 A 4/1998 Farnworth et al.
5,744,181 A 4/1998 Sornay et al.
5,763,332 A 6/1998 Gordon et al.
5,791,465 A 8/1998 Niki et al.
5,817,615 A 10/1998 Garabedian, Jr. et al.
5,851,981 A 12/1998 Choy et al.
5,863,663 A 1/1999 Mackey et al.
5,904,735 A 5/1999 Gutierrez et al.
5,908,707 A 6/1999 Cabell et al.
5,911,915 A 6/1999 Fonsny et al.
5,914,177 A 6/1999 Smith, III et al.
5,929,007 A 7/1999 Feng
5,980,922 A 11/1999 Mackey et al.
6,048,123 A * 4/2000 Holt et al. ..... 401/138
6,340,663 B1 1/2002 Deleo et al.

* cited by examiner

HARD SURFACE CLEANING COMPOSITIONS, PREMOISTENED WIPES, METHODS OF USE, AND ARTICLES COMPRISING SAID COMPOSITIONS OR WIPES AND INSTRUCTIONS FOR USE RESULTING IN EASIER CLEANING AND MAINTENANCE, IMPROVED SURFACE APPEARANCE AND/OR HYGIENE UNDER STRESS CONDITIONS SUCH AS NO-RINSE

This application claims the benefit of provisional application Ser. No. 60/156,286, filed Sep. 27, 1999.

FIELD OF THE INVENTION

This invention relates to liquid cleaning compositions, including concentrated compositions, premoistened wipes, including optimized substrates, and implements for use in cleaning hard surfaces and/or maintaining their appearance and hygiene, and articles comprising said compositions, concentrates, wipes, and the like, in association with instructions as to how to use them to provide superior performance. These compositions, wipes, and implement designs along with specific instructions for use are advantageous for use on hard surfaces including bathroom surfaces, glass surfaces, countertops, walls and floors. Such compositions typically contain hydrophilic polymer, detergent surfactant, organic cleaning solvent, and optional volatile buffers, perfume, anti-microbials, builders, and the like.

BACKGROUND OF THE INVENTION

The use of detergent compositions comprising organic water-soluble synthetic detergent surfactants, polymers, and cleaning solvents for cleaning hard surfaces in, e.g., bathrooms, is well established. Known liquid detergent compositions for this purpose comprise organic cleaning solvents, detergent surfactant, and optional detergent builders and/or abrasives. The compositions can be acidic for improved removal of hard water deposits.

Liquid cleaning compositions are usually preferred, since they have the advantage that they can be applied to hard surfaces in neat or concentrated form so that a relatively high level of, e.g., surfactant material and/or organic solvent is delivered directly to the soil. However, solid compositions can also be used to form a cleaning solution when diluted with water. Concentrated liquid cleaning compositions can also help improve the value equation for consumers by economizing on packaging costs, where the concentrated products are intended to be used in more dilute form. A concentrated, e.g., 10X refill, can also provide additional convenience to the consumer in that it lasts longer, weighs less, and occupies less space than a 1X product. Liquid cleaning compositions in the form of a "wipe" also can provide convenience by allowing the consumer to use the wipe once and dispose of it.

Implements are important in that they can be used to advantageously improve the performance of the liquid compositions. Implements, including wipes, pads, mops and the like, can provide important mechanical cleaning properties to complement the liquid composition choice. Conversely, the liquid compositions can be chosen to suit the choice of implement. Thus, the proper choice of implement allows for a significant reduction in the level of non-volatile surfactants and other adjuvants needed to achieve excellent cleaning results.

SUMMARY OF THE INVENTION

The present invention relates to hard surface cleaning compositions, preferably liquid, suitable for removal of and/or prevention of buildup of soils commonly encountered on floors, walls, counter tops, glass, and/or in the bathroom, said compositions preferably comprising hydrophilic polymers, to render the cleaned surface hydrophilic, and/or specific surfactant, preferably alkylpolyglycoside surfactant, selected to minimize spotting/filming, optionally cleaning solvents, and optionally organic acids. The invention also relates to cleaning systems including implements and instructions for how they are used, preferably, with the solutions comprising hydrophilic polymers to achieve a low residue end result. The invention further relates to methods of cleaning and maintaining the cleanliness of hard surfaces, especially those that are present in the bathroom, kitchen, laundry, etc., wherein one can treat the surface and let the treatment solution dry without scrubbing and/or rinsing, e.g., the treatment is preferably a no-rinse treatment. "No-rinse treatment", e.g. cleaning of hard surfaces without rinsing, as used herein, means that at least a substantial part of the surface treatment solution dries down on the treated surface. Such treatment solutions are preferably highly dilute. Typically, the surface is then later, after the surface is used again, exposed to water, or another cleaning solution. Preferably, the surface is one that is normally exposed to water on a regular basis, such as showers, tubs, sinks, etc.

The invention also relates to compositions and methods of use in which floors, counters, walls, and the like, are cleaned by applying a treatment solution which is then substantially removed by absorption and/or rubbing, while leaving on a low to moderate level of treatment liquid which then dries. Examples of such methods include applications such as the use of pre-moistened wipes (comprising a substrate and aqueous compositions incorporated in the substrate) and/or absorbent articles used in conjunction with cleaning solution. The use of these implements facilitates the ease of use and can be advantageous in achieving not only a desired end result but excellent hygiene. Since pre-moistened wipes or absorbent pads are typically disposed of after each use, their use and subsequent disposal reduces the risk of the implement harboring and re-inoculating germs onto the surface being cleaned which often happens with traditional re-usable sponges, cloths, and mops. The disclosures of premoistened wipes and disposable cleaning pads are found hereinafter.

The acidic versions of the present hard surface cleaning compositions can remove soap scum and hard water marks. The compositions can have disinfectant properties achieved through the choice of antibacterial actives, including citric acid, and can be used with, or without, additives such as hydrogen peroxide for additional mold/mildew prevention benefits. As stated above, the compositions preferably incorporate one or more hydrophilic polymers which attach to the surface to render it hydrophilic, as measured by, e.g., the contact angle, for improved surface wetting and/or filming/streaking properties and, optionally, viscosity control.

The hard surface cleaning compositions herein which contain the hydrophilic polymers, provide superior surface appearance, especially in a no-rinse application. Thus, in the context of a "daily shower" spray application, the compositions herein are sprayed directly onto tile, more preferably onto wet tile, and then allowed to dry. Upon the next exposure to water, e.g., during a shower, the dried-on, though not visible, residue allows for even faster wetting of the surface. Consequently, the product works better, when it is not rinsed or wiped off after use, in subsequent cleaning procedures. Additionally, the fact that no, or limited, rinsing or wiping is involved after the product is applied improves performance with continued use. One of the benefits of the preferred polymers herein is that they ultimately reach a steady state concentration on the hard surfaces on which they are sprayed. No build-up occurs because the preferred polymers are water soluble, and once steady state concentrations are reached, "fresh" polymer deposited on the surface is offset by polymer which is dissolved by the solution. The reduction of contact angle of water can be improved over several cycles, even for compositions that contain essentially no surfactant.

In the context of a floor, counter, wall cleaner, or the like, the steady state concentration achieved after applying a solution composition, wiping and removing a substantial amount by absorption and allowing a low to moderate level of treatment to dry is also important. In these cases the low level of residue (residue being defined as non-volatile actives) makes next time cleaning even easier by providing even better wetting upon subsequent application, thus reducing streaking/filming potential by minimizing solution de-wetting which is particularly important on very hydrophobic surfaces. This effective wetting benefit provided by polymer at low levels also allows the formulator to keep other ingredients in the composition, such as surfactants, that are typically involved in wetting, at a minimum. This reduces the possibility of obtaining a film that can smudge and/or cause surface stickiness due to the presence on the surface of too much active and/or other material. This is important, as it allows for less stickiness with prolonged product use.

Accordingly, the cleaning process is preferably a method which comprises using treatment solution (preferably a ready-to-use-solution) comprising:

a. an effective amount to reduce the contact angle and/or increase surface hydrophilicity, up to about 0.5%, preferably from about 0.005% to about 0.4%, more preferably from about 0.01% to about 0.3%, by weight of the composition, of hydrophilic polymer, preferably substantive, that renders the treated surface hydrophilic, and preferably is a polymer selected from the group consisting of: polystyrene sulfonate; polyvinyl pyrrolidone; polyvinyl pyrrolidone acrylic acid copolymer; polyvinyl pyrrolidone acrylic acid copolymer sodium salt; polyvinyl pyrrolidone acrylic acid copolymer potassium salt; polyvinyl pyrrolidone- vinyl imidazoline; polyvinyl pyridine; polyvinyl pyridine n-oxide; and mixtures thereof; and more preferably polyvinyl pyridine n-oxide;

b. optionally, but preferably, an effective amount of primary detergent surfactant, preferably from about 0.005% to about 0.5%, more preferably from about 0.01% to about 0.4%, most preferably from about 0.025% to about 0.3%, by weight of the composition, said primary detergent surfactant preferably comprising alkyl polysaccharide detergent surfactant having an alkyl group containing from about 8 to about 18 carbon atoms, more preferably from about 8 to about 16 carbon atoms, and from about one to about four, preferably from about one to about 1.5 saccharide moieties per molecule and/or a combination consisting of alkyl polysaccharide detergent surfactant having an alkyl group containing from about 8 to about 18 carbon atoms, more preferably from about 8 to about 16 carbon atoms, and from about one to about four, preferably from about one to about 1.5 saccharide moieties per molecule together with an alkyl ethoxylate comprising from about 8 to about 16 carbon atoms and from about 4 to about 25 oxyethylene units;

c. optionally, an effective amount to provide increased cleaning of organic cleaning solvent, preferably from about 0.25% to about 5%, preferably from about 0.5% to about 4%, more preferably from about 0.5% to about 3%, by weight of the composition, and is preferably selected from the group consisting of: mono-propylene glycol mono-propyl ether; mono-propylene glycol mono-butyl ether; di-propylene glycol mono-propyl ether; di-propylene glycol mono-butyl ether; di-propylene glycol mono-butyl ether; tri-propylene glycol mono-butyl ether; ethylene glycol mono-butyl ether; diethylene glycol mono-butyl ether, ethylene glycol mono-hexyl ether; diethylene glycol mono-hexyl ether; and mixtures thereof;

d. optionally, a minor amount that is less than the amount of primary detergent surfactant b., preferably from about 0.005% to about 0.5%, more preferably from about 0.01% to about 0.4%, and even more preferably from about 0.025% to about 0.3%, by weight of the composition, of cosurfactant, preferably anionic and/or nonionic detergent surfactant, more preferably selected from the group consisting of: $C_8$–$C_{12}$ linear sulfonates, $C_8$–$C_{18}$ alkylbenzene sulfonates; $C_8$–$C_{18}$ alkyl sulfates; $C_8$–$C_{18}$ alkylpolyethoxy sulfates; and mixtures thereof;

e. optionally, an effective amount to improve cleaning and/or antimicrobial action, preferably from about 0.01 % to about 1%, more preferably from about 0.01% to about 0.5%, and even more preferably from about 0.01% to about 0.25%, by weight of the composition, of water-soluble mono- or polycarboxylic acid;

f. optionally, an effective amount, up to about 1%, preferably from about 0.01% to about 0.5%, more preferably from about 0.025% to about 0.25%, by weight of the composition, of cyclodextrin, preferably alpha, beta, or gamma substituted cyclodextrin, and optionally, with short chain (1–4 carbon atoms) alkyl or hydroxyalkyl groups; the cyclodextrin is preferably beta-cyclodextrin, hydroxypropyl cyclodextrin, or mixtures thereof;

g. optionally, an effective amount to provide bleaching, cleaning, and/or antibacterial action, up to about 5%, preferably from about 0.1% to about 4%, more preferably from about 1% to about 3%, by weight of the composition, of hydrogen peroxide;

h. optionally, from about 0.005% to about 1%, preferably from about 0.005% to about 0.5%, more preferably from about 0.01% to about 0.1%, by weight of the composition, of a thickening polymer selected from the group consisting of polyacrylates, gums, and mixtures thereof;

i. optionally, an effective amount of perfume to provide odor effects, and/or additional adjuvants; and j. optionally, an effective amount, preferably from about 0.0001% to about 0.1%, more preferably from about 0.00025% to about 0.05%, and even more preferably from about 0.001% to about to about 0.01%, by weight of the composition, of suds suppressor, preferably silicone suds suppressor, and k. optionally, but preferably, an aqueous solvent system comprising water and optional water soluble solvent, and wherein said treatment solution has a pH under usage conditions of from about 2 to about 12, preferably from about 3 to about 11.5, with acidic compositions having a pH of from about 2 to about 6, preferably from about 3 to about 5, said method involving applying the treatment solution, optionally rubbing the surface which is wetted by said treatment solution, and then, optionally, removing part of said treatment solution, while leaving a portion of said treatment solution on the surface.

The improved surface appearance is the result of the use of the hydrophilic polymer and/or specific surfactant, especially the alkyl polysaccharide, and especially the use of only low levels of all ingredients. For no-rinse and/or limited "buffing" methods, the specific alkyl polysaccharide is important for appearance, even without the polymer being present. Concentrates of the above product can be made by reducing the amount of water. Concentrates of the solution of the present invention (i.e., products intended to be used diluted) have levels of active that are scaled up by the stated concentration factor. In a preferred embodiment, concentrates come with a measuring device (usually the cap or a graduated bottle) to help the consumer make accurate dilutions. Examples of concentrates of the present invention include, but are not limited to, 3X, 5X and 10 X products according to the specification levels defined above. Unless otherwise specified, all concentrations are implied to be for "ready-to-use" products hereinafter. It is understood that those skilled in the art would be able to make concentrates, which would then be diluted for use.

Preferred compositions herein can contain only polymer and perfume since the polymers, especially the preferred amine oxide polymers, are capable of solubilizing/suspending substantial amounts of even water insoluble perfumes. Normally, however, the surfactant will also be present. Compositions for use with disposable pads are disclosed hereinafter.

DETAILED DESCRIPTION OF THE INVENTION

The hard surface cleaning compositions of the present invention are especially useful for maintaining the appearance of hard surfaces and the buildup of hard-to-remove soils that are commonly encountered on floors and/or in the bathroom. These include hard water stains, fatty acids, triglycerides, lipids, insoluble fatty acid soaps, entrenched particulate matter, encrusted food, and the like. The detergent compositions can be used on many different surface types, such as ceramic, fiber glass, glass, polyurethane, metallic surfaces, plastic surfaces, and laminates of all the above.

a. Hydrophilic Polymer

In most of the embodiments of the invention, the polymeric material that improves the hydrophilicity of the surface being treated is essential. This increase in hydrophilicity provides improved final appearance by providing "sheeting" of the water from the surface and/or spreading of the water on the surface, and this effect is preferably seen when the surface is rewetted and even when subsequently dried after the rewetting.

In the context of a product intended to be used as a daily shower product, the "sheeting" effect is particularly noticeable because most of the surfaces treated are vertical surfaces. Thus, benefits have been noted on glass, ceramic and even tougher to wet surfaces such as porcelain enamel. When the water "sheets" evenly off the surface and/or spreads on the surface, it minimizes the formation of, e.g., "hard water spots" that form upon drying. For a product intended to be used in the context of a floor cleaner, the polymer improves surface wetting and assists cleaning performance.

Polymer substantivity is beneficial as it prolongs the sheeting and cleaning benefits. Another important feature of preferred polymers is lack of residue upon drying. Compositions comprising preferred polymers dry more evenly on floors while promoting an end result with little or no haze.

Many materials can provide the sheeting and anti-spotting benefits, but the preferred materials are polymers that contain amine oxide hydrophilic groups. Polymers that contain other hydrophilic groups such a sulfonate, pyrrolidone, and/or carboxylate groups can also be used. Examples of desirable poly-sulfonate polymers include polyvinylsulfonate, and more preferably polystyrene sulfonate, such as those sold by Monomer-Polymer Dajac (1675 Bustleton Pike, Feasterville, Pa. 19053). A typical formula is as follows.

$$-[CH(C_6H_4SO_3Na)-CH_2]_n-CH(C_6H_5)-CH_2-$$

wherein n is a number to give the appropriate molecular weight as disclosed below.

Typical molecular weights are from about 10,000 to about 1,000,000, preferably from about 200,000 to about 700,000. Preferred polymers containing pyrrolidone functionalities include polyvinyl pyrrolidone, quaternized pyrrolidone derivatives (such as Gafquat 755N from International Specialty Products), and co-polymers containing pyrrolidone, such as polyvinylpyrrolidone /dimethylaminoethylmethacrylate (available from ISP) and polyvinyl pyrrolidone/acrylate (available from BASF). Other materials can also provide substantivity and hydrophilicity including cationic materials that also contain hydrophilic groups and polymers that contain multiple ether linkages. Cationic materials include cationic sugar and/or starch derivatives and the typical block copolymer detergent surfactants based on mixtures of polypropylene oxide and ethylene oxide are representative of the polyether materials. The polyether materials are less substantive, however.

The preferred polymers comprise water-soluble amine oxide moieties. It is believed that the partial positive charge of the amine oxide group can act to adhere the polymer to the surface of the surface substrate, thus allowing water to "sheet" more readily. The amine oxide moiety can also hydrogen-bond with hard surface substrates, such as ceramic tile, glass, fiberglass, porcelain enamel, linoleum, no-wax tile, and other hard surfaces commonly encountered in consumer homes. To the extent that polymer anchoring promotes better "sheeting", higher molecular weight materials are preferred. Increased molecular weight improves efficiency and effectiveness of the amine oxide-based polymer. The preferred polymers of this invention have one or more monomeric units containing at least one N-oxide group. At least about 10%, preferably more than about 50%, more preferably greater than about 90% of said monomers forming said polymers contain an amine oxide group. These polymers can be described by the general formula:

$$P(B)$$

wherein each P is selected from homopolymerizable and copolymerizable moieties which attach to form the polymer backbone, preferably vinyl moieties, e.g. $C(R)_2$ ——$C(R)_2$, wherein each R is H, $C_1$ –$C_{12}$ (preferably $C_1$–$C_4$) alkyl(ene), $C_6$–$C_{12}$ aryl(ene) and/or B; B is a moiety selected from substituted and unsubstituted, linear and cyclic $C_1$–$C_{12}$ alkyl, $C_1$–$C_{12}$ alkylene, $C_1$–$C_{12}$ heterocyclic, aromatic $C_6$–$C_{12}$ groups and wherein at least one of said B moieties has at least one amine oxide (—N→O) group present; wherein the polymer typically has at least about 10% to about 90% monomers containing an amine oxide group; and the average molecular weight of the polymer is from about 2,000 to about 500,000, preferably from about 5,000 to about 250,000, and more preferably from about 7,500 to about 200,000.

The preferred polymers of this invention possess the unexpected property of being substantive without leaving a visible residue that would render the surface substrate unappealing to consumers. The preferred polymers include poly (4-vinylpyridine N-oxide) polymers (PVNO), e.g. those formed by polymerization of monomers that include the following moiety:

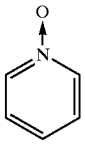

wherein the average molecular weight of the polymer is from about 2,000 to about 500,000 preferably from about 5,000 to about 400,000, and more preferably from about 7,500 to about 300,000. In general, higher molecular weight polymers are preferred. Often, higher molecular weight polymers allow for use of lower levels of the wetting polymer, which can provide benefits in floor cleaner applications. The desirable molecular weight range of polymers useful in the present invention stands in contrast to that found in the art relating to polycarboxylate, polystyrene sulfonate, and polyether based additives which prefer molecular weights in the range of 400,000 to 1,500,000. Lower molecular weights for the preferred poly-amine oxide polymers of the present invention are due to greater difficulty in manufacturing these polymers in higher molecular weight.

The level of amine oxide polymer will normally be less than about 0.5%, preferably from about 0.005% to about 0.4%, more preferably from about 0.01 % to about 0.3%, by weight of the end use composition/solution.

Some non-limiting examples of homopolymers and copolymers which can be used as water-soluble polymers of the present invention are: adipic acid/ dimethylaminohydroxypropyl diethylenetriamine copolymer; adipic acid/ epoxypropyl diethylenetriamine copolymer; polyvinyl alcohol; methacryloyl ethyl betaine/methacrylates copolymer; ethyl acrylate/methyl methacrylate/methacrylic acid/acrylic acid copolymer; polyamine resins; polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); poly(vinyl alcohol-co-12% vinylamine hydrochloride); and mixtures thereof. Preferably, said copolymer and/or homopolymers are selected from the group consisting of adipic acid/ dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquaternary amine resins; poly(ethenylformamide); poly (vinylamine) hydrochloride; poly(vinyl alcohol-co-6% vinylamine); poly(vinyl alcohol-co-12% vinylamine); poly (vinyl alcohol-co-6% vinylamine hydrochloride); poly(vinyl alcohol-co-12% vinylamine hydrochloride); and mixtures thereof.

Polymers useful in the present invention can be selected from the group consisting of copolymers of hydrophilic monomers. The polymer can be linear random or block copolymers, and mixtures thereof. The term "hydrophilic" is used herein consistent with its standard meaning of having affinity for water. As used herein in relation to monomer units and polymeric materials, including the copolymers, "hydrophilic" means substantially water soluble. In this regard, "substantially water soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, correspond to the maximum concentration of monomer or polymer, as applicable, that can dissolve in water or other solvents to form a homogeneous solution, as is well understood to those skilled in the art.

Nonlimiting examples of useful hydrophilic monomers are unsaturated organic mono- and polycarboxylic acids such as acrylic acid, methacrylic acid, crotonic acid, maleic acid and its half esters, and itaconic acid; unsaturated alcohols, such as vinyl alcohol and allyl alcohol; polar vinyl heterocyclics such as vinyl caprolactam, vinyl pyridine, and vinyl imidazole; vinyl amine; vinyl sulfonate; unsaturated amides such as acrylamides, e.g., N,N-dimethylacrylamide and N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, and mixtures thereof.

Polycarboxylate polymers are those formed by polymerization of monomers, at least some of which contain carboxylic functionality. Common monomers include acrylic acid, maleic acid, ethylene, vinyl pyrrolidone, methacrylic acid, methacryloylethylbetaine, and the like. Preferred polymers for substantivity are those having higher molecular weights. For example, polyacrylic acid having molecular weights below about 10,000 are not particularly substantive and therefore do not normally provide hydrophilicity for three rewettings with all compositions, although with higher levels and/or certain surfactants like amphoteric and/or zwitterionic detergent surfactants, molecular weights down to about 1,000 can provide some results. In general, the polymers should have molecular weights of more than about 10,000, preferably more than about 20,000, more preferably more than about 300,000, and even more preferably more than about 400,000. It has also been found that higher molecular weight polymers, e.g., those having molecular weights of more than about 3,000,000, are extremely difficult to formulate and are less effective in providing anti-spotting benefits than lower molecular weight polymers. Accordingly, the molecular weight should normally be, especially for polyacrylates, from about 20,000 to about 3,000,000; preferably from about 20,000 to about 2,500,000; more preferably from about 300,000 to about 2,000,000; and even more preferably from about 400,000 to about 1,500,000.

An advantage for some polycarboxylate polymers is the detergent builder effectiveness of such polymers. Although such polymers do increase filming/streaking, like other detergent builders, they provide increased cleaning effectiveness on typical, common "hard-to-remove" soils that contain particulate matter.

Some polymers, especially polycarboxylate polymers, thicken the compositions that are aqueous liquids. This can be desirable. However, when the compositions are placed in containers with trigger spray devices, the compositions are desirably not so thick as to require excessive trigger pressure. Typically, the viscosity under shear should be less than about 200 cp, preferably less than about 100 cp, more preferably less than about 50 cp. It can be desirable, however, to have thick compositions to inhibit the flow of the composition off the surface, especially vertical surfaces.

Non limiting examples of polymers for use in the present invention include the following: poly(vinyl pyrrolidone/acrylic acid) sold under the name Acrylidone® by ISP and poly(acrylic acid) sold under the name Accumer® by Rohm & Haas. Other suitable materials include sulfonated polystyrene polymers sold under the name Versaflex® sold by National Starch and Chemical Company, especially Versaflex® 7000.

The level of polymeric material will normally be less than about 0.5%, preferably from about 0.01% to about 0.4%, more preferably from about 0.01% to about 0.3%. In general, lower molecular weight materials such as lower molecular weight poly(acrylic acid), e.g., those having molecular weights below about 10,000, and especially about 2,000, do not provide good anti-spotting benefits upon rewetting, especially at the lower levels, e.g., about 0.02%. One should use only the more effective materials at the lower levels. In order to use lower molecular weight materials, substantivity should be increased, e.g., by adding groups that provide improved attachment to the surface, such as cationic groups, or the materials should be used at higher levels, e.g., more than about 0.05%.

b. Surfactant

When the polymer is not present in the compositions herein, the compositions will normally have one of the preferred surfactants present, such as alkylpolysaccharides or nonionic surfactants, including alkyl ethoxylates. The preferred surfactants for use herein are the alkylpolysaccharides that are disclosed in U.S. Pat. Nos.: 5,776,872, Cleansing compositions, issued Jul. 7, 1998, to Giret, Michel Joseph; Langlois, Anne; and Duke, Roland Philip; 5,883,059, Three in one ultra mild lathering antibacterial liquid personal cleansing composition, issued Mar. 16, 1999, to Furman, Christopher Allen; Giret, Michel Joseph; and Dunbar, James Charles; et al.; 5,883,062, Manual dishwashing compositions, issued Mar. 16, 1999, to Addison, Michael Crombie; Foley, Peter Robert; and Allsebrook, Andrew Micheal; and 5,906,973, issued May 25, 1999, Process for cleaning vertical or inclined hard surfaces, by Ouzounis, Dimitrios and Nierhaus, Wolfgang; all of which are incorporated herein by reference.

Suitable alkylpolysaccharides for use herein are disclosed in U.S. Pat. No. 4,565,647, Llenado, issued Jan. 21, 1986, which is incorporated herein by reference, having a hydrophobic group containing from about 6 to about 30 carbon atoms, preferably from about 10 to about 16 carbon atoms and a polysaccharide, e.g., a polyglycoside, hydrophilic group. For acidic or alkaline cleaning compositions/solutions suitable for use in no-rinse methods, the preferred alkyl polysaccharide preferably comprises a broad distribution of chain lengths, as these provide the best combination of wetting, cleaning, and low residue upon drying. This "broad distribution" is defined by at least about 50% of the chainlength mixture comprising from about 10 carbon atoms to about 16 carbon atoms. Preferably, the alkyl group of the alkyl polysaccharide consists of a mixtures of chainlength, preferably from about 6 to about 18 carbon atoms, more preferably from about 8 to about 16 carbon atoms, and hydrophilic group containing from about 1 to about 1.5 saccharide, preferably glucoside, groups per molecule. A broad mixture of chain lengths, particularly $C_8$–$C_{16}$, is highly desirable relative to narrower range chain length mixtures, and particularly versus lower (i.e., $C_8$–$C_{10}$ or $C_8$–$C_{12}$) chainlength alkyl polyglucoside mixtures. It is also found that the preferred $C_8$–$C_{16}$ alkyl polyglucoside provides much improved perfume solubility versus lower and narrower chainlength alkyl polyglucosides, as well as other preferred surfactants, including the $C_8$–$C_{14}$ alkyl ethoxylates. Any reducing saccharide containing 5 or 6 carbon atoms can be used, e.g., glucose, galactose and galactosyl moieties can be substituted for the glucosyl moieties. (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6- positions on the preceding saccharide units. The glycosyl is preferably derived from glucose.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyidecyl, undecyidodecyl, tridecyl, tetradecyl, pentadecyl, hexadecyl, heptadecyl, and octadecyl, di-, tri-, tetra-, penta-, and hexaglucosides and/ or galatoses. Suitable mixtures include coconut alkyl, di-, tri-, tetra-, and pentaglucosides and tallow alkyl tetra-, penta- and hexaglucosides.

To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-,3-, 4- and/or 6-position, preferably predominantly the 2-position.

In the alkyl polyglycosides, the alkyl moieties can be derived from the usual sources like fats, oils or chemically produced alcohols while their sugar moieties are created from hydrolyzed polysaccharides. Alkyl polyglycosides are the condensation product of fatty alcohol and sugars like glucose with the number of glucose units defining the relative hydrophilicity. As discussed above, the sugar units can additionally be alkoxylated either before or after reaction with the fatty alcohols. Such alkyl polyglycosides are described in detail in WO 86/05199 for example. Technical alkyl polyglycosides are generally not molecularly uniform products, but represent mixtures of alkyl groups and mixtures of monosaccharides and different oligosaccharides. Alkyl polyglycosides (also sometimes referred to as "APG's") are preferred for the purposes of the invention since they provide additional improvement in surface appearance relative to other surfactants. The glycoside moieties are preferably glucose moieties. The alkyl substituent is preferably a saturated or unsaturated alkyl moiety containing from about 8 to about 18 carbon atoms, preferably from about 8 to about 10 carbon atoms or a mixture of such alkyl moieties. $C_8$–$C_{16}$ alkyl polyglucosides are commercially available (e.g., Simusol® surfactants from Seppic Corporation, 75 Quai d'Orsay, 75321 Paris, Cedex 7, France, and Glucopon®425 available from Henkel). However, it has been found that purity of the alkyl polyglucoside can also impact performance, particularly end result for certain applications, including daily shower product technology. In the present invention, the preferred alkyl polyglucosides are those which have been purified enough for use in personal cleansing. Most preferred are "cosmetic grade" alkyl polyglucosides, particularly $C_8$ to $C_{16}$ alkyl polyglucosides, such as Plantaren 2000®, Plantaren 2000 N®, and Plantaren 2000 N UP®, available from Henkel Corporation (Postfach 101100, D 40191 Dusseldorf, Germany).

In the context of floor, counter, wall, etc. applications, another class of preferred nonionic surfactant is alkyl ethoxylates. The alkyl ethoxylates of the present invention are either linear or branched, and contain from about 8 carbon atoms to about 14 carbon atoms, and from about 4 ethylene oxide units to about 25 ethylene oxide units. Examples of alkyl ethoxylates include Neodol® 91-6, Neodol 91-8® supplied by the Shell Corporation (P.O. Box 2463, 1 Shell Plaza, Houston, Tex.), and Alfonic® 810-60 supplied by Vista corporation, (900 Threadneedle P.O. Box 19029, Houston, Tex.). More preferred surfactants are the alkyl ethoxylates comprising from about 9 to about 12 carbon atoms, and from about 4 to about 8 ethylene oxide units. These surfactants offer excellent cleaning benefits and work synergistically with the required hydrophilic polymers. A most preferred alkyl ethoxylate is $C_{11}EO_5$, available from the Shell Chemical Company under the trademark Neodol® 1-5. This surfactant is found to provide desirable wetting and cleaning properties, and can be advantageously combined with the preferred $C_{8-16}$ alkyl polyglucoside in a matrix that includes the wetting polymers of the present invention. While not wishing to be limited by theory, it is believed that the $C_{8-16}$ alkyl polyglucoside can provide a superior end result (i.e., reduce hazing) in compositions that additionally contain the preferred alkyl ethoxylate particularly when the preferred alkyl ethoxylate is required for superior cleaning. The preferred the $C_{8-16}$ alkyl polyglucoside is also found to improve perfume solubility of compositions comprising alkyl ethoxylates. Higher levels of perfume can be advantageous for consumer acceptance.

The usage of liquid compositions according to the present invention are prepared with relatively low levels of active materials. Typically, compositions will comprise sufficient surfactant and optional solvent, as discussed hereinafter, to be effective as hard surface cleaners yet remain economical; accordingly they typically contain from about 0.005% to about 0.5% by weight of the composition of surfactant, preferably alkylpolyglycoside and/or $C_{8-14}$ alkylethoxylate surfactant, more preferably from about 0.01 % to about 0.4% surfactant, and even more preferably from about 0.01% to about 0.3% surfactant. It has been found that use of low, rather than high levels of surfactant are advantageous to overall end result performance. It is also been found that when the primary surfactant system includes preferred alkyl ethoxylates that end result hazing is mitigated by specific cosurfactants. These preferred cosurfactants are $C_8$ sulfonate and Poly-Tergent CS-1, and are further described below in Section d.

c. Optional Organic Cleaning Solvent

The compositions, optionally, can also contain one, or more, organic cleaning solvents at effective levels, typically no less than about 0.25%, and, at least about 0.5%, preferably at least about 3.0%, and no more than about 7%, preferably no more than about 5%, by weight of the composition.

The surfactant provides cleaning and/ or wetting even without an organic cleaning solvent present. However, the cleaning can normally be further improved by the use of the right organic cleaning solvent. By organic cleaning solvent, it is meant an agent which assists the surfactant to remove soils such as those commonly encountered in the bathroom. The organic cleaning solvent also can participate in the building of viscosity, if needed, and in increasing the stability of the composition. The compositions containing $C_{8-16}$ alkyl polyglucosides and/or $C_{8-14}$ alkylethoxylates also have lower sudsing when the solvent is present. Thus, the suds profile can be controlled in large part by simply controlling the level of hydrophobic solvent in the formulation.

Such solvents typically have a terminal $C_3$–$C_6$ hydrocarbon attached to from one to three ethylene glycol or propylene glycol moieties to provide the appropriate degree of hydrophobicity and, preferably, surface activity. Examples of commercially available hydrophobic cleaning solvents based on ethylene glycol chemistry include mono-ethylene glycol n-hexyl ether (Hexyl Cellosolve® available from Union Carbide). Examples of commercially available hydrophobic cleaning solvents based on propylene glycol chemistry include the di-, and tri-propylene glycol derivatives of propyl and butyl alcohol, which are available from Arco Chemical (3801 West Chester Pike, Newtown Square, Pa. 19073) and Dow Chemical (1691 N. Swede Road, Midland, Mich.) under the trade names Arcosolv® and Dowanol®.

In the context of the present invention, preferred solvents are selected from the group consisting of mono-propylene glycol mono-propyl ether; di-propylene glycol mono-propyl ether; mono-propylene glycol mono-butyl ether; di-propylene glycol mono-propyl ether; di-propylene glycol mono-butyl ether; tri-propylene glycol mono-butyl ether; ethylene glycol mono-butyl ether; di-ethylene glycol mono-butyl ether; ethylene glycol mono-hexyl ether; di-ethylene glycol mono-hexyl ether; and mixtures thereof. "Butyl" includes both normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnBO from Dow Chemical. Di-propylene glycol mono-t-butyl ether is commercially available from Arco Chemical under the tradename Arcosolv PTB®.

The amount of organic cleaning solvent can vary depending on the amount of other ingredients present in the composition. The hydrophobic cleaning solvent is normally helpful in providing good cleaning, such as in floor cleaner applications.

For cleaning in enclosed spaces, the solvent can cause the formation of undesirably small respirable droplets, so compositions/solutions for use in treating such spaces are desirably substantially free, more preferably completely free, of such solvents.

d. Optional Additional Cosurfactant

The liquid compositions of the present invention optionally can include a small amount of additional cosurfactant such as anionic and/or nonionic detergent surfactant. Such anionic surfactants typically comprise a hydrophobic chain containing from about 8 to about 18 carbon atoms, preferably from about 8 to about 16 carbon atoms, and typically include a sulfonate or carboxylate hydrophilic head group. In general, the level of optional, e.g., anionic, cosurfactants in the compositions herein is from about 0.01 % to about 0.25%, more preferably from about 0.01% to about 0.2%, most preferably from about 0.01% to about 0.1%, by weight of the composition.

In the context of floor, counter and other surface applications, the choice of cosurfactant can be critical in both selection of type and level. In compositions comprising $C_8$–$C_{14}$ alkyl ethoxylates, it is found that low levels of $C_8$ sulfonate can improve end result by providing a "toning" effect. By toning, it is meant an improvement in the visual appearance of the end result, due to less haziness. If present, the $C_8$ sulfonate is preferably used in from about 1:10 to about 1:1 weight ratio with respect to the primary surfactant (s). $C_8$ sulfonate is commercially available from Stepan under the tradename Bio-Terge PAS-8® as well as from the Witco Corporation under the tradename Witconate NAS-8®. Another outstanding "toning" surfactant of benefit to the present invention is Poly-Tergent CS-1 which can be purchased from BASF. If present, the Poly-Tergent CS-1 is preferably used in from about 1:20 to about 1:1 weight ratio with respect to the primary surfactant(s).

Other surfactants which can be used, though less preferably, and typically at very low levels, include $C_8$–$C_{18}$ alkyl sulfonates (Hostapur SAS® from Hoechst, Aktiengesellschaft, D-6230 Frankfurt, Germany), $C_{10}$–$C_{14}$ linear or branched alkyl benzene sulfonates, $C_9$–$C_{15}$ alkyl ethoxy carboxylates detergent surfactant (Neodox® surfactants available from Shell Chemical Corporation), $C_{10-14}$ alkyl sulfates and ethoxysulfates (e.g., Stepanol AM® from Stepan). Alkyl ethoxy carboxylates can be advantageously used at extremely low levels (about 0.01% or lower ) to dissolve perfume. This can be an important benefit given the low levels of active needed for the present invention to be most effective.

Alternative nonionic detergent surfactants for use herein are alkoxylated alcohols generally comprising from about 6 to about 16 carbon atoms in the hydrophobic alkyl chain of the alcohol. Typical alkoxylation groups are propoxy groups or propoxy groups in combination with ethoxy groups. Such compounds are commercially available under the tradename Antarox® available from Rhodia (P.O. Box 425 Cranberry, N.J. 08512) with a wide variety of chain length and alkoxylation degrees. Block copolymers of ethylene oxide and propylene oxide can also be used and are available from BASF under the tradename Pluronic®. Preferred nonionic detergent surfactants for use herein are according to the formula $R(X)_nH$, were R is an alkyl chain having from about 6 to about 16 carbon atoms, preferably from about 8 to about 12 carbon atoms, X is a propoxy, or a mixture of ethoxy and propoxy groups, n is an integer of from about 4 to about 30, preferably from about 5 to about 8. Other non-ionic surfactants that can be used include those derived from natural sources such as sugars and include $C_8$–$C_{16}$ N-alkyl glucose amide surfactants. If present, the concentration of alternative nonionic surfactant is from about 0.01% to about 0.2%, more preferably from about 0.01% to about 0.1%, by weight of the composition.

e. Mono- or Polycarboxylic Acid

For purposes of soap scum and hard water stain removal, the compositions can be made acidic with a pH of from about 2 to about 5, more preferably about 3. Acidity is accomplished, at least in part, through the use of one or more organic acids that have a pKa of less than about 5, preferably less than about 4. Such organic acids also can assist in phase formation for thickening, if needed, as well as provide hard water stain removal properties. It is found that organic acids are very efficient in promoting good hard water removal properties within the framework of the compositions of the present invention. Lower pH and use of one or more suitable acids is also found to be advantageous for disinfectancy benefits.

Examples of suitable mono-carboxylic acids include acetic acid, glycolic acid or β-hydroxy propionic acid and the like. Examples of suitable polycarboxylic acids include citric acid, tartaric acid, succinic acid, glutaric acid, adipic acid, and mixtures thereof. Such acids are readily available in the trade. Examples of more preferred polycarboxylic acids, especially non-polymeric polycarboxylic acids, include citric acid (available from Aldrich Corporation, 1001 West Saint Paul Avenue, Milwaukee, Wis.), a mixture of succinic, glutaric and adipic acids available from DuPont (Wilmington, Del.) sold as "refined AGS di-basic acids", maleic acid (also available from Aldrich), and mixtures thereof. Citric acid is most preferred, particularly for applications requiring cleaning of soap scum. Glycolic acid and the mixture of adipic, glutaric and succinic acids provide greater benefits for hard water removal. The amount of organic acid in the compositions herein can be from about 0.01% to about 1%, more preferably from about 0.01% to about 0.5%, most preferably from about 0.025% to about 0.25% by weight of the composition.

f. Odor Control Agents

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet surfaces. As the water is being removed however, e.g., the surface is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Preferably, the aqueous cleaning solution of the present invention is clear. The term "clear" as defined herein means transparent or translucent, preferably transparent, as in "water clear," when observed through a layer having a thickness of less than about 10 cm.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl—$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, Apr. 1994, p. 49, said references being incorporated herein by reference; and mixtures thereof. Other cyclodextrin derivatives are disclosed in U.S. Pat. Nos.: 3,426,011, Parmerter et al., issued Feb. 4, 1969; 3,453,257; 3,453,258; 3,453,259; and 3,453,260, all in the names of Parmerter et al., and all issued Jul. 1, 1969; 3,459,731, Gramera et al., issued Aug. 5, 1969; 3,553,191, Parmerter et al., issued Jan. 5, 1971; 3,565,887, Parmerter et al., issued Feb. 23, 1971; 4,535,152, Szejtli et al., issued Aug. 13, 1985; 4,616,008, Hirai et al., issued Oct. 7, 1986; 4,678,598, Ogino et al., issued Jul. 7, 1987; 4,638,058, Brandt et al., issued Jan. 20, 1987; and 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrin is alpha-cyclodextrin and/or its derivatives, gamma-cyclodextrin and/or its derivatives, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

It is preferable that the usage compositions of the present invention contain low levels of cyclodextrin so that no visible residue appears at normal usage levels. Preferably, the solution used to treat the surface under usage conditions is virtually not discernible when dry. Typical levels of cyclodextrin in usage compositions for usage conditions are from about 0.01% to about 1%, preferably from about 0.05% to about 0.75%, more preferably from about 0.1% to about 0.5% by weight of the composition. Compositions with higher concentrations can leave unacceptable visible residues.

g. Optional Source of Peroxide

The compositions of the invention can contain peroxide such as hydrogen peroxide, or a source of hydrogen peroxide, for further disinfectancy, fungistatic and fungicidal benefits. The components of the present composition are substantially compatible with the use of peroxides. Preferred peroxides include benzoyl peroxide and hydrogen peroxide. These can optionally be present in the compositions herein in levels of from about 0.05% to about 5%, more preferably from about 0.1% to about 3%, most preferably from about 0.2% to about 1.5%.

When peroxide is present, it is desirable to provide a stabilizing system. Suitable stabilizing systems are known. A preferred stabilizing system consists of radical scavengers and/or metal chelants present at levels of from about 0.01% to about 0.5%, more preferably from about 0.01% to about 0.25%, most preferably from about 0.01% to about 0.1%, by weight of the composition. Examples of radical scavengers include anti-oxidants such as propyl gallate, butylated hydroxy toluene (BHT), butylated hydroxy anisole (BHA) and the like. Examples of suitable metal chelants include diethylene triamine penta-acetate, diethylene triamine penta-methylene phosphonate, hydroxyethyl diphosphonate and the like.

h. Optional Thickening Polymer:

Low levels of polymer can also be used to thicken the preferred aqueous compositions of the present invention. To the extent a given polymer can be considered a hydrophilic polymer or a thickening polymer, such polymer shall be considered a hydrophilic polymer for purposes of the present invention. In general, the level of thickening polymer is kept as low as possible so as not to hinder the product's end result properties. Xanthan gum is a particularly preferred thickening agent as it can also enhance end result properties, particularly when used in low concentrations. The thickening polymer agent is present in from about 0.001% to about 0.1%, more preferably from about 0.0025% to about 0.05%, most preferably from about 0.005% to about 0.025%, by weight of the composition.

i. Aqueous Solvent System

The compositions which are aqueous, comprise at least about 80% aqueous solvent by weight of the composition, more preferably from about 80% to over 99% by weight of the composition. The aqueous compositions are typically in micellar form, and do not incorporate substantial levels of water insoluble components that induce significant micellar swelling.

The aqueous solvent system can also comprise, in addition to water, low molecular weight, highly water-soluble solvents typically found in detergent compositions, e.g., ethanol, isopropanol, etc. These solvents can be used to provide disinfectancy properties to compositions that are otherwise low in active. Additionally, they can be particularly useful in compositions wherein the total level of perfume is very low. In effect, highly volatile solvents can provide "lift", and enhance the character of the perfume. Highly volatile solvents, if present are typically present in from about 0.25% to about 5%, more preferably from about 0.5% to about 3%, most preferably from about 0.5% to about 2%, by weight of the composition. Examples of such solvents include methanol, ethanol, isopropanol, n-butanol, iso-butanol, 2-butanol, pentanol, 2-methyl-1-butanol, methoxymethanol, methoxyethanol, methoxy propanol, and mixtures thereof.

The compositions of the present invention can also include other solvents, and in particular paraffins and isoparaffins, which can substantially reduce the suds created by the composition.

j. Optional Suds Suppressor

Suitable silicone suds suppressors for use herein include any silicone and silica-silicone mixtures. Silicones can be generally represented by alkylated polysiloxane materials while silica is normally used in finely divided forms exemplified by silica aerogels and xerogels and hydrophobic silicas of various types. In industrial practice, the term "silicone" has become a generic term which encompasses a variety of relatively high-molecular-weight polymers containing siloxane units and hydrocarbyl groups of various types. Indeed, silicone compounds have been extensively described in the art, see for instance U.S. Pat. Nos. 4,076,648; 4,021,365; 4,749,740; 4,983,316 and European Patents: EP 150,872; EP 217,501; and EP 499,364, all of said patents being incorporated herein by reference. Preferred are polydiorganosiloxanes such as polydimethylsiloxanes having trimethylsilyl end blocking units and having a viscosity at 25° C. of from $5\times10^{-5}m^2/s$ to 0.1 $m^2/s$, i.e. a value of n in the range 40 to 1500. These are preferred because of their ready availability and their relatively low cost.

A preferred type of silicone compounds useful in the compositions herein comprises a mixture of an alkylated siloxane of the type hereinabove disclosed and solid silica. The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}m^2/s$ to $1m^2/s$. Preferred silicone compounds can have a viscosity in the range of from $5\times10^{31}$ $^3m^2/s$ to $0.1m^2/s$. Particularly suitable are silicone compounds with a viscosity of $2\times10^{-2}m^2/s$ or $4.5\times10^{-2}m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2-3597® both commercially available from Dow Corning.

k. Optional Perfume and/or Additional Adjuvants

Optional components, such as perfumes and/or other conventional adjuvants can also be incorporated in the present compositions.

Perfume

An optional, but highly preferred ingredient, is a perfume, usually a mixture of perfume ingredients. As used herein, perfume includes constituents of a perfume which are added primarily for their olfactory contribution, often complimented by use of a volatile organic solvent such as ethanol.

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface.

The perfumes are preferably those that are more water-soluble and/or volatile to minimize spotting and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Perfume components can be natural products such as essential oils, absolutes, resinoids, resins, concretes, etc., and/or synthetic perfume components such as hydrocarbons, alcohols, aldehydes, ketones, ethers, acids, acetals, ketals, nitriles, and the like, including saturated and unsaturated compounds, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate, terpineol, terpinyl acetate, acetate, 2-phenylethanol, 2-phenylethyl acetate, benzyl alcohol, benzyl acetate, benzyl salicylate, benzyl benzoate, styrallyl acetate, amyl salicylate, dimenthylbenzylcarbinol, trichloromethylphenycarbinyl acetate, p-tert.butyl-cyclohexyl acetate, isononyl acetate, alpha-n-amylcinammic aldehyde, alpha-hexyl-cinammic aldehyde, 2-methyl-3-(p-tert.butylphenyl)-propanal, 2-methyl-3(p-isopropylphenyl)propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3cyclohexenecarbaldehyde, 4-acetoxy-3-pentyl-tetrahhydropyran, methyl dihydrojasmonate, 2-n-heptyl-cyclopentanone, 3-methyl-2-pentyl-cyclopentanone, n-decanal, n-dodecanal, 9-decenol-1, phenoxyethyl isobutyrate, phenylacetaldehyde dimenthyl acetal, phenylacetaldehyde dicetyll acetal, geranonitrile, citronellonitrile, cedryl acetate, 3-isocamphyl-cyclohexanol, cedryl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musks, tetralin musks, isochroman musks, macrocyclic ketones, macrolactone musks, ethylene brassylate, and aromatic nitromusk. Compositions herein typically comprise from 0.1% to 2% by weight of the total composition of a perfume ingredient, or mixtures thereof, preferably from 0.1% to 1%. In the case of the preferred embodiment containing peroxide, the perfumes must be chosen so as to be compatible with the oxidant.

In a preferred execution, the perfume ingredients are hydrophobic and highly volatile, e.g., ingredients having a boiling point of less than about 260° C., preferably less than about 255° C. ; and more preferably less than about 250° C., and a ClogP of at least about 3, preferably more than about 3.1, and even more preferably more than about 3.2.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. lnf. Comput. Sci., 29, 163 (1989); and Broto's method as disclosed in Eur. J. Med. Chem. - Chim. Theor., 19, 71 (1984).

Other Adjuvants

The compositions herein can comprise a variety of other optional ingredients, including further actives and detergent builder, as well as primarily aesthetical ingredients.

In particular the rheology of the compositions herein can be made suitable for suspending particles in the composition, e.g., particles of abrasives.

Detergency Builders

Detergent builders that are efficient for hard surface cleaners and have reduced filming/streaking characteristics at the critical levels are another optional ingredient. Preferred detergent builders are the carboxylic acid detergent builders described hereinbefore as part of the polycarboxylic acid disclosure, including citric and tartaric acids. Tartaric acid improves cleaning and can minimize the problem of filming/streaking that usually occurs when detergent builders are added to hard surface cleaners.

The detergent builder is present at levels that provide detergent building, and, those that are not part of the acid pH adjustment described hereinbefore, are typically present at a level of from about 0.01% to about 0.3%, more preferably from about 0.005% to about 0.2%, and most preferably from about 0.05% to about 0.1%, by weight of the composition.

Buffers

The compositions herein can also contain other various adjuncts such as buffers, preservatives, and antibacterial agents, which are known to the art for detergent compositions. Preferably they are not used at levels that cause unacceptable filming/streaking. Buffers are an important class of adjuncts in the present compositions. This occurs mainly as a result of the low levels of active employed. An ideal buffer system will maintain pH over a desired narrow range, while not leading to streaking/filming issues. Preferred buffers in the context of the invention are those which are highly volatile, yet can provide cleaning benefits in use. As such, they are advantageous in that they can be used at higher levels than corresponding buffers that are less volatile. Such buffers tend to have low molecular weight, i.e., less than about 150 g/mole and generally contain no more than one hydroxy group. Examples of preferred buffers include ammonia, methanol amine, ethanol amine, 2-amino-2-methyl-1-propanol, 2-dimethylamino-2-methyl-1-propanol, acetic acid, glycolic acid, and the like. Most preferred among these are ammonia, 2-dimethylamino-2-methyl-1-propanol, and acetic acid. When used, these buffers are typically present at levels of from about 0.005% to about 0.5%, by weight of the composition, with the higher levels being more preferred for the more volatile buffer materials.

Non-volatile buffers can also be used in this invention. Such buffers are used at generally lower levels than the preferred levels because of increased streaking/filming tendencies. Examples of such buffers include, but are not limited to, sodium carbonate, potassium carbonate and bicarbonate, 1,3-bis(aminomethyl) cyclohexane, sodium citrate, citric acid, maleic acid, tartaric acid, and the like. Maleic acid is particularly preferred as a buffer because of its tendency not to induce surface damage. Citric acid is also desirable since it provides anti-microbial benefits as a registered EPA active. Additionally, in compositions comprising the hydrophilic polymers of the present invention for daily shower applications, acidity has been found to promote better wetting and provide longer lasting "sheeting" effects. When used, non-volatile buffers are present in from about 0.001% to about 0.05% by weight of the composition.

Non-limiting examples of other adjuncts are: enzymes such as proteases; hydrotropes such as sodium toluene sulfonate, sodium cumene sulfonate, and potassium xylene sulf6nate; and aesthetic-enhancing ingredients such as colorants, providing they do not have an adverse impact on filming/streaking.

Preservatives and Antibacterial Agents

Preservatives can also be used, and may be required in many of the compositions of the present invention, since they contain high levels of water. Examples of preservatives include bronopol, hexitidine sold by Angus chemical (211 Sanders Road, Northbrook, Ill., USA). Other preservatives include Kathon®, 2-((hydroxymethyl) (amino)ethanol, propylene glycol, sodium hydroxymethyl amino acetate, formaldehyde and glutaraldehyde, dichloro-s-triazinetrione, trichloro-s-triazinetrione, and quaternary ammonium salts including dioctyl dimethyl ammonium chloride, didecyl dimethyl ammonium chloride, $C_{12}$, $C_{14}$ and $C_{16}$ dimethyl benzyl. Preferred preservatives include 1,2-benzisothiazolin-3-one and polyhexamethylene biguanide sold by Avicia Chemicals (Wilmington, Del. 19897), chlorhexidine diacetate sold by Aldrich-Sigma (1001 West Saint Paul Avenue, Milwaukee, Wis. 53233), and sodium pyrithione sold by Arch Chemicals (501 Merritt Seven, P.O. Box 5204, Norwalk Conn. 06856). When used, preservatives are preferentially present at concentrations of from about 0.0001% to about 0.01%. These same preservatives can function to provide antibacterial control on the surfaces, but typically will require use at higher levels from about 0.005 to about 0.1%. Other antibacterial agents, including quaternary ammonium salts, can be present, but are not preferred in the context of the present invention at high levels, i.e., at levels greater than about 0.05%. Such compounds have been found to often interfere with the benefits of the preferred polymers. In particular, quaternary ammonium surfactants tend to hydrophobically modify hard surfaces. Thus, the preferred polymers are found to be ineffective in compositions comprising significant concentrations of quaternary ammonium surfactants. Similar results have been found using amphoteric surfactants, including lauryl betaines and coco amido betaines. When present, the level of cationic or amphoteric surfactant should be at levels below about 0.1%, preferably below about 0.05%. More hydrophobic antibacterial/germicidal agents, like orthobenzyl-para-chlorophenol, are to be avoided. If present, such materials should be kept at levels below about 0.05%.

COMPOSITIONS, INCLUDING BATHROOM, FLOOR, COUNTER. WALL CLEANING, AND GLASS COMPOSITIONS

The present invention relates to compositions for the cleaning of floors, counters, walls, and other surfaces for which no, or minimal, rinsing is required. Examples of such applications include ready-to-use aqueous cleaners and dilutable aqueous, multipurpose cleaners. These compositions can be used with conventional cleaning processes such as sponge mops, string mops, strip mops, cloth, paper towels, sponges, rags, and the like, as disclosed hereinafter.

A. "Daily Shower" Compositions

Compositions for use in the bathroom and/or shower on a regular basis provide the benefit of maintaining cleanliness and appearance rather than having to remove large amounts of built-up soil. Such compositions are used after each shower, bath, wash-up, and the like, and left on to protect the surface and make the removal of any subsequent soil easier. Such compositions are essentially dilute "usage" compositions.

These compositions typically comprise:

a. an effective amount to reduce the contact angle and/or increase surface hydrophilicity, up to about 0.5%, preferably from about 0.005% to about 0.4%, more preferably from about 0.01% to about 0.3%; by weight of the composition, of hydrophilic polymer, preferably substantive, that renders the treated surface hydrophilic, and preferably is a polymer selected from the group consisting of: polystyrene sulfonate; polyvinyl pyrrolidone; polyvinyl pyrrolidone acrylic acid copolymer; polyvinyl pyrrolidone acrylic acid copolymer sodium salt; polyvinyl pyrrolidone acrylic acid copolymer potassium salt; polyvinyl pyrrolidone- vinyl imidazoline; polyvinyl pyridine; polyvinyl pyridine n-oxide; and mixtures thereof; and more preferably polyvinyl pyridine n-oxide;

b. optionally, but preferably, an effective amount of primary detergent surfactant, preferably from about 0.005% to about 0.5%, more preferably from about 0.01% to about 0.4%, most preferably from about 0.025% to about 0.3%, by weight of the composition, said primary detergent surfactant preferably comprising alkyl polysaccharide detergent surfactant having an alkyl group containing from about 8 to about 18 carbon atoms, more preferably from about 8 to about 16 carbon atoms, and from about one to about four, preferably from about one to about 1.5 saccharide moieties per molecule and/or a combination consisting of alkyl polysaccharide detergent surfactant having an alkyl group containing from about 8 to about 18 carbon atoms, more preferably from about 8 to about 16 carbon atoms, and from about one to about four, preferably from about one to about 1.5 saccharide moieties per molecule together with an alkyl ethoxylate comprising from about 8 to about 16 carbon atoms and from about 4 to about 25 oxyethylene units;

c. optionally, an effective amount to provide increased cleaning of organic cleaning solvent, preferably from about 0.25% to about 5%, preferably from about 0.5% to about 4%, more preferably from about 0.5% to about 3%, by weight of the composition, and is preferably selected from the group consisting of: mono-propylene glycol mono-propyl ether; mono-propylene glycol mono-butyl ether; di-propylene glycol mono-propyl ether; di-propylene glycol mono-butyl ether; di-propylene glycol mono-butyl ether; tri-propylene glycol mono-butyl ether; ethylene glycol mono-butyl ether; diethylene glycol mono-butyl ether, ethylene glycol mono-hexyl ether; diethylene glycol mono-hexyl ether; and mixtures thereof;

d. optionally, a minor amount that is less than the amount of primary detergent surfactant b., preferably from about 0.005% to about 0.5%, more preferably from about 0.01% to about 0.4%, and even more preferably from about 0.025% to about 0.3%, by weight of the composition, of cosurfactant, preferably anionic and/or nonionic detergent surfactant, more preferably selected from the group consisting of: $C_8$–$C_{12}$ linear sulfonates, $C_8$–$C_{18}$ alkylbenzene sulfonates; $C_8$–$C_{18}$ alkyl sulfates; $C_8$–$C_{18}$ alkylpolyethoxy sulfates; and mixtures thereof;

e. optionally, an effective amount to improve cleaning and/or antimicrobial action, preferably from about 0.01% to about 1%, more preferably from about 0.01% to about 0.5%, and even more preferably from about 0.01% to about 0.25%, by weight of the composition, of water-soluble mono- or polycarboxylic acid;

f. optionally, an effective amount, up to about 1%, preferably from about 0.01% to about 0.5%, more preferably from about 0.025% to about 0.25%, by weight of the composition, of cyclodextrin, preferably alpha, beta, or gamma substituted cyclodextrin, and optionally, with short chain (14 carbon atoms) alkyl or hydroxyalkyl groups; the cyclodextrin is preferably beta-cyclodextrin, hydroxypropyl cyclodextrin, or mixtures thereof;

g. optionally, an effective amount to provide bleaching, cleaning, and/or antibacterial action, up to about 5%, preferably from about 0.1% to about 4%, more preferably from about 1% to about 3%, by weight of the composition, of hydrogen peroxide;

h. optionally, from about 0.005% to about 1%, preferably from about 0.005% to about 0.5%, more preferably from about 0.01% to about 0.1%, by weight of the composition, of a thickening polymer selected from the group consisting of polyacrylates, gums, and mixtures thereof;

i. optionally, an effective amount of perfume to provide odor effects, and/or additional adjuvants; and j. optionally, an effective amount, preferably from about 0.0001% to about 0.1%, more preferably from about 0.00025% to about 0.05%, and even more preferably from about 0.001% to about to about 0.01%, by weight of the composition, of suds suppressor, preferably silicone suds suppressor, and optionally, but preferably, the balance being an aqueous solvent system, comprising water, and optional water soluble solvent, and wherein said composition has a pH under usage conditions of from about 2 to about 12, preferably from about 3 to about 11.5, with acidic compositions having a pH of from about 2 to about 6, preferably from about 3 to about 5.

The ingredients in these "daily shower" compositions are selected so as to avoid the appearance of spots/films on the treated surface, even when the surface is not rinsed or wiped completely to a dry state. For stress conditions, the selection of both a polyvinylpyridine amine oxide, or polyvinylpyridine polymer, and a preferred primary detergent surfactant, such as an alkyl polysaccharide detergent surfactant, are required for optimum appearance.

B. Glass Cleaner Compositions

Glass cleaner compositions typically contain less materials than other compositions, since glass composition residues are more easily seen. For these compositions, only the optimal polymers and surfactants, and methods which provide at least some rubbing action, are required.

Glass cleaner compositions comprise:

a. an effective amount to reduce the contact angle and/or increase surface hydrophilicity, up to about 0.5%, preferably from about 0.005% to about 0.4%, more preferably from about 0.01% to about 0.3%, by weight of the composition, of hydrophilic polymer, preferably substantive, that renders the treated surface hydrophilic, and preferably is a polymer selected from the group consisting of: polystyrene sulfonate; polyvinyl pyrrolidone; polyvinyl pyrrolidone acrylic acid copolymer; polyvinyl pyrrolidone acrylic acid copolymer sodium salt; polyvinyl pyrrolidone acrylic acid copolymer potassium salt; polyvinyl pyrrolidone- vinyl imidazoline; polyvinyl pyridine; polyvinyl pyridine n-oxide; and mixtures thereof; and more preferably polyvinyl pyridine n-oxide;

b. an effective amount of primary detergent surfactant, preferably from about 0.001% to about 0.5%, more preferably from about 0.005% to about 0.3%, most preferably from about 0.025% to about 0.3%, by weight of the composition, said primary detergent surfactant preferably comprising as the primary surfactant, alkyl polysaccharide detergent surfactant having an alkyl group containing from about 8 to about 18 carbon atoms, more preferably from about 8 to about 16 carbon atoms, the alkyl distribution wherein at least about 50% of the chainlength mixture comprises from about 10 carbon atoms to about 16 carbon atoms, optionally, as the primary surfactant, but preferably as the cosurfactant, a minor amount that is less than the amount of primary surfactant, e.g., from about 0.0001% to about 0.3%, preferably from about 0.001% to about 0.2%, more preferably from about 0.05% to about 0.2%, of cosurfactant;

c. optionally, an effective amount to provide increased cleaning, e.g., from about 0.5% to about 7%, preferably from about 0.5% to about 5%, more preferably from about 0.5% to about 3%, of one or more organic cleaning solvents, preferably selected from the group consisting of: mono-propylene glycol mono-propyl ether; mono-propylene glycol mono-butyl ether; di-propylene glycol mono-propyl ether; di-propylene glycol mono-butyl ether; di-propylene glycol mono-butyl ether; tri-propylene glycol mono-butyl ether; ethylene glycol mono-butyl ether; diethylene glycol mono-butyl ether; ethylene glycol mono-hexyl ether; diethylene glycol mono-hexyl ether; and mixtures thereof;

d. optionally, an effective amount to provide bleaching, cleaning, and/or antibacterial action, up to about 5%, preferably from about 0.1% to about 4%, more preferably from about 1% to about 3%, of hydrogen peroxide;

e. optionally, an effective amount of perfume to provide odor effects and/or additional adjuvants; and the balance being an aqueous solvent system comprising water and optional water-soluble solvent, and wherein said treatment solution has a pH under usage conditions of from about 3 to about 11.5, preferably from about 4 to about 10.

Glass cleaning compositions comprising the polymers of the present invention can be used as a spray execution, and with one or more substrates, including rags, cloths, or paper towels. In such a context, it has been found that some of the preferred polymers, such as polyvinyl amine oxides provide anti-fog benefits. It is believed that the hygroscopic properties of the preferred polymers are responsible for the benefits.

C. General Purpose and Conventional Floor Cleaning Compositions

The general purpose and conventional floor cleaning compositions of the present invention can be either liquid or solid and can be used diluted, or, for the liquid, full strength. These compositions comprise:

a. an effective amount to reduce the contact angle and/or increase surface hydrophilicity, up to about 0.5%, preferably from about 0.005% to about 0.2%, more preferably from about 0.0125% to about 0.1%, by weight of the composition, of hydrophilic polymer, preferably substantive, that renders the treated surface hydrophilic, and preferably is a polymer selected from the group consisting of: polystyrene sulfonate; polyvinyl pyrrolidone; polyvinyl pyrrolidone acrylic acid copolymer; polyvinyl pyrrolidone acrylic acid copolymer sodium salt; polyvinyl pyrrolidone acrylic acid copolymer potassium salt; polyvinyl pyrrolidone- vinyl imidazoline; polyvinyl pyridine; polyvinyl pyridine n-oxide; and mixtures thereof; and more preferably polyvinyl pyridine n-oxide;

b. an effective amount of primary detergent surfactant, preferably from about 0.005% to about 10%, more preferably from about 0.01% to about 8%, most preferably from about 0.025% to about 4%, by weight of the composition, said primary detergent surfactant preferably comprising alkyl polysaccharide detergent surfactant having an alkyl group containing from about 8 to about 18 carbon atoms, more preferably from about 8 to about 16 carbon atoms, and from about one to about four, preferably from about one to about 1.5 saccharide moieties per molecule, preferably having a broad alkyl distribution, and, optionally, cosurfactant, preferably anionic and/or nonionic detergent surfactant, e.g., preferably selected from the group consisting of: $C_8$–$C_{12}$ linear sulfonates, $C_8$–$C_{18}$ alkylbenzene sulfonates; $C_8$–$C_{18}$ alkyl sulfates; $C_8$–$C_{18}$ alkylpolyethoxy sulfates; and mixtures thereof;

c. optionally, an effective amount to provide increased cleaning of organic cleaning solvent, preferably from about 0.5% to about 10%, preferably from about 0.5% to about 6%, more preferably from about 0.5% to about 5%, by weight of the composition, and is preferably selected from the group consisting of: mono-propylene glycol mono-propyl ether; mono-propylene glycol mono-butyl ether; di-propylene glycol mono-propyl ether; di-propylene glycol mono-butyl ether; di-propylene glycol mono-butyl ether; tri-propylene glycol mono-butyl ether; ethylene glycol mono-butyl ether; diethylene glycol mono-butyl ether, ethylene glycol mono-hexyl ether; diethylene glycol mono-hexyl ether; and mixtures thereof;

d. optionally, an effective amount to improve cleaning and/or antimicrobial action, preferably from about 0.01% to about 1%, more preferably from about 0.01% to about 0.5%, and even more preferably from about 0.01% to about 0.25%, by weight of the composition, of water-soluble mono- or polycarboxylic acid;

e. optionally, an effective amount, up to about 1%, preferably from about 0.01% to about 0.5%, more preferably from about 0.025% to about 0.25%, by weight of the composition, of cyclodextrin, preferably alpha, beta, or gamma substituted cyclodextrin, and optionally, with short chain (14 carbon atoms) alkyl or hydroxyalkyl groups; the cyclodextrin is preferably beta-cyclodextrin, hydroxypropyl cyclodextrin, or mixtures thereof;

f. optionally, an effective amount to provide bleaching, cleaning, and/or antibacterial action, up to about 5%, preferably from about 0.1% to about 4%, more preferably from about 1% to about 3%, by weight of the composition, of hydrogen peroxide;

g. optionally, from about 0.005% to about 1%, preferably from about 0.005% to about 0.5%, more preferably from about 0.01% to about 0.1%, by weight of the composition, of a thickening polymer selected from the group consisting of polyacrylates, gums, and mixtures thereof;

h. optionally, an effective amount of perfume to provide odor effects, and/or additional adjuvants; and i. optionally, an effective amount, preferably from about 0.0001% to about 0.1%, more preferably from about 0.00025% to about 0.05%, and even more preferably from about 0.001% to about to about 0.01%, by weight of the composition, of suds suppressor, preferably silicone suds suppressor, and the balance being an aqueous solvent system, comprising water and optional water soluble solvent, or, less preferably, the balance comprising water and inorganic salts including detergent builders and/or inert salts and/or abrasives, and wherein said composition has a pH under usage conditions of from about 2 to about 12, preferably from about 3 to about 11.5, with acidic compositions having a pH of from about 2 to about 6, preferably from about 3 to about 5.

D. Wet Wipes for Glass and Shiny Surfaces, Floors, Counter Walls and Other Surfaces The glass cleaning compositions described in Section B. above and General Purpose and Floor compositions described in Section C. above can be used in a premoistened wipe. The wipe substrate can be composed of suitable unmodified and/or modified naturally occurring fibers including cotton, Esparto grass, bagasse, hemp, flax, silk, wool, wood pulp, chemically modified wood pulp, jute, ethyl cellulose, and/or cellulose acetate. Suitable synthetic fibers can comprise fibers of one, or more, of polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX® and polypropylene, polyamides such as nylon, polyesters such as DACRON® or KODEL®, polyurethanes, polystyrenes, and the like, including fibers comprising polymers containing more than one monomer. The absorbent layer can comprise solely naturally occurring fibers, solely synthetic fibers, or any compatible combination of naturally occurring and synthetic fibers.

The fibers useful herein can be hydrophilic, hydrophobic, or can be a combination of both hydrophilic and hydrophobic fibers. As indicated above, the particular selection of hydrophilic or hydrophobic fibers depends upon the other materials included in the absorbent (and to some degree) the scrubbing layer described hereinafter. Suitable hydrophilic fibers for use in the present invention include cellulosic fibers, modified cellulosic fibers, rayon, cotton, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene, polypropylene, polyacrylics, polyamides, polystyrenes, polyurethanes and the like.

Suitable wood pulp fibers can be obtained from well-known chemical processes such as the Kraft and sulfite processes. It is especially preferred to derive these wood pulp fibers from southern soft woods due to their premium absorbency characteristics. These wood pulp fibers can also be obtained from mechanical processes, such as ground wood, refiner mechanical, thermomechanical, chemimechanical, and chemi-thermomechanical pulp processes. Recycled or secondary wood pulp fibers, as well as bleached and unbleached wood pulp fibers, can be used.

Another type of hydrophilic fibers for use in the present invention are chemically stiffened cellulosic fibers. As used herein, the term "chemically stiffened cellulosic fibers" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking polymer chains.

Where fibers are used as the absorbent layer (or a constituent component thereof), the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or substrate of fibers together in each of the respective layers. This can be beneficial in providing additional overall integrity to the cleaning wipe.

Amongst its various effects, bonding at the fiber intersections increases the overall compressive modulus and strength of the resulting thermally bonded member. In the case of the chemically stiffened cellulosic fibers, the melting and migration of the thermoplastic material also has the effect of increasing the average pore size of the resultant substrate, while maintaining the density and basis weight of the substrate as originally formed. This can improve the fluid acquisition properties of the thermally bonded substrate upon initial exposure to fluid, due to improved fluid permeability, and upon subsequent exposure, due to the combined ability of the stiffened fibers to retain their stiffness upon wetting and the ability of the thermoplastic material to remain bonded at the fiber intersections upon wetting and upon wet compression. In net, thermally bonded substrates of stiffened fibers retain their original overall volume, but with the volumetric regions previously occupied by the thermoplastic material becoming open to thus increase the average interfiber capillary pore size.

Thermoplastic materials useful in the present invention can be in any of a variety of forms including particulates, fibers, or combinations of particulates and fibers. Thermoplastic fibers are a particularly preferred form because of their ability to form numerous interfiber bond sites. Suitable thermoplastic materials can be made from any thermoplastic polymer that can be melted at temperatures that will not extensively damage the fibers that comprise the primary substrate or matrix of each layer. Preferably, the melting point of this thermoplastic material will be less than about 190° C., and preferably between about 75° C. and about 175° C. In any event, the melting point of this thermoplastic material should be no lower than the temperature at which the thermally bonded absorbent structures, when used in the cleaning pads, are likely to be stored. The melting point of the thermoplastic material is typically no lower than about 50° C.

The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like. Depending upon the desired characteristics for the resulting thermally bonded absorbent member, suitable thermoplastic materials include hydrophobic fibers that have been made hydrophilic, such as surfactant-treated or silica-treated thermoplastic fibers derived from, for example, polyolefins such as polyethylene or polypropylene, polyacrylics, polyamides, polystyrenes, polyurethanes and the like. The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and resolidification, the surfactant will tend to remain at the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Conn. Besides nonionic surfactants, anionic surfactants can also be used. These surfactants can be applied to the thermoplastic fibers at levels of, for example, from about 0.2 to about 1 gram per square centimeter of thermoplastic fiber.

Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer.

Suitable bicomponent fibers for use in the present invention can include sheath/core fibers having the following polymer combinations: polyethylene/ polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s, Chisso Corp., and CELBOND®, available from Hercules). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses.

Methods for preparing thermally bonded fibrous materials are described in U.S. application Ser. No. 08/479,096 (Richards et al.), filed Jul. 3, 1995 (see especially pages 16–20) and U.S. Pat. No. 5,549,589 (Horney et al.), issued Aug. 27, 1996 (see especially Columns 9 to 10). The disclosures of both of these references are incorporated herein by reference.

The absorbent layer can also comprise a HIPE-derived hydrophilic, polymeric foam. Such foams and methods for their preparation are described in U.S. Pat. No. 5,550,167 (DesMarais), issued Aug. 27, 1996; and commonly assigned U.S. patent application Ser. No. 08/370,695 (Stone et al.), filed Jan. 10, 1995 (both of which are incorporated herein by reference).

The wipe can consist of one or more layers including an optional scrub layer for maximum cleaning efficiency. For pre-moistened wipes that use a single substrate, the substrate preferably contains fibers comprising of some combination of hydrophilic and hydrophobic fibers, and more preferably fibers comprising at least about 30% hydrophobic fibers and even more preferably at least about 50% of hydrophobic fibers in a hydroentangled substrate. The term "hydrophobic fibers" includes polyester fibers as well as fibers derived from polyolefins such as polyethylene, polypropylene, and the like. The combination of hydrophobic fibers and absorbent hydrophilic fibers represents a particularly preferred embodiment for the single substrate pre-moistened wipe since the absorbent hydrophilic fibers, typically cellulose, aid in the sequestering and removal of dust and other soils present on the surface. The hydrophobic fibers are particularly useful in cleaning greasy soils, in improving the pre-moistened wipe and in lowering the friction between substrate and hard surface (glide). In terms of rank ordering of fiber composition for improved glide, the inventors have found polyester fibers, particularly polyester fibers in combination with polypropylene fibers, to be most effective in providing excellent glide, followed by polyethylene fibers. Cellulose (or rayon) based pre-moistened wipes, though highly absorbent, lead to significant friction between substrate and surface to be cleaned. Fiber blends are more difficult to rank order for providing excellent glide, though it has been found that even low levels of polyester or polypropylene fiber content can significantly improve the glide performance in virtually all cases. Fiber compositions that typically have a coefficient of friction with glass can be improved, as needed, by impregnating or chemically bonding the wipe with low levels of silicone or other chemicals that are known to reduce friction. Silicones are preferred since they also reduce composition sudsing, leading to improved result.

Various forming methods can be used to form a suitable fibrous substrate for the premoistened wipes of the present invention. For instance, the substrate can be made by nonwoven dry forming techniques, such as air-laying, or alternatively by wet laying, such as on a paper-making machine. Other non-woven manufacturing techniques, including but not limited to techniques such as melt blown, spunbonded, needle punched, and hydroentanglement methods, can also be used.

In one embodiment, the dry fibrous substrate can be an airlaid nonwoven substrate comprising a combination of natural fibers, staple length synthetic fibers, and a latex binder. The dry fibrous substrate can be from about 20% to about 80%, by weight, of wood pulp fibers, from about 10% to about 60%, by weight, of staple length polyester fibers, and from about 10% to about 25%, by weight, of binder.

The dry, fibrous substrate can have a basis weight of between about 30 and about 100 grams per square meter. The density of the dry substrate can be measured after evaporating the liquid from the premoistened wipe, and the density can be less than about 0.15 grams per cubic centimeter. The density is the basis weight of the dry substrate divided by the thickness of the dry substrate, measured in consistent units, and the thickness of the dry substrate is measured using a circular load foot having an area of about 2 square inches and which provides a confining pressure of about 95 grams per square inch. In one embodiment, the dry substrate can have a basis weight of about 64 grams per square meter, a thickness of about 0.06 cm, and a density of about 0.11 grams per cubic centimeter.

In one embodiment, the dry fibrous substrate can comprise at least about 50 percent, by weight, of wood pulp fibers, and more preferably at least about 70 percent by weight wood pulp fibers. One particular airlaid nonwoven substrate which is suitable for use in the present invention comprises about 73.5 percent by weight cellulosic fibers (Southern softwood Kraft having an average fiber length of about 2.6 mm); about 10.5 percent by weight polyester fibers having a denier of about 1.35 gram/9000 meter of fiber length and a staple length of about 0.85 inch; and about 16 percent by weight of a binder composition comprising a styrene butadiene copolymer. The binder composition can be made using a latex adhesive commercially available as Rovene™ 5550 (49 percent solids styrene butadiene) available from Mallard Creek Polymers of Charlotte, N.C.

One suitable airlaid non-woven substrate for use in the present invention is the airlaid nonwoven substrate employed in PAMPERS® BABY FRESH brand baby wipes marketed by The Procter & Gamble Co. of Cincinnati, Ohio.

The following patents are incorporated herein by reference for their disclosure related to substrates: U.S. Pat. No. 3,862,472 issued Jan 28, 1975; U.S. Pat. No. 3,982,302 issued Sep. 28, 1976; U.S. Pat. No. 4,004,323 issued Jan. 25, 1977; U.S. Pat. No. 4,057,669 issued Nov. 8, 1977; U.S. Pat. No. 4,097,965 issued Jul. 4, 1978; U.S. Pat. No. 4,176,427 issued Dec. 4, 1979; U.S. Patent 4,130,915 issued Dec. 26, 1978; U.S. Pat. No. 4,135,024 issued Jan. 16, 1979; U.S. Pat. No. 4,189,896 issued Feb. 26,1980; U.S. Pat. No. 4,207,367 issued Jun. 10, 1980; U.S. Pat. No. 4,296,161 issued Oct. 20, 1981; U.S. Pat. No. 4,309,469 issued Jan 25, 1982; U.S. Pat. No. 4,682,942 issued Jul. 28, 1987; and U.S. Pat. Nos. 4,637,859; 5,223,096; 5,240,562; 5,556,509; and 5,580,423.

The art recognizes the use of dusting sheets such as those in U.S. Pat. No. 3,629,047, U.S. Pat. No. 3,494,421, U.S. Pat. No. 4,144,370, U.S. Pat. No. 4,808,467, U.S. Pat. No. 5,144,729, and U.S. Pat. No. 5,525,397, all of which are incorporated herein by reference, as effective for picking up and retaining particulate dirt. These sheets require a structure that provides reinforcement yet free fibers in order to be effective. It has been found that similar structures used dry for dusting can also be advantageously used when premoistened with liquid at levels of at least about 0.5 gram of chemical solution per gram of dry substrate or greater. These levels are significantly higher than the levels used for chemical additives such as mineral oils; waxes, and the like, often applied to conventional dusting sheets to enhance performance. In particular, the wipes of this invention are specifically intended to be used pre-moistened with aqueous compositions.

In one preferred embodiment, the cleaning sheet has at least two regions where the regions are distinguished by basis weight. The measure for basis weight is described in US Provisional Applications 60/055,330 and 60/047,619. Briefly, the measurement is achieved photographically, by differentiating dark (low basis weight) and light (high basis) network regions. In particular, the cleaning sheet comprises one or more low basis weight regions, wherein the low basis region(s) have a basis weight that is not more than about 80% of the basis weight of the high basis weight regions. In one preferred aspect, the first region is relatively high basis weight and comprises an essentially continuous network. The second region comprises a plurality of mutually discrete regions of relatively low basis weight and which are circumscribed by the high basis weight first region. In particular, a preferred cleaning sheet comprises a continuous region having a basis weight of from about 30 to about 120 grams per square meter and a plurality of discontinuous regions circumscribed by the high basis weight region, wherein the discontinuous regions are disposed in a random, repeating pattern and have a basis weight of not more than about 80% of the basis weight of the continuous region.

In one embodiment, the cleaning sheet will have, in addition to regions which differ with regard to basis weight, substantial macroscopic three-dimensionality. The term "macroscopic three-dimensionality", when used to describe three dimensional cleaning sheets means a three dimensional pattern is readily visible to the naked eye when the perpendicular distance between the viewer's eye and the plane of the sheet is about 12 inches. In other words, the three dimensional structures of the pre-moistened sheets of the present invention are cleaning sheets that are non-planar, in that one or both surfaces of the sheets exist in multiple planes. By way of contrast, the term "planar", refers to sheets having fine-scale surface aberrations on one or both sides, the surface aberrations not being readily visible to the naked eye when the perpendicular distance between the viewer's eye and the plane of the sheet is about 12 inches. In other words, on a macro scale the observer will not observe that one or both surfaces of the sheet will exist in multiple planes so as to be three-dimensional.

The measure for three-dimensionality is described in U.S. Provisional Applications 60/055,330 and 60/047,619.

Briefly, macroscopic three-dimensionality is described in terms of average height differential, which is defined as the average distance between adjacent peaks and valleys of a given surface of a sheet, as well as the average peak to peak distance, which is the average distance between adjacent peaks of a given surface. Macroscopic three dimensionality is also described in terms of surface topography index of the outward surface of a cleaning sheet; surface topography index is the ratio obtained by dividing the average height differential of a surface by the average peak to peak distance of that surface. In a preferred embodiment, a macroscopically three-dimensional cleaning sheet has a first outward surface and a second outward surface wherein at least one of the outward surfaces has a peak to peak distance of at least about 1 mm and a surface topography index from about 0.01 mm to about 10 mm. The macroscopically three-dimensional structures of the pre-moistened wipes of the present invention optionally comprise a scrim, which, when heated and the cooled, contracts so as to provide further macroscopic three-dimensional structure.

In another alternative embodiment, the substrate can comprise a laminate of two outer hydroentangled substrates, such as nonwoven substrates of polyester, rayon fibers or blends thereof having a basis weight of about 10 to about 60 grams per square meter, joined to an inner constraining layer, which can be in the form of net like scrim material which contracts upon heating to provide surface texture in the outer layers..

The pre-moistened wipe is made by wetting the dry substrate with at least about 1.0 gram of liquid composition per gram of dry fibrous substrate. Preferably, the dry substrate is wetted with at least about 1.5 and more preferably at least about 2.0 grams of liquid composition per gram of the dry fibrous substrate. The exact amount of solution impregnated on the wipe will depend on the product's intended use. For pre-moistened wipes intended to be used for cleaning counter tops, stove tops, glass, and the like, optimum wetness is from about 1 to about 5 grams of solution per gram of substrate. In the context of a floor cleaning wipe, the pre-moistened wipe can preferably include an absorbent core reservoir with a large capacity to absorb and retain fluid. Preferably, the absorbent reservoir has a fluid capacity of from about 5 grams to about 15 grams per gram of absorptive material. Pre-moistened wipes intended to be used for the cleaning of walls, exterior surfaces, etc. will have a capacity of from about 2 grams to about 10 grams of dry fibrous substrate.

D1. Glass Wipes:

Pre-moistened wipes for use on glass can comprise either mono-layer or multi-laminate substrates. In the context of mono-layer substrates, since the surface is not wiped to dryness in the context of a pre-moistened wipe, it is essential that the content of non-volatile materials in the aqueous composition be kept to a minimum. Thus, the actives described above are preferably used at even lower levels for best end result. Also, it has been found that compositions consisting solely of organic hydrophobic cleaning solvents can deliver an excellent end result along with good cleaning in a pre-moistened wipe. These solvents, as opposed to the aqueous hydrophilic solvents such as ethanol, isopropanol and the like, have been found to provide better and more even surface wetting. This is important as it leads to a more uniform drying, which provides reassurance to consumers that streaks are not going to form. Additionally, while not wishing to be limited by theory, it is believed that in a soiled environment, the hydrophobic organic cleaning solvents will dry with less streaking. For example, in the context of glass wipes current mono-layer glass wipes, e.g., Glassmates™ manufactured by Reckitt & Colman, which use hydrophilic solvents only (i.e., they lack hydrophobic organic cleaning solvent) dry in spots. In the context of a pre-moistened wipe, the cleaning solvents are employed in a level of from about 0.5% to about 10%, more preferably from about 1% to about 5%. Preferred hydrophobic organic cleaning solvents include mono-propylene glycol propyl ether, mono-propylene glycol butyl ether, mono-ethylene glycol butyl ether, and mixtures thereof. Other aqueous hydrophilic solvents such as ethanol, isopropanol, isobutanol, 2-butanol, methoxypropanol, and the like, can be used to provide perfume lift. Buffers with molecular weights of less than about 150 g/mole as described above, can be used advantageously to improve cleaning without harming end result performance. Examples of preferred buffers include ammonia, methanol amine, ethanol amine, 2-amino-2-methyl-1-propanol, 2-dimethylamino-2-methyl-1-propanol, acetic acid, glycolic acid, and the like. Most preferred among these are ammonia, 2-dimethylamino-2-methyl-1-propanol and acetic acid. When used, these buffers are present from about 0.005% to about 0.5%, by weight of the composition, with the higher levels being more preferred for the more volatile chemicals. In the context of glass wipes, simple compositions using low levels of non-volatile surfactant with preferably high levels of the preferred organic cleaning solvent are sufficient to provide excellent cleaning and wetting performance even in the absence of the hydrophilic polymer. However, the addition of polymer can advantageously be used to provide other benefits such as anti-spotting, antifogging and easier next-time cleaning.

The art recognizes the use of pre-moistened wipes. For example, U.S. Pat. No. 4,276,338 discloses a multi-laminate absorbent article comprising adjacent first and second layers maintained together to improve wicking. U.S. Pat. No. 4,178,407 discloses a single towel having absorbent surface on both sides that additionally comprises an inner layer impermeable to liquid. The towel is designed to have little wet strength and the layer of absorbent material consists of loose fibers. The art also discloses pre-moistened wipes for use in glass cleaner applications. U.S. Pat. No. 4,448,704 discloses an article suitable for cleaning hard surfaces such as glass. The article may be wet or comprise compositions contained within rupturable pouches. The article of U.S. Pat. No. 4,448,704 is pre-washed with demineralized water or the solution used to impregnate said article; the liquid composition has a surface tension of less than 35 dynes/cm, and preferably includes a surface-active agent and a partially esterified resin such as a partially esterified styrene/maleic anhydride copolymer. All of said patents are incorporated herein by reference.

The pre-moistened wipes of the present invention advantageously are not pre-washed, yet the inventors have found that they deliver excellent end result even as single layered sheets. An additional benefit of the premoistened glass wipes is to keep linting at a minimum. Steps such as pre-washing typically loosens up fibers, making the substrate more prone to linting. In the context of hydroentangled structures specifically, the tightness of the fiber integration is optimally achieved in processing of the fibrous materials, not during the making or preparation of the pre-moistened wipe. As a result, preferred compositions of the present invention display improved linting. Additionally, the liquid composition used on the pre-moistened wipes for glass is preferably substantially free of surface active agents. As such, the surface tension of the liquid does not need to reduce surface tension below 35 dynes/cm. In the context of a multi-layered ssubstrate for the premoistened wipe of the present invention, the wipe can have two sides that differ in function. One side is pre-moistened and acts to deliver the liquid while the other is preferably not wet and is designed for buffing or finishing.

In the context of glass and other cleaning situations where lower levels of liquid are required to reduce amount of liquids left on surfaces and grease cleaning efficacy is required, a preferred embodiment includes a dry fibrous substrate substrate where at least about 65% of the dry fibrous substrate is composed of hydrophobic fibers such as polyester, polypropylene, polyethylene fibers, and the like, and lower levels of hydrophilic fibers such as wood pulp, cotton fibers, and the like, are at levels of less than about 35%. The lower level of hydrophilic fibers helps reduce how much liquid the wipe can retain while the higher level of hydrophobic fibers helps to better absorb grease. Aside from benefits associated with improved grease cleaning, it has been found that hydrophobic fibers also improve the feel of the wipe on glass and other hard surfaces, providing an easier cleaning feel to both the consumer and to the surface being treated. This improved ease-of-cleaning, lubricity, or "glide" can be experimentally quantified by friction measurements on relevant hard surfaces. Improved glide from the substrate provides additional freedom in the formulation of the liquid composition.

Hydrophobic fibers in the substrate of the premoistened wipe provide glide benefits whether the wipe is completely pre-moistened and when the wipe is completely dry. This is significant since wipes become increasingly dry as they are used. Thus, the level of $C_{14}$ or higher chainlength surfactants, which are known to provide lubricity benefits, can be substantially reduced or preferably altogether eliminated from the liquid composition used in the pre-moistened wipe herein while still preserving excellent glide (low friction) characteristics. The use of wipes comprising some level of hydrophobic fibers, particularly polyester, also provides increased flexibility in developing pre-moistened wipes for glass at acidic pH. It has been found that acidic cleaning compositions significantly hinder the glide of cellulosic substrates such as common paper towels or cellulosic pre-moistened wipes.

In addition to the substrate composition, the wipe dimensions can also be used to control dosing as well as provide ergonomic appeal. Preferred wipe dimensions are from about 5 ½ inches to about 9 inches in length, and from about 5 ½ inches to about 9 inches in width to comfortably fit in a hand. As such, the wipe preferably has dimensions such that the length and width differ by no more than about 2 inches. In the context of heavier soil cleaning, wipes are preferably bigger so that they can used and then folded, either once or twice, so as to contain dirt within the inside of the fold and then the wipe can be re-used. For this application, the wipe has a length from about 5 ½ inches to about 13 inches and a width from about 10 inches to about 13 inches. As such, the wipe can be folded once or twice and still fit comfortably in the hand.

In addition to having wipes prepared using a mono-layer substrate, it is advantageous in some situations to have the pre-moistened wipe constructed using a multi-layer substrate. In a preferred embodiment, the wipe consists of a multi-laminate substrate comprising a pre-moistened outer layer, an impermeable film or membrane inner layer and second outer-layer which is substantially dry. To improve the wet capacity of the wipe and to protect the back layer from getting prematurely wet, an optional absorbent reservoir layer can be placed between the pre-moistened first outer-layer and the impermeable film or membrane inner layer. Preferably, the dimensions of the reservoir layer are smaller than the dimensions of the two outer layers to prevent liquid wicking from the front layer onto the back layer.

The use of a multi-laminate substrate as herein described can be highly desirable in that it allows for a dry buffing step, aimed at substantially removing most of the liquid remaining on the glass following application of the wet side of the pre-moistened wipe on the glass. The inventors have found that even with a buffing step, hydrophilic polymer in the pre-moistened wipe, if present, remains on the glass providing anti-fog properties to the glass. The buffing step also provides improved overall flexibility in the level of solids used in the liquid composition because most of the solids are wiped up together with the remainder of the aqueous composition during the buffing step. In fact, those skilled in the art can recognize that it can be advantageous to use very low levels, preferably less than about 0.02%, water-soluble, though crystalline, surfactants because of improved propensity for dry the substrate to remove such crystalline solids from the glass surface.

The multi-laminate substrate is further advantageously used in the context of heavier soiled situations, such as those encountered on outside windows or car glass. By allowing use of a fresh, clean surface for buffing, the multi-laminate substrate reduces the amount of dirty liquid pushed around by the pre-moistened wipe.

When a multi-laminate substrate is used, it is preferred that the outer pre-moistened layer contain at least about 30% hydrophobic fibers for oil removal and glide. The impermeable inner layer is most preferably polyethylene, polypropylene, or mixtures thereof. The composition mixture and thickness of the impermeable layer is chosen so as to minimize, or more preferably eliminate any seepage of liquid from the pre-moistened first outer-layer to the dry second outer-layer. Use of a reservoir core layer or of a high fluid capacity pre-moistened outer-layer will test the impermeable layer, such that more than one impermeable layer can be required to ensure sufficient dryness for the second outer-layer of the wipe. The reservoir layer, if present, will preferably consist of treated or untreated cellulose, either as a stand-alone material or as a hybrid with hydrophobic fibers. The hydrophobic content of the reservoir layer is preferably less than about 30%, more preferably less than about 20% by weight of the total fiber content of the layer. In a preferred embodiment, the reservoir consists of air-laid cellulose. The second outer-layer, which is substantially dry to the touch, preferably consists of high absorbency cellulose, or blends of cellulose and synthetic fibers.

The inventors have recognized that packing of the wipes that contain a pre-moistened side and a dry side can be challenging. To resolve this packing issue, a preferred folding scheme has been developed. The wipes are folded in either halves, thirds or in another suitable way such that all of the pre-moistened layers of each of the premoistened wipes are folded inward and into each other. As a result, all of the outer dry layers of successive wipes piled into a pouch, container or box, do directly contact any pre-moistened wipe sides. By "directly contact", it is meant that all of the pre-moistened sides of the wipes are separated from dry sides by a liquid impermeable layer. By packing the wipes in such a preferred manner, it is ensured that the dry sides of the wipes do not become contaminated with liquid during storage in the wipes container and prior to use. The packing material can be made of any suitable material, including plastic or cellophane. Optionally, another means to further address potential liquid wicking into the buffing layer, is by simply adding superabsorbent polymer into the buffing layer or between the impermeable layer and the buffing layer.

In a preferred embodiment, a starter kit comprises a sturdy box or other receptacle capable of holding from about eight to about twenty-four wipes which have been folded at least once, and lower cost packages capable of holding from about five to about twelve wipes are used as refill packages.

Importantly, the pre-moistened wipe can be used as a stand-alone or in conjunction with an implement comprising a handle and attachment device for the wipe. As used herein, implement signifies any physical means for attachment of substrate, such as pad, dry wipe pre-moistened wipe, and the like. Optionally, but preferably, the pre-moistened wipe includes one or more preservatives so as to ensure fungistatic benefits. Examples of preservatives to be used in association with the pre-moistened wipes of the invention include methyl paraben, bronopol, hexetidine, dichloro-s-triazinetrione, trichloro-s-triazinetrione, and quaternary ammonium salts including dioctyl dimethyl ammonium chloride, didecyl dimethyl ammonium chloride, $C_{12}$, $C_{14}$ and $C_{16}$ dimethyl benzyl (Bardac® 2280 and Barquat® MB-80 sold by Lonza), and the like at concentrations below about 0.02%. Preferred preservatives include citric acid, tetrakis (hydroxymethyl phosphonium sulfate) ("THPS"), sodium pyrithione, Kathon®, and 1,2-benzisothiazolin-3-one sold by Avicia Chemicals. The preservatives, if used, are in concentrations of from about 0.001% to about 0.05%, more preferably from about 0.005% to about 0.02%, by weight of the composition. Alternatively, preservation can be achieved using product pH, by making the pH of the aqueous composition squeezed out of the pre-moistened wipe either greater than about 10.5 or less than about 3.0. Preferred pH-based preservatives include those which are highly volatile such as ammonia (for high pH) and acetic acid (for low pH). When pH-based preservatives are used, particularly when volatile preservatives are used, the concentration of the preservative can be substantially higher than 0.02%. The use of wipes comprising hydrophobic fibers provides sufficient glide on the surface so as to even allow the use of acidic preservation agents. Additionally, a combination of preservatives can be used to achieve the desired preservation benefits. In any event, the preservative(s) can either be applied directly onto the wipe prior to the solution, or alternatively dispersed into the solution prior to moistening the wipe.

Alternatively, it can be beneficial to incorporate antimicrobial actives directly into the substrate. In this context, it is preferred to use highly water-insoluble antimicrobial actives such as those derived from heavy metals. Examples of insoluble antimicrobials include zinc pyrithione, bismuth pyrithione, copper naphthenate, copper hydroxy quinoline, and the like. Other examples of actives, which do not use heavy metals, include dichloro-s-triazinetrione and trichloro-s-triazinetrione.

D2. Premoistened Wipes for Floors, Counters, and/or Walls

The aqueous cleaning compositions described in Sections B. and C. above can be used in a pre-moistened wipe for general purpose, counter, wall and floor cleaning. The material descriptions and processes described above in Sections D. and D1. are also applicable to floor, counter and wall cleaning methods. It is particularly advantageous in the context of floor wipes to have structures with three-dimensionality. The three-dimensional structure of the substrates described above have been found to provide improved hair pick-up relative to planar sheets, which in a wet surface environment is surprising. In a preferred embodiment, the user advantageously uses slight weaving motions in an up-and-down wiping pattern to maximize hair pick-up.

Optimum wetness of the premoistened wipe is from about 1 to about 5 grams of solution per gram of wipe. In the context of a floor cleaning premoistened wipe, the substrate can optionally include an absorbent core reservoir layer with a large capacity to absorb and retain fluid. Preferably, the absorbent reservoir layer has a fluid capacity of from about 5 to about 15 grams per gram of absorptive material. Pre-moistened wipes intended to be used for the cleaning of walls, exterior surfaces, etc. will have an absorbent capacity of from about 2 to about 10 grams of liquid per gram of dry fibrous substrate.

Since there is no rinsing step in the context of a general purpose pre-moistened wipe, it is essential that the non-volatile content be kept to a minimum to avoid film/streak residue from product. Thus, the active materials described in Section C. "General Purpose and Conventional Floor Cleaners" above are preferably used at even lower levels for best end result. Also, it has been found that compositions consisting of primarily organic hydrophobic cleaning solvents can deliver an excellent end result along with good cleaning in the context of a general purpose pre-moistened wipe for reasons similar to those described in pre-moistened glass wipes. Buffers with molecular weights of less than about 150 g/mole can be used advantageously to improve cleaning without harming end result performance. Examples of preferred buffers include ammonia, methanol amine, ethanol amine, 2-amino-2-methyl-1-propanol, 2-dimethylamino-2-methyl-1-propanol, acetic acid, glycolic acid, and the like. Most preferred among these are ammonia, 2-dimethylamino-2-methyl-1-propanol, and acetic acid. When used, these buffers are present in from about 0.005% to about 0.5%, with the higher levels being more preferred for the more volatile chemicals. As in the case of glass wipes (see Section D1.), it has been found that simple compositions using low levels of non-volatile surfactant with preferably high levels of the preferred organic cleaning solvent are sufficient to provide excellent cleaning and wetting performance even in the absence of the hydrophilic polymer. However, the addition of polymer can advantageously be used to provide other benefits such as anti-spotting, antifogging, and easier next-time cleaning.

To provide added convenience general purpose pre-moistened wipes can be attached to a mop head with a handle. In such an execution the pre-moistened wipe is ideal for light cleaning and disinfecting. Since the amount of solution released from the wipe is much more limited than that delivered through conventional cleaning, very effective anti-microbial systems need to be used. In one such composition the general purpose and floor pre-moistened wipe can contain a solution comprising an effective level of detergent surfactant and citric acid at about 0.5 to about 5%. To boost the efficacy of such solution hydrogen peroxide or a source of hydrogen peroxide can be added at about 0.5% to about 3%. An alternative composition could use quaternary ammonium salts such as dioctyl dimethyl ammonium chloride, didecyl dimethyl ammonium chloride, $C_{12}$, $C_{14}$ and $C_{16}$ dimethyl benzyl ammonium chlorides, at levels greater than about 0.05%. Such compounds have been found to often interfere with the benefits of the preferred polymers. While these solutions (e.g., those comprising sources of hydrogen peroxide, quaternary ammonium compounds and citric acid) deliver a high degree of anti-microbial efficacy they can leave a filmy surface because they are solids and need to be used at high levels.

Better end result performance is delivered by compositions containing primarily the organic cleaning solvents described above at from about 0.25% to about 10%, more preferably 0.5% to about 5% to provide cleaning and wetting, in combination with non-volatile buffers described above. Low levels of non-volatiles including hydrophilic polymer can advantageously be incorporated such that the total level of non-volatiles excluding perfume and antimicrobials, is from about 0% to about 0.08%, more preferably from 0% to about 0.055%, most preferably from about 0% to about 0.025%. In a preferred embodiment, the combination of surfactants, wetting polymers, buffers and hydrophobic organic cleaning solvents are chosen so as a provide a surface tension reduction from water (72 dynes/cm) of more than about 25 dynes/cm, more preferably more than 30 dynes/cm, most preferably more than 35 dyneslcm. Optionally, low levels of more effective anti-microbial ingredients such as bronopol, hexitidine sold by Angus chemical (211 Sanders Road, Northbrook, Ill., USA), Kathon®, 2-((hydroxymethyl) (amino)ethanol, propylene glycol, sodium hydroxymethyl amino acetate, formaldehyde, and glutaraldehyde, quaternary ammonium salts such as dioctyl dimethyl ammonium chloride, didecyl dimethyl ammonium chloride, C12,C14 and C16 dimethyl benzyl (Bardac® 2280 and Barquat® MB-80 sold by Lonza), dichloro-s-triazinetrione, trichloro-s-triazinetrione, and more preferably 1,2-benzisothiazolin-3-one sold by Avicia Chemicals, chlorhexidine diacetate sold by Aldrich-Sigma, sodium pyrithione and polyhexamethylene biguanide at about 0.001% to about 0.1%, more preferably from about 0.005% to about 0.05% are added for preserving and/or providing antimicrobial benefits.

An important benefit of the wet wipes of the present invention is the fact that judicious selection of the antimicrobial actives combined with the lack of a rinsing step as preferred in the present invention, and lack of a buffing step (consumers are in the habit of cleaning floors and countertops to a wet end result), allow for residual disinfectancy benefits. By residual disinfectancy, it is meant that the residual antimicrobial actives delivered by the wet wipe onto the hard surface at least about 99.9% cidal against bacteria and other microorganisms for a period of from about 8 to about 72 hours, more preferably from about 12 to about 48 hours, most preferably at least about 24 hours. While residual disinfectancy can be achieved using conventional approaches (i.e., spray product with a paper towel, sponge, rag, etc.), the premoistened wipe has the added convenience of delivering the cleaning and disinfectancy benefits in one package. The residual properties result from a combination of low vapor pressure and high cidal efficacy of the antimicrobial actives associated with the compositions of the present invention. Those skilled in the art will recognize that residual disinfectancy benefits, if present in the context of compositions comprising a very low level of surfactant, are even more easily achieved in compositions wherein the level of surfactants is raised. Residual disinfectancy, in addition to excellent end result, can provide consumers with reassurance as to the effectiveness of the wet wipe. Such reassurance is most important for tasks such as cleaning of surfaces that are particularly susceptible to harboring germs, most particularly counter tops, stove tops, appliances, sinks, furniture, showers, glass and other fixtures that are near or inside the kitchen or bathroom(s).

Preferred antimicrobial actives for residual benefits as delivered from a wet wipe or a dry wipe that becomes wet as a result of contact with a wet composition during the cleaning process, include Kathon®, 2-((hydroxymethyl) (amino)ethanol, propylene glycol, sodium hydroxymethyl amino acetate, formaldehyde, and glutaraldehyde, quaternary ammonium salts such as dioctyl dimethyl ammonium chloride, octyl decyl dimethyl ammonium chloride, didecyl dimethyl ammonium chloride, $C_{12}$,$C_{14}$ and $C_{16}$ dimethyl benzyl (Bardac® 2280 and Barquat® MB-80 sold by Lonza), dichloro-s-triazinetrione, trichloro-s-triazinetrione, and more preferably tetrakis(hydroxymethyl) phosphonium sulphate (THPS), 1,2-benzisothiazolin-3-one sold by Avicia Chemicals, chlorhexidine diacetate sold by Aldrich-Sigma, sodium pyrithione and polyhexamethylene biguanide at about 0.001% to about 0.1%, more preferably from about 0.005% to about 0.05%. The specific antimirobial actives and combinations thereof are chosen so as to be effective against specific bacteria, as desired by the formulator. Preferably, the antimicrobial actives are chosen to be effective against gram-positive and gram-negative bacteria, enveloped and non-enveloped viruses, and molds that are commonly present in consumer homes, hotels, restaurants, commercial establishments and hospitals. Most preferably, the antimicrobials provide residual disinfectancy against *Salmonella choleraesuis, Pseudomonas aeruginosa, Staphylococcus aureus* and *Escherichia coli*, and combinations thereof. Wherever possible, the antimicrobial actives are chosen to have residual disinfectancy benefits against more than one bacterial organism, and more preferably against at least one gram-negative organism and at least one gram-positive organism.

The inventors have found that residual disinfectancy can also be achieved or enhanced using pH. Additionally, use of low levels of surfactants to reduce surface tension by more than about 25 dynes/cm, preferably more than about 30 dynes/cm, can advantageously be used in combination with pH effects in the context of a pre-moistened wipe. Thus, compositions at a pH 10.5 or greater or a pH of 3 or lower are found to deliver the desired residual efficacy. The preferred hydrophilic, substantive polymer can be used to improve residuality, particularly for voltaile actives such as acetic acid. The use of pH can also help lower the level of the above actives needed to achieve residual. Preferred actives that are effective as a result of pH include lactic acid, glycolic acid, $C_8$,$C_9$, $C_{10}$ fatty acids, sodium hydroxide, potassium hydroxide.

This approach, i.e., using a combination of hydrophobic organic solvent plus volatile buffer plus optionally low levels of non-volatile raw materials to deliver a superior end result, in combination with effective and low streaking antimicrobials, can be used in a variety of practical applications herein disclosed, including general purpose cleaners, glass cleaners, glass cleaner wipes, solutions used with disposable pads (either with or without mop implements).

Use of low levels of non-volatiles in the compositions of the invention presents a challenge for perfume incorporation. Some methods to improve solubility of perfume are disclosed below. However, in certain instances, particularly when hydrophobic perfumes are desired, perfume incorporation can be problematic. To circumvent this issue, the inventors have advantageously found that perfume delivery can be achieved by directly applying concentrated perfume to either the wipe (or pad). In this manner, virtually any perfume can be used. In order to minimize any residue negatives that can be caused by the concentrated perfume, the perfume is preferentially applied to the perimeter of the wipe or pad, or to areas that do not directly contact the surface to be treated. In another embodiment, perfume can also be added into the package containing the wipes. In similar fashion, use of low levels of non-volatile actives makes incorporation of effective suds suppressors into the aqueous composition more difficult. It has been found that suds suppressors can more easily, and more effectively be applied directly to the wipe to prevent suds control. It is found that this not only addresses a consumer perception of too much sudsing, but surprisingly also has shown an improved end result upon surface drying. Furthermore, it has been found that applying suds suppressor directly onto the wipes makes process a lot easier through better control of suds during manufacturing and packaging. Preferred suds suppressors are those that are effective at levels of no more than about 0.1 grams of suds suppressor per gram of substrate, more preferably at levels less than about 0.01 grams suds suppressor per gram of substrate, most preferably, less than about 0.005 grams suds suppressor per gram of substrate. The most preferred suds suppressor in this context is DC AF, manufactured by the Dow Corning company. The use of suds suppressors to improve surface appearance is particularly significant since these materials are effective at very low levels.

E. Floor Cleaning Compositions for Use with Disposable Cleaning Pads

The compositions described in the previous sections on glass wipes and floor wipes also pertain to a cleaning system where solution is applied to the surface and then cleaned with a disposable cleaning pad particularly since it again involves a no-rinse cleaning application. The proper selection of ingredients and levels used can have a significant impact on performance.

Compositions for use with a disposable cleaning pad where no rinsing is involved comprise:

a. optionally, but preferably, an effective amount to reduce the contact angle and/or increase surface hydrophilicity, up to about 0.5%, preferably from about 0.001% to about 0.4%, more preferably from about 0.005% to about 0.3%, of preferably relatively substantive hydrophilic polymer that renders the treated surface hydrophilic, e.g., polymer selected from the group consisting of: polystyrene sulfonate; polyvinyl pyrrolidone; polyvinyl pyrrolidone acrylic acid copolymer; polyvinyl pyrrolidone acrylic acid copolymer sodium salt; polyvinyl pyrrolidone acrylic acid copolymer potassium salt; polyvinyl pyrrolidone- vinyl imidazoline; polyvinyl pyridine; polyvinyl pyridine n-oxide; and mixtures thereof, preferably polyvinyl pyridine n-oxide;

b. optionally, but preferably, an effective amount of detergent surfactant, preferably from about 0.001% to about 0.5%, more preferably from about 0.005% to about 0.3%, most preferably from about 0.02% to about 0.3%, by weight of the composition, said detergent surfactant preferably comprising alkyl polsaccharide detergent surfactant having an alkyl group containing from about 8 to about 18 carbon atoms, more preferably from about 8 to about 16 carbon atoms, and from about one to about four, preferably from about one to about 1.5 saccharide moieties per molecule and/or a combination consisting of alkyl polysaccharide detergent surfactant having an alkyl group containing from about 8 to about 18 carbon atoms, more preferably from about 8 to about 16 carbon atoms, and from about one to about four, preferably from about one to about 1.5 saccharide moieties per molecule and preferably having a broad distribution of alkyl chains, said alkyl polysaccharide detergent surfactant being present when said hydrophilic polymer is not present, and, optionally, as a cosurfactant, from about 0.01% to about 0.5%, preferably from about 0.01% to about 0.4%, more preferably from about 0.025% to about 0.3%, of anionic and/or nonionic detergent surfactant, e.g., preferably selected from the group consisting of: $C_8$–$C_{12}$ linear sulfonates, $C_8$–$C_{18}$ alkylbenzene sulfonates; $C_8$–$C_{18}$ alkyl sulfates; $C_8$–$C_{18}$ alkylpolyethoxy sulfates; and mixtures thereof;

c. optionally, an effective amount to provide increased cleaning, e.g., from about 0.5% to about 7%, preferably from about 0.5% to about 5%, more preferably from about 0.5% to about 4%, of one, or more, organic cleaning solvents, preferably selected from the group consisting of: mono-propylene glycol mono-propyl ether, mono-propylene glycol mono-butyl ether, di-propylene glycol mono-propyl ether di-propylene glycol mono-butyl ether, di-propylene glycol mono-butyl ether; tri-propylene glycol mono-butyl ether; ethylene glycol mono-butyl ether; diethylene glycol mono-butyl ether, ethylene glycol mono-hexyl ether and diethylene glycol mono-hexyl ether, and mixtures thereof, most preferably propoxypropanol;

d. optionally, an effective amount to improve cleaning and/or antimicrobial action, e.g., from about 0.01% to about 1%, preferably from about 0.01% to about 0.5%, more preferably from about 0.01% to about 0.25%, of water soluble mono- or polycarboxylic acid;

e. optionally, an effective amount, up to 1%, preferably from about 0.01% to about 0.5%, more preferably from about 0.025% to about 0.25%, of either an unsubstituted or substituted cyclodextrin, either alpha, beta, or gamma cyclodextrin substituted, optionally, with short chain (1–4 carbon atoms) alkyl or hydroxyalkyl groups, preferably beta-cyclodextrin, hydroxypropyl cyclodextrin or mixtures thereof;

f. optionally, an effective amount to provide bleaching, cleaning, and/or antibacterial action, up to about 5%, preferably from about 0.1% to about 4%, more preferably from about 1% to about 3%, of hydrogen peroxide;

g. optionally, from about 0.005% to about 1%, preferably from about 0.005% to about 0.5%, more preferably from about 0.01% to about 0.1%, of a thickening polymer selected from the group consisting of polyacrylates, gums and mixtures thereof;

h. optionally, an effective amount of perfume to provide odor effects and/or additional adjuvants;

i. optionally, an effective amount, from about 0.0001% to about 0.1%, more preferably from about 0.00025 to about 0.05%, most preferably from about 0.001% to about to about 0.01% of suds suppressor, preferably silicone suds suppressor;

j. optionally, detergent builder; and optionally, but preferably, the balance being an aqueous solvent system, comprising water, and optional water soluble solvent, and wherein said composition has a pH under usage conditions of from about 2 to about 12, preferably from about 3 to about 11.5, the level of hydrophobic materials, including hydrophobic cleaning solvents being limited. These detergent compositions are used in combination with a disposable, preferably superabsorbent, cleaning pad, preferably attached to an implement which facilitates its use. Preferred detergent compositions which can be used with the preferred pads containing superabsorbent material and optional implement, described hereinafter, require sufficient detergent to enable the solution to provide cleaning without overloading the superabsorbent material with solution, but, typically, if there is more than about 0.5% detergent surfactant the performance suffers. Therefore, the level of detergent surfactant is preferably from about 0.001%to about 0.5%, more preferably from about 0.005% to about 0.4%, and even more preferably from about 0.02% to about 0.3%, by weight of the composition. The level of hydrophobic materials, including cleaning solvent, is preferably less than about 7%, more preferably less than about 6%, and even more preferably less than about 5% and the pH is typically provided, at least in part, by volatile materials, to minimize streaking/filming problems. In some cases an alkaline pH is preferred where soils are higher in grease composition while in other cases a lower pH is preferred where soils could have calcium or calcium soap deposits.

Preferred buffers include ammonia, methanol amine, ethanol amine, 2-amino-2-methyl-1-propanol, 2-dimethylamino-2-methyl-1-propanol, acetic acid, glycolic acid and the like. Most preferred among these are ammonia, 2-dimethylamino-2-methyl-1 -propanol and acetic acid.

Suitable hydrophobic cleaning solvents include short chain (e.g., $C_1$–$C_6$) derivatives of oxyethylene glycol and oxypropylene glycol, such as mono- and di-ethylene glycol n-hexyl ether, mono-, di- and tri-propylene glycol n-butyl ether, and the like, most preferably propoxypropanol. The level of hydrophobic cleaning solvent, e.g., solvent having a solubility in water of less than about 10%, is in the cleaning composition at less than about 6%, more preferably less than about 5% by weight of the composition.

Suitable detergent builders include those derived from phosphorous sources, such as orthophosphates, pyrophosphates, tripolyphosphates, etc., and those derived from non-phosphorous sources, such as nitrilotriacetates; S,S-ethylene diamine disuccinates; and the like. Suitable chelants include ethylenediaminetetraacetates; citrates; and the like. Suitable suds suppressors include silicone polymers and linear or branched $C_{10}$–$C_{18}$ fatty acids or alcohols. Suitable detergent enzymes include lipases, proteases, amylases and other enzymes known to be useful for catalysis of soil degradation. The total level of such ingredients is low, preferably less than about 0.1%, more preferably less than about 0.05%, to avoid causing filming/streaking problems. Preferably, the compositions should be essentially free of materials that cause filming/streaking problems. Accordingly, it is desirable to use alkaline materials that do not cause filming and/or streaking for the majority of the buffering. Suitable alkaline buffers are carbonates, bicarbonates, citrates, etc. The preferred alkaline buffers are alkanol amines having the formula:

$$CR_2(NR_2)CR_2OH$$

wherein each R is selected from the group consisting of hydrogen and alkyl groups containing from one to four carbon atoms and the total of carbon atoms in the compound is from three to six, preferably, 2-dimethylamino-2-methyl-1 -propanol.

Soil suspending agents, preferably water soluble polymers, for use in the detergent composition and/or cleaning solution of this invention in addition to the said hydrophilic polymers, can optionally be selected from a group consisting of, ethoxylated and/or propoxylated polyalkylamines, carboxylate polymers, nitrogen-based zwitterionic polymers, polyethyleneoxides, polyphosphates, and cellulosic polymers. Preferred soil suspending agents are ethoxylated polyalkylamines. Such agents are disclosed in U.S. Pat. No. : 4,891,160, issued Jan. 2, 1990, entitled Detergent compositions containing ethoxylated amines having, clay soil removal/anti-redeposition properties, by Vander Meer, James M. Specific methods for preparing ethoxylated amines are disclosed in U.S. Pat. No. 2,182,306 to Ulrich et al., issued Dec. 5, 1939; U.S. Pat. No. 3,033,746 to Mayle et al., issued May 8, 1962; U.S. Pat. No. 2,208,095 to Esselmann et al., issued Jul. 16, 1940; U.S. Pat. No. 2,806,839 to Crowther, issued Sept. 17, 1957; and U.S. Pat. No. 2,553,696 to Wilson, issued May 21, 1951 (all incorporated herein by reference).

Still other suitable compounds are disclosed in U.S. Pat. No. : 5,565,145, issued Oct. 15, 1996, entitled Compositions comprising ethoxylated/propoxylated, polyalkyleneamine polymers as soil dispersing agents, by Watson, Randall A.; Gosselink, Eugene P.; and Zhang, Shulin, incorporated herein by reference.

An improvement in soil suspension can be achieved at all mixing ratios of the vinyl pyrrolidone polymer and the nonionic cellulose ether. Preferably, the ratio of the vinyl pyrrolidone polymer to the nonionic cellulose ether in the detergent composition is within the range from about 8:2 to about 2:8, most preferably from about 6:4 to about 4:6, by weight. Mixtures of this type are disclosed in U.S. Pat. No. : 4,999,129, entitled Process and composition for washing soiled polyester fabrics, by Michael Hull.

In one preferred embodiment, similar to learnings on glass and floor wipes, using high levels of an organic cleaning solvent while minimizing the level of non-volatile ingredients can be advantageous, resulting in good cleaning without leaving haze or streaks particularly on tough to clean surfaces like ceramic. These compositions contain primarily the organic cleaning solvents from about 0.5% to about 10%, more preferably 1% to about 5% to provide cleaning and wetting, in combination with non-volatile buffers described above. Low levels of non-volatiles including hydrophilic polymer can advantageously be incorporated such that the total level of non-volatiles excluding perfume and antimicrobials, is from about 0% to about 0.2%, more preferably from 0% to about 0.1%, more preferably from about 0% to about 0.055% and most preferably from about 0% to about 0.025%. Also as in the case of glass wipes and floor, counter and wall wipes, the inventors have found that simple compositions using low levels of non-volatile surfactant with preferably high levels of the preferred organic cleaning solvent are sufficient to provide excellent cleaning and wetting performance even in the absence of the hydrophilic polymer. However, the addition of polymer can advantageously be used to provide other benefits such as anti-spotting, antifogging and easier next-time-cleaning. In a preferred embodiment, the combination of surfactants, wetting polymers, buffers and hydrophobic organic cleaning solvents are chosen so as a provide a surface tension reduction from water (72 dynes/cm) of more than about 25 dynes/cm, more preferably more than 30 dynes/cm, most preferably more than 35 dynes/cm.

Optionally, low levels anti-microbial ingredients such as bronopol, hexitidine sold by Angus chemical (211 Sanders Road, Northbrook, Ill., USA), dichloro-s-triazinetrione, trichloro-s-triazinetrione, quaternary ammonium salts including dioctyl dimethyl ammonium chloride, octyl decyl ammmonium chloride, didecyl dimethyl ammonium chloride, C12,C14 and C16 dimethyl benzyl (Bardac® 2280 and Barquat® MB-80 sold by Lonza), Kathon®, 2-((hydroxymethyl) (amino)ethanol, propylene glycol, sodium hydroxymethyl amino acetate, formaldehyde, and glutaraldehyde, and more preferably tetrakis (hydroxymethyl phosphonium sulfate (THPS), 1,2-benzisothiazolin-3-one, chlorhexidine diacetate, sodium pyrithione and polyhexamethylene biguanide at about 0.001% to about 0.1%, more preferably from about 0.005% to about 0.05% can be added for preserving and/or providing antimicrobial benefits while maintaining good end result. As in the case of the wet wipe (part D, D1 and D2.), residual disinfectancy benefits can be important for consumers cleaning counter tops, stove tops, appliances, sinks, furniture, and other fixtures that are near or inside the kitchen or bathroom (s), and to a lesser extent in the cleaning of floors, glass and walls. Such benefits can be delivered via one or more of these antimicrobial actives. A full discussion of residual disinfectancy is provided in section D, D1 and D2 ("Wet-wipe" for Floors and/or Counters and Walls).

The cleaning pads will preferably have an absorbent capacity, when measured under a confining pressure of 0.09 psi after 20 minutes (1200 seconds) (hereafter referred to as "$t_{1200}$ absorbent capacity"), of at least about 10 g deionized water per g of the cleaning pad. The absorbent capacity of the pad is measured at 20 minutes (1200 seconds) after exposure to deionized water, as this represents a typical time for the consumer to clean a hard surface such as a floor. The confining pressure represents typical pressures exerted on the pad during the cleaning process. As such, the cleaning pad should be capable of absorbing significant amounts of the cleaning solution within this 1200 second period under 0.09 psi. The cleaning pad will preferably have a $t_{1200}$ absorbent capacity of at least about 15 g/g, more preferably at least about 20 g/g, still more preferably at least about 25 g/g and most preferably at least about 30 g/g. The cleaning pad will preferably have a $t_{900}$ absorbent capacity of at least about 10 g/g, more preferably a $t_{900}$ absorbent capacity of at least about 20 g/g.

Values for $t_{1200}$ and $t_{900}$ absorbent capacity are measured by the performance under pressure (referred to herein as "PUP") method, which is described in detail in the Test Methods section in allowed application Ser. No. 08/756,507, Holt, Masters, and Ping, filed Nov. 26, 1996, said application being incorporated herein, in its entirety, by reference. The application contains a more complete disclosure of the pads, instruments, etc. that are of use herein.

The cleaning pads will also preferably, but not necessarily, have a total fluid capacity (of deionized water) of at least about 100 g, more preferably at least about 200 g, still more preferably at least about 300 g and most preferably at least about 400 g. While pads having a total fluid capacity less than 100 g are within the scope of the invention, they are not as well suited for cleaning large areas, such as seen in a typical household, as are higher capacity pads.

Pads that absorb less than about 100 g or less can be advantageous, particularly when used with in conjunction preferred liquid compositions described above for cleaning and disinfecting smaller areas like bathroom floors or for consumers who typically have smaller areas of washable floors in their home of about 100 square feet or less. Under these situations consumers will be less forced to keep partially used pads which still have absorptive capacity available. These pads can also be advantageous in that maybe better suited for spill pick-up where again keeping partially used pads is not desired. This pad can be composed of an absorbent structure with or without superabsorbent polymer.

In the pads there is preferably an absorbent layer which serves to retain any fluid and soil absorbed by the cleaning pad during use and a scrubbing layer. While the preferred scrubbing layer, described hereinafter, has some effect on the pad's ability to absorb fluid, the preferred absorbent layer plays a major role in achieving the desired overall absorbency. Furthermore, the absorbent layer preferably comprises multiple layers which are designed to provide the cleaning pad with multiple planar surfaces.

From the essential fluid absorbency perspective, the absorbent layer is preferably capable of removing fluid and soil from any "scrubbing layer" so that the scrubbing layer will have capacity to continually remove soil from the surface. The absorbent layer also is preferably capable of retaining absorbed material under typical in-use pressures to avoid "squeeze-out" of absorbed soil, cleaning solution, etc.

The absorbent layer can comprise any material that is capable of absorbing and retaining fluid during use. To achieve desired total fluid capacities, it will be preferred to include in the absorbent layer a material having a relatively high fluid capacity (in terms of grams of fluid per gram of absorbent material). As used herein, the term "superabsorbent material" means any absorbent material having a g/g capacity for water of at least about 15 g/g, when measured under a confining pressure of 0.3 psi. Because a majority of the cleaning fluids useful with the present invention are aqueous based, it is preferred that the superabsorbent materials have a relatively high g/g capacity for water or water-based fluids.

Representative superabsorbent materials include water insoluble, water-swellable superabsorbent gelling polymers (referred to herein as "superabsorbent gelling polymers") which are well known in the literature. These materials demonstrate very high absorbent capacities for water. The superabsorbent gelling polymers useful in the present invention can have a size, shape and/or morphology varying over a wide range. These polymers can be in the form of particles that do not have a large ratio of greatest dimension to smallest dimension (e.g., granules, flakes, pulverulents, interparticle aggregates, interparticle crosslinked aggregates, and the like) or they can be in the form of fibers, sheets, films, foams, laminates, and the like. The use of superabsorbent gelling polymers in fibrous form provides the benefit of providing enhanced retention of the superabsorbent material, relative to particles, during the cleaning process. While their capacity is generally lower for aqueous-based mixtures, these materials still demonstrate significant absorbent capacity for such mixtures. The patent literature is replete with disclosures of water-swellable materials. See, for example, U.S. Pat. No. 3,699,103 (Harper et al.), issued Jun. 13, 1972; U.S. Pat. No. 3,770,731 (Harmon), issued Jun. 20, 1972; U.S. Reissue Pat. No. 32,649 (Brandt et al.), reissued Apr. 19, 1989; U.S. Pat. No. 4,834,735 (Alemany et al.), issued May 30, 1989.

Superabsorbent gelling polymers useful in the present invention include a variety of water-insoluble, but water-swellable polymers capable of absorbing large quantities of fluids. Such polymeric materials are also commonly referred to as "hydrocolloids", and can include polysaccharides such as carboxymethyl starch, carboxymethyl cellulose, and hydroxypropyl cellulose; nonionic types such as polyvinyl alcohol, and polyvinyl ethers; cationic types such as polyvinyl pyridine, polyvinyl morpholine, and N,N-dimethylaminoethyl or N,N-diethylaminopropyl acrylates and methacrylates, and the respective quaternary salts thereof. Well-known materials and are described in greater detail, for example, in U.S. Pat. No. 4,076,663 (Masuda et al), issued Feb. 28, 1978, and in U.S. Pat. No. 4,062,817 (Westerman), issued Dec. 13, 1977, both of which are incorporated by reference.

Preferred superabsorbent gelling polymers contain carboxy groups. These polymers include hydrolyzed starch-acrylonitrile graft copolymers, partially neutralized hydrolyzed starch-acrylonitrile graft copolymers, starch-acrylic acid graft copolymers, partially neutralized starch-acrylic acid graft copolymers, saponified vinyl acetate-acrylic ester copolymers, hydrolyzed acrylonitrile or acrylamide copolymers, slightly network crosslinked polymers of any of the foregoing copolymers, partially neutralized polyacrylic acid, and slightly network crosslinked polymers of partially neutralized polyacrylic acid. These polymers can be used either solely or in the form of a mixture of two or more different polymers. Examples of these polymer materials are disclosed in U.S. Pat. No. 3,661,875, U.S. Pat. No. 4,076,663, U.S. Pat. No. 4,093,776, U.S. Patent 4,666,983, and U.S. Pat. No. 4,734,478, all of said patents being incorporated by reference.

Most preferred polymer materials for use in making the superabsorbent gelling polymers are slightly network crosslinked polymers of partially neutralized polyacrylic acids and starch derivatives thereof. Most preferably, the hydrogel-forming absorbent polymers comprise from about 50 to about 95%, preferably about 75%, neutralized, slightly network crosslinked, polyacrylic acid (i.e. poly (sodium acrylate/acrylic acid)). Network crosslinking renders the polymer substantially water-insoluble and, in part, determines the absorptive capacity and extractable polymer content characteristics of the superabsorbent gelling polymers. Processes for network crosslinking these polymers and typical network crosslinking agents are described in greater detail in U.S. Pat. No. 4,076,663.

While the superabsorbent gelling polymers is preferably of one type (i.e., homogeneous), mixtures of polymers can also be used in the implements of the present invention. For example, mixtures of starch-acrylic acid graft copolymers and slightly network crosslinked polymers of partially neutralized polyacrylic acid can be used in the present invention.

While any of the superabsorbent gelling polymers described in the prior art can be useful in the present invention, where significant levels (e.g., more than about 50% by weight of the absorbent structure) of superabsorbent gelling polymers are to be included in an absorbent structure, and in particular where one or more regions of the absorbent layer will comprise more than about 50%, by weight of the region, the problem of gel blocking by the swollen particles can impede fluid flow and thereby adversely affect the ability of the gelling polymers to absorb to their full capacity in the desired period of time. U.S. Pat. No. 5,147,343 (Kellenberger et al.), issued Sep. 15, 1992 and U.S. Pat. No. 5,149,335 (Kellenberger et al.), issued Sep. 22, 1992, describe superabsorbent gelling polymers in terms of their Absorbency Under Load (AUL), where gelling polymers absorb fluid (0.9% saline) under a confining pressure of 0.3 psi. (The disclosure of each of these patents is incorporated herein by reference.) The methods for determining AUL are described in these patents. Polymers described therein can be particularly useful in embodiments of the present invention that contain regions of relatively high levels of superabsorbent gelling polymers. In particular, where high concentrations of superabsorbent gelling polymer are incorporated in the cleaning pad, those polymers will preferably have an AUL, measured according to the methods described in U.S. Pat. No. 5,147,343, of at least about 24 ml/g, more preferably at least about 27 ml/g after 1 hour; or an AUL, measured according to the methods described in U.S. Pat. No. 5,149,335, of at least about 15 ml/g, more preferably at least about 18 m/lg after 15 minutes. Commonly assigned U.S. application Ser. Nos. 08/219,547 (Goldman et al.), filed Mar. 29, 1994 and 08/416,396 (Goldman et al.), filed Apr. 6, 1995 (both of which are incorporated by reference herein), also address the problem of gel blocking and describe superabsorbent gelling polymers useful in overcoming this phenomena. These applications specifically describe superabsorbent gelling polymers which avoid gel blocking at even higher confining pressures, specifically 0.7 psi. In the embodiments of the present invention where the absorbent layer will contain regions comprising high levels (e.g., more than about 50% by weight of the region) of superabsorbent gelling polymer, it can be preferred that the superabsorbent gelling polymer be as described in the aforementioned applications by Goldman et al.

Other useful superabsorbent materials include hydrophilic polymeric foams, such as those described in commonly assigned U.S. patent application Ser. No. 08/563,866 (DesMarais et al.), filed Nov. 29, 1995 and U.S. Pat. No. 5,387,207 (Dyer et al.), issued Feb. 7, 1995. These references describe polymeric, hydrophilic absorbent foams that are obtained by polymerizing a high internal phase water-in-oil emulsion (commonly referred to as HIPEs). These foams are readily tailored to provide varying physical properties (pore size, capillary suction, density, etc.) that affect fluid handling ability. As such, these materials are particularly useful, either alone or in combination with other such foams or with fibrous structures, in providing the overall capacity required by the present invention.

Where superabsorbent material is included in the absorbent layer, the absorbent layer will preferably comprise at least about 15%, by weight of the absorbent layer, more preferably at least about 20%, still more preferably at least about 25%, of the superabsorbent material.

The absorbent layer can also consist of or comprise fibrous material. Fibers useful in the present invention include those that are naturally occurring (modified or unmodified), as well as synthetically made fibers. Examples of suitable unmodified/modified naturally occurring fibers include cotton, Esparto grass, bagasse, hemp, flax, silk, wool, wood pulp, chemically modified wood pulp, jute, ethyl cellulose, and cellulose acetate. Suitable synthetic fibers can be made from polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like. The absorbent layer can comprise solely naturally occurring fibers, solely synthetic fibers, or any compatible combination of naturally occurring and synthetic fibers.

The fibers useful herein can be hydrophilic, hydrophobic or can be a combination of both hydrophilic and hydrophobic fibers. As indicated above, the particular selection of hydrophilic or hydrophobic fibers depends upon the other materials included in the absorbent (and to some degree the scrubbing) layer. That is, the nature of the fibers will be such that the cleaning pad exhibits the necessary fluid delay and overall fluid absorbency. Suitable hydrophilic fibers for use in the present invention include cellulosic fibers, modified cellulosic fibers, rayon, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like.

Suitable wood pulp fibers can be obtained from well-known chemical processes such as the Kraft and sulfite processes. It is especially preferred to derive these wood pulp fibers from southern soft woods due to their premium absorbency characteristics. These wood pulp fibers can also be obtained from mechanical processes, such as ground wood, refiner mechanical, thermomechanical, chemimechanical, and chemi-thermomechanical pulp processes. Recycled or secondary wood pulp fibers, as well as bleached and unbleached wood pulp fibers, can be used.

Another type of hydrophilic fiber for use in the present invention is chemically stiffened cellulosic fibers. As used herein, the term "chemically stiffened cellulosic fibers" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking polymer chains.

Where fibers are used as the absorbent layer (or a constituent component thereof), the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or substrate of fibers together in each of the respective layers. This can be beneficial in providing additional overall integrity to the cleaning pad.

Amongst its various effects, bonding at the fiber intersections increases the overall compressive modulus and strength of the resulting thermally bonded member. In the case of the chemically stiffened cellulosic fibers, the melting and migration of the thermoplastic material also has the effect of increasing the average pore size of the resultant substrate, while maintaining the density and basis weight of the substrate as originally formed. This can improve the fluid acquisition properties of the thermally bonded substrate upon initial exposure to fluid, due to improved fluid permeability, and upon subsequent exposure, due to the combined ability of the stiffened fibers to retain their stiffness upon wetting and the ability of the thermoplastic material to remain bonded at the fiber intersections upon wetting and upon wet compression. In net, thermally bonded substrates of stiffened fibers retain their original overall volume, but with the volumetric regions previously occupied by the thermoplastic material becoming open to thus increase the average interfiber capillary pore size.

Thermoplastic materials useful in the present invention can be in any of a variety of forms including particulates, fibers, or combinations of particulates and fibers. Thermoplastic fibers are a particularly preferred form because of their ability to form numerous interfiber bond sites. Suitable thermoplastic materials can be made from any thermoplastic polymer that can be melted at temperatures that will not extensively damage the fibers that comprise the primary substrate or matrix of each layer. Preferably, the melting point of this thermoplastic material will be less than about 190° C., and preferably between about 75° C. and about 175° C. In any event, the melting point of this thermoplastic material should be no lower than the temperature at which the thermally bonded absorbent structures, when used in the cleaning pads, are likely to be stored. The melting point of the thermoplastic material is typically no lower than about 50° C.

The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like. Depending upon the desired characteristics for the resulting thermally bonded absorbent member, suitable thermoplastic materials include hydrophobic fibers that have been made hydrophilic, such as surfactant-treated or silica-treated thermoplastic fibers derived from, for example, polyolefins such as polyethylene or polypropylene, polyacrylics, polyamides, polystyrenes, polyurethanes and the like. The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and resolidification, the surfactant will tend to remain at the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Conn. Besides nonionic surfactants, anionic surfactants can also be used. These surfactants can be applied to the thermoplastic fibers at levels of, for example, from about 0.2 to about 1 g. per sq. of centimeter of thermoplastic fiber.

Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer.

Suitable bicomponent fibers for use in the present invention can include sheath/core fibers having the following polymer combinations: polyethylene/ polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s, Chisso Corp., and CELBOND®, available from Hercules). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses.

Methods for preparing thermally bonded fibrous materials are described in U.S. application Ser. No. 08/479,096 (Richards et al.), filed Jul. 3, 1995 (see especially pages 16–20) and U.S. Pat. No. 5,549,589 (Homey et al.), issued Aug. 27, 1996 (see especially Columns 9 to 10). The disclosures of both of these references are incorporated by reference herein.

The absorbent layer can also comprise a HIPE-derived hydrophilic, polymeric foam that does not have the high absorbency of those described above as "superabsorbent materials". Such foams and methods for their preparation are described in U.S. Pat. No. 5,550,167 (DesMarais), issued Aug. 27, 1996; and commonly assigned U.S. patent application Ser. No. 08/370,695 (Stone et al.), filed Jan. 10, 1995 (both of which are incorporated by reference herein).

The absorbent layer of the cleaning pad can be comprised of a homogeneous material, such as a blend of cellulosic fibers (optionally thermally bonded) and swellable superabsorbent gelling polymer. Alternatively, the absorbent layer can be comprised of discrete layers of material, such as a layer of thermally bonded airlaid material and a discrete layer of a superabsorbent material. For example, a thermally bonded layer of cellulosic fibers can be located lower than (i.e., beneath) the superabsorbent material (i.e., between the superabsorbent material and the scrubbing layer). In order to achieve high absorptive capacity and retention of fluids under pressure, while at the same time providing initial delay in fluid uptake, it can be preferable to utilize such discrete layers when forming the absorbent layer. In this regard, the superabsorbent material can be located remote from the scrubbing layer by including a less absorbent layer as the lower-most aspect of the absorbent layer. For example, a layer of cellulosic fibers can be located lower (i.e., beneath) than the superabsorbent material (i.e., between the superabsorbent material and the scrubbing layer).

In a preferred embodiment, the absorbent layer comprises a thermally bonded airlaid substrate of cellulose fibers (Flint River, available from Weyerhaeuser, Wash.) and AL Thermal C (thermoplastic available from Danaklon a/s, Varde, Denmark), and a swellable hydrogel-forming superabsorbent polymer. The superabsorbent polymer is preferably incorporated such that a discrete layer is located near the surface of the absorbent layer which is remote from the scrubbing layer. Preferably, a thin layer of, e.g., cellulose fibers (optionally thermally bonded) are positioned above the superabsorbent gelling polymer to enhance containment.

The scrubbing layer is the portion of the cleaning pad that contacts the soiled surface during cleaning. As such, materials useful as the scrubbing layer must be sufficiently durable that the layer will retain its integrity during the cleaning process. In addition, when the cleaning pad is used in combination with a solution, the scrubbing layer must be capable of absorbing liquids and soils, and relinquishing those liquids and soils to the absorbent layer. This will ensure that the scrubbing layer will continually be able to remove additional material from the surface being cleaned. Whether the implement is used with a cleaning solution (i.e., in the wet state) or without cleaning solution (i.e., in the dry state), the scrubbing layer will, in addition to removing particulate matter, facilitate other functions, such as polishing, dusting, and buffing the surface being cleaned.

The scrubbing layer can be a mono-layer, or a multi-layer structure one or more of whose layers can be slitted to facilitate the scrubbing of the soiled surface and the uptake of particulate matter. This scrubbing layer, as it passes over the soiled surface, interacts with the soil (and cleaning solution when used), loosening and emulsifying tough soils and permitting them to pass freely into the absorbent layer of the pad. The scrubbing layer preferably contains openings (e.g., slits) that provide an easy avenue for larger particulate soil to move freely in and become entrapped within the absorbent layer of the pad. Low density structures are preferred for use as the scrubbing layer, to facilitate transport of particulate matter to the pad's absorbent layer.

In order to provide desired integrity, materials particularly suitable for the scrubbing layer include synthetics such as polyolefins (e.g., polyethylene and polypropylene), polyesters, polyamides, synthetic cellulosics (e.g., Rayon®), and blends thereof. Such synthetic materials can be manufactured using known process such as carded, spunbond, meltblown, airlaid, needle punched and the like.

Cleaning pads of the present invention optionally have an attachment layer that allows the pad to be connected to an implement's handle or the support head in preferred implements. The attachment layer will be necessary in those embodiments where the absorbent layer is not suitable for attaching the pad to the support head of the handle. The attachment layer can also function as a means to prevent fluid flow through the top surface (i.e., the handle-contacting surface) of the cleaning pad, and can further provide enhanced integrity of the pad. As with the scrubbing and absorbent layers, the attachment layer can consist of a mono-layer or a multi-layer structure, so long as it meets the above requirements.

The attachment layer can comprise a surface which is capable of being mechanically attached to the handle's support head by use of known hook and loop technology. In such an embodiment, the attachment layer will comprise at least one surface which is mechanically attachable to hooks that are permanently affixed to the bottom surface of the handle's support head.

To achieve the desired fluid imperviousness and attachability, it is preferred that a laminated structure comprising, e.g., a meltblown film and fibrous, nonwoven structure be utilized. In a preferred embodiment, the attachment layer is a tri-layered material having a layer of meltblown polypropylene film located between two layers of spun-bonded polypropylene.

Making processes:

The compositions herein can be made by mixing together all ingredients. It has been found that for maximum perfume solubilization in compositions where the actives are present at low levels, a preferred order of addition is necessary. This involves the making of a premix like the perfume compositions disclosed hereinbefore, that is then added to the "base" product. The premix comprises raw materials added in the following order: surfactant(s), if any, at about 25% activity or higher, then perfume, then polymer, then the optional suds suppressor. In certain cases, it is advantageous to add solvent(s) and/or the optional buffer, to the premix after the optional suds suppressor. Thorough mixing of the premix provides the best results. The premix is then added to the base, which contains water and the other components. The combined mixture (i.e., premix in the base) is then mixed to obtain a homogeneous solution.

Another preferred method to incorporate maximum perfume into compositions with limited surfactant, is to create a premix in which perfume is added to a cyclodextrin mixture in aqueous media. Alternatively, the perfume-cyclodextrin mixture can be pre-formed prior to the premix. This approach ensures maximum perfume incorporation into the composition, and can provide perfume to compositions with little or no surfactant.

In certain cases, perfume solubilization can not be achieved, even with the preferred processing methods. However, in applications such as, but not limited to, counter and floor cleaners, the entire heterogeneous composition can be added directly to the article of use. Examples wherein this method of use is desirable include pre-moistened wipes, dry absorbent substrates used in conjunction with solution.

In cases where the surfactant active level does not limit perfume solubility in the compositions, a single step making process can be followed. For example, an acceptable order of addition is to first incorporate water, any detergent surfactant and/or organic acid, followed by any hydrophobic cleaning solvent. Once the solvent is added, pH is adjusted to optimum as desired by the formulator. The polymer can then be added followed by any optional peroxide, perfume and/or dye.

F. "Perfume" Compositions

The compositions described in A., B., C., D., and E. above can advantageously be used in concentrated form because their ability to solubilize significant levels of perfume via hydrophilic polymer. For example perfumes not completely soluble in water at 100 parts per million can be dissolved using about 0.05% or more hydrophilic polymer. Additionally, the preferred alkyl polyglucoside at low levels can be used to improve perfume solubility. By low levels, it is meant concentrations of less than about 0.05% polyglucoside. It is found that the preferred polyglucoside can dissolve three to ten times of perfume on a weight basis in water, and the ability of the polymer to dissolve/disperse perfume is improved even more. This is beneficial since it keeps the amount of non-volatile materials low to minimize residue. For example, 0.5% of the preferred alkyl polyglucoside with 0.5% PVNO can be used to dissolve up to about 0.5% perfume. At lower surfactant and hydrophilic polymer levels, a larger ratio of perfume to actives can be dissolved. Thus, the combination of 0.03% alkyl polyglucoside and 0.015% can dissolve up to about 0.1% perfume, where other nonionics can only dissolve about half the level of perfume.

G. Methods of Use

In preferred methods of use, the compositions herein are distributed over substantially all of the shower, bath tub, floor, counter, walls, glass, and the like, using either a spray container or distributing device like a sponge, cloth, mop, wipe, roller, absorbent pad, pre-moistened wipe, and the like. Preferably the distribution is substantially uniform. It is an advantage of the type of product herein that no rinsing is needed and, in fact, can be counterproductive since the efficiency of the method is improved by not rinsing. The polymer is primarily effective as a result of staying on the surface to render it hydrophilic. In fact, the method can comprise applying only an aqueous solution of the polymer, or the polymer plus perfume, to the surface.

Instructions for use are rendered in consumer-friendly language on the packaging and/or advertising (e.g., leaflets, coupons, displays, etc.). By consumer-friendly language, it is meant that consumers would be instructed how to preferably use the product, e.g., "apply five sprays of product over a two square foot area", "use electrical sprayer device to cover your entire shower walls", or "use one cap-full of concentrated floor cleaner product diluted into half a bucket of water", to achieve best results. The units of measurement provided to consumers will reflect consumer understanding, e.g., English dosing units will be preferred in the United States, and metric units will be used in most European nations. Pictures can be used, either with, or without, words in helping make the instructions consumer-friendly. Special packaging design can also be advantageously used to convey instructions in a consumer-friendly fashion. Ergonomic appeal can also make product use more intuitive, either with or without words and pictures. In particular, the packaging can be designed to facilitate proper dispensing. Although all of the following methods described herein (below) are written in metric units; it is understood that these units will be converted into consumer-friendly language instructions in the actual product packaging, advertising etc., as illustrated above.

The use of the compositions herein, as opposed to the types of compositions sold heretofore for treating hard surfaces, provides improved performance. A method in which a detergent composition comprising the preferred $C_{8-16}$ alkylpolyglycoside, especially alkylpolyglucoside surfactant with broad alkyl distribution, to bathroom surfaces as part of a treatment after each shower or bath to maintain the surfaces in clean condition and, similarly, a method for cleaning floors using an absorbent pad are also desirable, since the surface appearance is improved, even without the presence of the polymer. However, the best appearance is provided by the combination. In fact, compositions sold heretofore cause the surface to be unsightly due to the failure of the surface to dry evenly, thus exhibiting spots and/or streaks. It is an advantage of the compositions/solutions herein that they can reverse this and immediately improve appearance. Similar benefits are observed in the context of floor cleaners etc. The polymers inhibit soil, hardness, etc. from adhering to the surface and especially inhibit the formation of unsightly spots upon drying, thus avoiding the appearance concerns that might cause the consumer to rinse, or otherwise remove the polymer for appearance reasons.

G1. "Daily Shower" Method

In the context of a product for bathroom and/or shower maintenance, an effective amount of the composition containing the hydrophilic polymer is used to cover the surface to be treated. Distribution can be achieved by using a spray device, a roller, one or more pads etc., although sprayer devices are preferred. One of the more important benefits of the compositions and mode of use thereof, is soil prevention and prevention of soil build-up, and general cleanliness of the shower and related areas.

For best results pertaining to soil prevention, malodor control, deodorization, germ prevention and soil build-up control on showers and related surfaces, the product is applied using from about 5 milliliters per square meter to about 50 milliliters per square meter, more preferably from about 10 milliliters to about 30 milliliters per square meter. The dosing amount will depend on the cleanliness of the shower to begin.

For best results, the method will begin with a clean shower. This reduces the amount of product needed, provides longer lasting, sustainable benefits and leads to better initial and on-going results. When low levels of soil are present, it requires longer periods of use, usually from two to four weeks, to achieve the same desired end result.

For odor control, the daily shower maintenance product can advantageously include cyclodextrin. Care should be taken in the selection of level and type of perfume and cyclodextrin so as to minimize filming and/or streaking. This is particularly true on shiny surfaces such as chrome and glass, where residual solids are highly visible. To achieve this, the perfume is preferably selected to be highly water soluble. Even when little or no cyclodextrin is used, deodorization and malodor control can still be achieved if the product is used as directed, i.e., on a daily basis. For surfaces where lighting is poor or the surfaces are not as shiny, such as fiberglass and mat ceramic, higher levels of surfactant, polymer, perfume and cyclodextrin can be used.

Preferably, the amount of solution is sufficient to completely cover the surface to be treated so as to evenly distribute the polymer and achieve maximum sheeting/spotting benefits. In any event, daily application of the compositions of the invention will result in eventual full coverage of the surface.

Additionally, regular use of the product with thorough coverage will not only maintain cleanliness, but also provide bacteria-static and fungi-static benefits, i.e., it will prevent bacteria and mold from appearing on the treated surfaces.

The appearance of other germs can also be eliminated or substantially minimized using the instructions for use herein disclosed. This mode of use provides an easier means versus conventional approaches for handling micro-organism control (i.e., it eliminates or reduces the need for harsh, streaky actives such as bleach, quaternary ammonium salts etc.).

Since the daily shower compositions are intended to be used on a frequent basis for best results, i.e., preferably daily or after each shower, it is important that the product and delivery mechanism be easily accessible. The packaging and delivery mechanism is preferably designed to be kept in close proximity to areas of use. As such, the packaging should be light, easy to handle and easy to apply. The packaging can preferably encompass aesthetically pleasing features that blend in well in a bathroom setting and optionally includes devices that allow easy storage and retrieval of product. Devices separate from the package include but are not limited to, hanging baskets or shelving directly on the shower head, walls, doors sides of tubs, and the like. Devices that can be part of the package include hooks, fasteners, suction cups, adhesives, screws, and the like to attach and/or store product to walls, doors, showers, etc. Where refill packaging is used, the refill should also be designed for easy access and storage as above. This can be important in that daily use of the product is easily maintainable when the refill package is proximate.

Optionally, to achieve even easier use and maintenance for longer period of time while minimizing the need to refill, larger system units comprising a hose or related delivery mechanism can be used. Examples of such delivery systems include hand-actuated pressure pumps and boxes with built in mechanical, battery operated or electrical pumps. These devices can be directly attached as part of the shower and tub unit, or can be separate external units. Electrical pumps should be attached to the source of electricity through a device that limits the voltage for safety reasons. As separate devices, all of the fastening mechanisms described above can be used, or the device can be completely non-attached. Optionally, and preferably all of the above system units can be equipped with devices for proper dosage quantity, pressure, steam, temperature control and coverage pattern control. In one such execution, a concentrate can be blended with water so as to provide optimum and long lasting delivery of actives.

G2. Wall Cleaning Processes

In the context of a wall cleaner, the compositions can be distributed using a spray device combined with a buffing implement, or dosed more conveniently using a roller, such as manual or powered paint rollers. When using rollers, it is important to remove soil from the roller. This can be achieved by either washing the device with water when it becomes very soiled, or using a wringer to scrape the soil from the roller. The wringing device can be used separately or housed together with the roller. Hand implements for wall cleaning can also be used.

Optionally, the implement is attached to a handle for harder to reach areas, coverage and ease of use. For increased convenience, the compositions can be delivered in the form of a pre-moistened wipe. The pre-moistened wipe can provides cleaning liquid and scrubbing surface all in one execution.

It is especially important to control dosing and coverage where the surface is susceptible to damage. For best results, i.e., soil removal with minimal or no surface damage, dosing should be preferably from about 1 milliliter to about 20 milliliters per square meter, more preferably from about 2 milliliters to about 10 milliliters per square meter. For best results, the product is applied at the above-recommended doses, covering surfaces to be treated completely, and allowed to air-dry. Instructions for use include pictures and/or words detailing preferred application pattern and dosing. The compositions of this invention are mild and minimize harm to most painted surfaces. Preferably solvent use is limited or not present for this application. Preferred compositions for wall cleaning include the preferred $C_{8-16}$ alkylpolyglycoside either with or without hydrophilic polymers. The compositions are ideally suited for light duty jobs, i.e., general maintenance of painted and/ or wall-papered surfaces, because of product mildness and generally low levels of actives. Additional benefits for painted walls, provided by the hydrophilic polymer, include shine, luster restoration, and soil prevention.

G3. Counter and/or Cabinet Cleaning Processes

In the context of a counter and cabinet cleaner, the compositions can be distributed using a spray device combined with a buffing implement, or dosed more conveniently using a hand-implement or an implement attached to a handle for harder to reach areas, coverage, and ease of use. Optionally, for increased convenience, the compositions can be delivered in the form of a pre-moistened wipe. The pre-moistened wipe provides liquid and scrubbing all in one execution. The wipe can also incorporate soft and abrasive materials as needed for spot cleaning. For best results, i.e., soil removal with delivery of high gloss and no streaks to treated areas such that no rinsing is required, dosing should be preferably from about 5 milliliter to about 30 milliliters per square meter, more preferably from about 10 milliliters to about 20 milliliters per square meter. The compositions of this invention are mild and minimize harm to most painted surfaces and woods or worn Formica®. Preferred compositions for wall cleaning include the preferred $C_{8-16}$ alkylpolyglycoside either with or without hydrophilic polymers. The compositions are ideally suited for light duty jobs, i.e., daily or weekly maintenance, because of product mildness and generally low levels of actives. Importantly, residual levels of the hydrophilic polymers provide shine and soil prevention. Solvents, particularly volatile solvents, are preferably incorporated in these compositions, as they can provide additional cleaning, if needed, without streaking in a no-rinse application. The compositions also deliver next-time easier cleaning advantages of grease, encrusted foods and stains via the residual polymer left on surface. Additionally, the compositions can be used with articles to improve cleaning, such as abrasive pads, heat and steam. For counters, antimicrobial benefits are particularly desirable. It is found that compositions comprising can enhance the bacteriocidal benefits of disinfectant compositions delivered via cleaning substrates. Moreover, frequent of the product in a maintenance fashion will provide bacteria prevention benefits.

G4. Glass Cleaning Processes

In the context of a glass and shiny surfaces cleaner, the compositions can be distributed using a spray device combined with a buffing implement, or dosed more conveniently using or hand-implement or an implement attached to a handle for harder to reach areas, coverage, and ease of use. When sprayed or applied to glass surfaces, product can be wiped with absorbent paper towels, cloths, etc. For best results, a preferred wiping pattern consists of a side-to-side-overlapping motion starting in the upper left hand (or right hand) corner of the glass, progressing the wipe pattern down the glass continuing in side-by side patterns, and ending in the bottom left or right corner. The towel or cloth is then flipped to provide clean dry area, and the glass is buffed in an up-and-down pattern starting from the left (or right) end of the glass and progressing to the right (or left) such that the wiping motion covers the entire piece of glass. An alternative wiping pattern begins with up-and-down wiping motions, flipping the towel or cloth and finishing with side-to-side wiping motions. The alternative wiping method simply reverses the timing of the side-to-side and up-and-down wiping patterns. A benefit to the combined side-to-side and up-and-down patterns is minimization of streaks as a result of improved spreading of solution and the elimination of streak lines from paper towel linear motions (i.e., the edges of the paper towel or cloth form provide visible demarcations of where wiping has taken place). In accordance with the above-wiping patterns, solution should be applied at application level of from about 10 to about 20 sprays per square meter (assuming that one spray delivers about one to-two milliliters). The above preferred cleaning pattern(s) can also be advantageously used in the context of a multi-laminate pre-moistened wipe wherein one outer-layer is pre-moistened while the other is substantially dry prior to use. In such cases, wiping is first performed with the pre-moistened outer layer such that when the towel is flipped, the dry side is exposed to the surface to be cleaned. In this manner, cleaning is achieved with a buffing step, which is often preferred in highly soiled environments. Many of the hydrophilic polymer benefits, including water sheeting and antifog, are substantially retained even a buffing step is included in the process. Those skilled in the art will appreciate that the level of hydrophilic polymer may have to be increased in pre-moistened that include a dry outer-layer designed for buffing.

G5. Floor Cleaning Processes

In the context of a floor surfaces cleaner, the compositions can be distributed using a sponge, string or strip mop. By floor cleaners, we mean compositions intended to clean and preserve common flooring inside or outside of the home or office. Floors that can be cleaned with compositions of the present invention include living room, dining room, kitchen, bathroom, cellar, attic, patio etc. These floors can consist of ceramic, porcelain, marble, Formica®, no-wax vinyl, linoleum, wood, quarry tile, brick or cement, and the like.

In the context of conventional, i.e., sponge, string and strip implements preferably equipped with mop heads and handles, the compositions can be ready to use, i.e., used as is, or diluted in a bucket or other suitable receptacle at dilution factors specified in the instructions. For best results, thorough sweeping and/or vacuuming is recommended before wet mopping. It is recommended that the lowest soiled floors be cleaned first, with progression toward more heavily surfaces. This maximizes the mileage of the solution and limits room to room contamination. The implement head is dunked or immersed into the solution (either dilute or ready to use) and wrung out. The implement should not be completely dry nor should it be dripping wet prior to mopping.

A preferred mopping pattern with a sponge mop or floor cloth used with a brush with a handle is performed in an up-and-down overlapping motion from left to right (or right to left) and then repeated using an up-and-down overlapping pattern from right to left (or left to right). The up-and-down motion preferentially covers about 0.5 meters to about 1 meter. The left to right distance preferentially is about 1 to about 2 meters. After mopping this area, i.e., from about 0.5 square meters to about 2 square meters, the sponge mop or floor cloth should be re-immersed in solution and wrung again. By following this procedure the volume of solution left on solution left on the floor is from about 20 milliliters to about 50 milliliters per square meter, preferably from about 30 milliliters to about 40 milliliters per square meter.

Using a string or strip mop(e.g., cellulose, polyvinyl alcohol (PVA), cotton, synthetic or blends, and mixtures thereof), a preferred mopping pattern consists of an up-and-down overlapping motion from left to right (or right to left) which is then repeated using a side to side overlapping motion from right to left (or left to right). The up-and-down motion preferentially covers about 0.5 meters to about 1 meter. The side-to-side pattern right to left (or left to right) is preferably covers from about 0.5 meters to about 1 meter. The mopping pattern preferably outlines a square shape, i.e., from about 0.5 square meters to about 1 square meter. After mopping this area, the strip or string mop should be re-immersed in solution and wrung again. By following this procedure the volume of solution left on solution left on the floor is from about 20 milliliters to about 50 milliliters per square meter, preferably from about 30 milliliters to about 40 milliliters per square meter.

Optionally, to better control consistency of results using conventional mops, the composition (either diluted or ready to use) is stored in one receptacle, and the mop-rinsing water is stored in another receptacle. This dual-receptacle approach can consist of two separate units or can be combined as one. Examples of this mode of use include squirt bottles, trigger sprays, mechanical sprays, garden misters, and electrical or battery-operated dosing devices. The advantages of this mode of use include always providing fresh solution to the floor, and keeping soiled water (from the cleaning of the floors) from re-contaminating the floor. Additionally, this approach effectively controls microorganisms through less re-inoculation, thereby providing a more germ-free end result. This mode of use is also advantageous for spot cleaning, i.e., tough-to-clean areas can be pre-treated with product before the mopping begins; this mode of use also allows flexibility with respect to dosage control in that more solution can be administered to dirty areas, and less to cleaner areas, thereby improving value.

Optionally, to achieve more consistent and higher quality results, the composition can be applied directly to the floor as a ready to use solution in either liquid or spray form. Examples of this mode of use include squirt bottles, trigger sprays, mechanical sprays, garden misters, and electrical or battery-operated dosing devices. Advantages of this mode of use include always providing fresh solution to the floor, and better mop maintenance, particularly if the mop is not re-exposed to dirty solution (i.e., the mop can be preserved longer by wringing out old solution and only applying fresh solution to the floor.). Additionally, this approach more effectively removes microorganisms from the cleaning mechanism, thereby providing a more germ-free end result (i.e., less re-inoculation of the microorganisms). This mode of use is also advantageous for spot cleaning, i.e., tough-to-clean areas can be pre-treated with product before the mopping begins; this mode of use also allows flexibility with respect to dosage control in that more solution can be administered to dirty areas, and less to cleaner areas, thereby improving value.

Optionally, the fresh solution dispensing approach can be delivered using a motorized system. An example of a motorized system for floor cleaning is the Dirt Devil® Wet Vac. Preferably, the motorized system would comprise a chamber containing fresh solution and a second chamber to suck up and hold the dirty solution removed from the floor. The motorized unit also preferably comprises squeegee and/or scrubbing devices. The scrubbing device can be made of cotton, cellulose sponge etc. The dispensing unit can consist of a simple unit containing a lever (which can be calibrated for one or more dosing levels) to meter liquid onto the floor. Thorough sweeping and/or vacuuming is recommended prior to using the motorized cleaning system. A preferred wiping pattern consists of an up-and-down overlapping motion from left to right (or right to left) and then repeated using an up-and-down overlapping pattern from right to left (or left to right). The up-and-down motion preferentially covers about 0.5 meters to about 1 meter. The left to right distance preferentially is about I to about 2 meters. After mopping this area, i.e., from about 0.5 square meters to about 2 square meters, the motorized cleaning unit is engaged, solution is squeezed into a puddle in a raking motion, and then sucked up into the dirty solution containment chamber using vacuum.

G6. Methods Using Glass Cleaning Wipes

Optionally, for increased convenience, the compositions can be delivered in the form of a pre-moistened wipe. For tough to reach areas (e.g., indoor or outdoor windows, second or higher story windows, large pieces of glass), the pre-moistened wipe is optionally but preferably attached to a mop head and handle. For ease of use and versatility, the handle can consist of one or more small extendible attachment or a telescopic pole. For best results, the mop head unit includes a squeegee for optional buffing. The pre-moistened wipe provides liquid and scrubbing all in one execution. For best results, i.e., soil removal with delivery of high gloss and no streaks to treated areas such that no rinsing is required, dosing should be preferably from about 1 milliliter to about 10 milliliters per square meter, more preferably from about 3 milliliters to about 5 milliliters per square meter. For best results, a preferred wiping pattern consists of a side-to-side overlapping motion starting in the upper left hand (or right hand) corner of the glass, progressing the wipe pattern down the glass continuing in side-by side patterns, and ending in the bottom left or right corner. The pre-moistened wipe is then flipped, and the glass is cleaned in an up-and-down pattern starting from the left (or right) end of the glass and progressing to the right (or left) such that the wiping motion covers the entire piece of glass. An alternative wiping pattern begins with up-and-down wiping motions, flipping the pre-moistened and finishing with side-to-side wiping motions. The alternative wiping method simply reverses the timing of the side-to-side and up-and-down wiping patterns. A benefit to the combined side-to-side and up-and-down patterns is minimization of streaks as a result of improved spreading of solution and the elimination of streak lines from paper towel linear motions (i.e., the edges of the paper towel or cloth form provide visible demarcations of where wiping has taken place). Preferably, the left-on solution evaporates quickly following completion of the wipe pattern. For best end result, pressure placed on the pre-moistened wipe is decreased during the final wiping steps. In this manner, solution dripping is reduced and the wipe can be effectively used in reabsorbing some of the liquid during the final wiping stage. The compositions of this invention work particularly well in a no-rinse application for window glass, car glass, mirrors, chrome, silver, stove tops, glass tables, appliances, and the like. Unlike conventional glass cleaners, pre-moistened wipes do not require extra buffing to deliver excellent filming/streaking end results, particularly for light cleaning tasks. Additionally, the hydrophilic polymer delivers several important consumer benefits, including anti-fog and soil spotting prevention properties. The compositions are ideally suited for light duty jobs, i.e., stove top cleanliness, i.e., weekly maintenance. Importantly, residual levels of the hydrophilic polymers provide shine and soil prevention. Solvents, particularly volatile solvents, are preferably incorporated in these compositions, as they can provide additional cleaning, if needed, without streaking in a no-rinse application. The compositions also deliver next-time easier cleaning advantages of grease, encrusted foods and stains via the residual polymer left on surface. Additionally, the compositions can be used with articles to improve cleaning, such as abrasive pads, heat and steam and combinations thereof. For particularly tough soil removal or highly soiled surfaces, use of a multi-laminate wipe is even more advantageous. The same level of liquid and wiping pattern(s) is used as described above, but instructions would include an additional buffing or polishing step in order to remove potentially dirty liquid and prevent soil redeposition on glass.

G7. General Purpose and Floor Cleaning Using a Pre-moistened Wipe

Optionally, for increased floor cleaning convenience, the compositions can be delivered in the form of a pre-moistened wipe as described hereinbefore, preferably attached to a mop head and/or handle. The pre-moistened wipe can provide liquid and scrubbing all in one execution. Mopping pattern with a pre-moistened mop used with a handle is preferably performed in an up-and-down overlapping motion from left to right (or right to left) and then repeated using an up-and-down overlapping pattern from left to right (or right to left). The up-and-down motion preferentially covers about 0.5 meters to about 1 meter. The left to right distance preferentially is about 1 to about 2 meters. This mopping pattern is then repeated until the wipe is either substantially exhausted or dried out. Pre-moistened wipes can be advantageous particularly for cleaning small areas, such as encountered in typical bathrooms. They are also readily available and versatile in that they can be used to clean surfaces other than floors, such as counter tops, walls, etc., without having to use a variety of other liquids and/or implements. This approach also effectively removes and controls microorganisms by minimizing implement inoculation, which is often seen with conventional re-usable systems such as sponge, string and strip mops. Lack of implement inoculation leads to a cleaner and more germ-free end result.

G8. Floor Cleaning Using a Disposable Pad

Optionally, and most preferably, convenience and performance can be maximized by using a system composed of a disposable cleaning pad and a mode for applying fresh solution onto the floor. The pad is composed of a laminate of non-wovens, cellulose and super-absorbent polymer. This pad is attached to a device comprising a mop head and handle. In such a system, solution application can be achieved via a separate squirt bottle or spray trigger system, or can be directly attached or built-in to the device (i.e., on the mop head or the handle). The delivery mechanism can be actuated by the operator, or can be battery-induced or electrical.

This system provides multiple benefits versus conventional cleaning modes. It reduces time to clean the floor, because the pad sucks up dirty solution. It eliminates the need to carry heavy, messy buckets. Due to the absorbent pad which absorbs and locks away dirty solution, a single pad can clean large surface areas.

Additionally, since a fresh pad is used every time, germs and dirt are trapped, removed and thrown away, promoting better hygiene and malodor control. Conventional mops, which are re-usable, can harbor dirt and germs, which can be spread throughout the household and create persistent bad odors in the mop and in the home. Through operator-controlled dosing and more efficient removal of dirty solution from the floor, better end result is also achieved.

Additionally, because the cleaning process involves use of low levels of solution in contact with the floor for much shorter periods of time relative to conventional cleaning systems, (less solution is applied on the floor and the super-absorbent polymer absorbs most of it such that volume left behind with the disposable pad and mop is only from about 1 to about 5 milliliters of solution per square meter), the system provides improved surface safety on delicate surfaces. This is particularly important for the cleaning of wood, which tends to expand and then contract when excess treated with excess water.

Finally, this system is well suited for pre-treating tough soil spots prior to full floor cleaning because of the controlled dosing of solution. Unlike conventional mops, this system is more effective and more convenient for removal of spills. For example, conventional mops actually wet the floor in attempting to control spills, while absorbent paper towels or cloths require the user to bend down to achieve spill removal. Finally, the implement plus pad can be designed to allow easy access to tough to clean and hard to reach areas, e.g., under appliances, tables, counters, and the like. The use of super-absorbent polymer allows a reduction in volume of the pad, i.e., the pad is thin though highly absorbent due to the super-absorbent structure being able to absorb 100 times its weight; this is achievable with conventional mops, which require greater bulk for absorption purposes (cellulose or a synthetic structures absorb only up to about from 5 to about 10 times their weight).

For best results using the disposable pad and implement cleaning system, first thoroughly sweep and/or vacuum before wet mopping. Prior to application of the solution to the areas to be cleaned, preferably apply from about 10 to about 20 milliliters in small area (e.g., about one-half a square meter) and wipe pad across area back and forth several times until solution is almost completely absorbed. This is important in that it primes the pad, allowing it to function most effectively. In an application where the dosing mechanism is separate from the implement (i.e., a detached dosing system), a priming set can optionally be to spray solution directly onto the pad, with even coverage using from about 10 to about 20 milliliters. Apply solution at rate of from about 5 to about 40 milliliters, more preferably from about 10 to about 30 milliliters per square meter, spreading the liquid out as much as possible over the area section to be cleaned. This is followed by wiping using the disposable pad.

A preferred wiping pattern consists of an up-and-down overlapping motion starting in the bottom left hand (or right hand) side of the section to be cleaned, and progressing the wiping pattern across the floor continuing to use up-and-down wiping motions. Wiping is then continued beginning at the top right (or left) side of the section to be cleaned and reversing the direction of the wipe pattern using a side-to-side motion. Another preferred wipe pattern consists of an up-and-down wiping motion, followed by an up-and-down wiping motion in the reverse direction. These thorough preferred wiping patterns allow the pad to loosen and absorb more solution, dirt and germs, and provide a better end result in doing so by minimizing residue left behind. Another benefit of the above wiping patterns is minimization of streaks as a result of improved spreading of solution and the elimination of streak lines from the edges of the pad.

The pads are versatile in that they can be used for multiple cleanings and multiple surfaces. Each pad is designed to clean one average size floor (i.e., from about 10 to about 20 square meters) with an average soil load. Pads can need to be changed sooner if floors are larger than average, or especially dirty. To determine if the pad needs changing, look at the back of the pad and ascertain if the back absorbent layer is saturated with liquid and/or dirt.

The use of the compositions herein, where no rinsing is desirable, as opposed to the types of compositions sold heretofore for treating non-bathtub/shower area surfaces including floor surfaces, walls and counter tops, provides improved performance.

H. Article of Manufacture

It is highly desirable in the context of using the product defined herein on a regular, e.g., daily, bi-weekly or weekly basis, especially without rinsing, to maintain the cleanliness of a bath room, shower, walls, counter tops, glass, floors etc., that the product be marketed in a container, in association with instructions to use it on a regular basis, preferably after showering and/or bathing, especially without rinsing. The instructions can be either directly printed on the container itself or presented in a different manner including, but not limited to, a brochure, print advertisement, electronic advertisement, and/or other advertisement, so as to communicate the set of instructions to a consumer of the article of manufacture. The consumer needs to know the method of use, and the benefits from following the method of use in order to obtain the full value of the invention.

In another more preferred embodiment, the compositions of the present invention are used in the context of a cleaning implement that comprises a removable cleaning pad which alleviates the need to rinse the pad during use. This preferably includes a cleaning implement that comprises a removable cleaning pad with sufficient absorbent capacity, on a gram of absorbed fluid per gram of cleaning pad basis, that allows the cleaning of a large area, such as that of the typical hard surface floor or wall (e.g., 80–100 $ft^2$), without the need to change the pad. This, in turn, requires the use of a superabsorbent material, preferably of the type disclosed hereinbefore and in Ser. No. 08/756,507, incorporated by reference hereinbefore.

The liquid compositions described above can be desirably used with an implement for cleaning a surface, the implement comprising:

a. cleaning pad, preferably removable, containing an effective amount of a superabsorbent material, and having a plurality of substantially planar surfaces, wherein each of the substantially planar surfaces contacts the surface being cleaned, more preferably said pad is a removable cleaning pad having a length and a width, the pad comprising
   i. scrubbing layer; and
   ii. optionally an absorbent layer comprising a first layer and a second layer, where the first layer is located between the scrubbing layer and the second layer (i.e., the first layer is below the second layer) and has a smaller width than the second layer; and b. optionally, a handle.

Optionally, a preferred aspect of the cleaning pad is the use of multiple planar surfaces that contact the soiled surface during the cleaning operation. In the context of a cleaning implement such as a mop, these planar surfaces are provided such that during the typical cleaning operation (i.e., where the implement is moved back and forth in a direction substantially perpendicular to the pad's width), each of the planar surfaces contact the surface being cleaned as a result of "rocking" of the cleaning pad.

The preferred cleaning implements have a pad which offers beneficial soil removal properties due to continuously providing a fresh surface, and/or edge to contact the soiled surface, e.g., by providing a plurality of surfaces that contact the soiled surface during the cleaning operation.

The detergent surfactant is preferably linear, e.g., branching and aromatic groups should not be present, and the detergent surfactant is preferably relatively water soluble, e.g., having a hydrophobic chain containing preferably from about 8 to about 16, , carbon atoms, and, for nonionic detergent surfactants, having an HLB of from about 9 to about 15, more preferably from about 10 to about 13.5. The most preferred surfactants are the alkylpolyglucosides described hereinbefore. Other preferred surfactants are the alkyl ethoxylates comprising from about 9 to about 12 carbon atoms, and from about 4 to about 8 ethylene oxide units. These surfactants offer excellent cleaning benefits and work synergistically with the required hydrophilic polymers. A most preferred alkyl ethoxylate is $C_{11}EO_5$, available from the Shell Chemical Company under the trademark Neodol® 1–5. The $C_{11}EO_5$ is particularly preferred when used in combination with the preferred cosurfactants, $C_8$ sulfonate and/or Poly-Tergent CS-1. Additionally, the preferred alkyl ethoxylate surfactant is found to provide excellent cleaning properties, and can be advantageously combined with the preferred $C_{8-16}$ alkyl polyglucoside in a matrix that includes the wetting polymers of the present invention. While not wishing to be limited by theory, it is believed that the $C_{8-16}$ alkyl polyglucoside can provide a superior end result (i.e., reduce hazing) in compositions that additionally contain the preferred alkyl ethoxylate particularly when the preferred alkyl ethoxylate is required for superior cleaning. The preferred the $C_{8-16}$ alkyl polyglucoside is also found to improve perfume solubility of compositions comprising alkyl ethoxylates. Higher levels of perfume can be advantageous for consumer acceptance.

The invention also comprises a detergent composition as disclosed herein in a container in association with instructions to use it. This container can have an assembly of one or more units, either packaged together or separately. For example, the container can include a pad or a dry wipe with cleaning solution. A second example is a container with pad or dry wipe, implement and solution. A third example is a container with concentrated refill, ready to use solution and pads with or without superabsorbent gelling. Yet another example is a container with a pre-moistened wipe, either with or without an implement, with or without a handle.

The detergent composition, (cleaning solution) is an aqueous-based solution comprising the hydrophilic polymer, optionally, but preferably, and optionally one or more detergent surfactants, the preferred alkylpolyglycosides being present if the hydrophilic polymer isn't present, optional solvents, builders, chelants, suds suppressors, enzymes, etc. Suitable polymers are those previously described herein. Suitable surfactants are commercially and are described in McCutcheon's Vol. 1: Emulsifiers and Detergents, North American edition, McCutcheon's Division, MC Publishing Company, 1999. Again, the most preferred polymers are polymers containing amine oxide moieties. The most preferred surfactants are the $C_8$–$C_{16}$ polyalkylglucosides, and $C_{9-12}$ ethoxylates with from about 4 to about 8 oxyethylene units, and mixtures thereof. These compositions have been disclosed hereinbefore.

A suitable preferred cleaning solution for use in the context of floors, counters, walls, either as a stand-alone or in conjunction with conventional sponges, mops, rags, or with disposable pre-moistened wipes, pads, mops etc. comprises: from about 0.001% to about 0.25%, preferably from about 0.005% to about 0.15%, more preferably from about 0.01% to about 0.07% of the hydrophilic polymer. The level of polymer chosen will depend on the application. For example, it is found that higher levels of hydrophilic polymer can leave a sticky feel on floors. Such a tack is more easily tolerated in applications such counters, stove tops and walls. The composition can contain only the polymer, but preferably also contains from about 0.001% to about 0.5%, preferably from about 0.005% to about 0.25%, more preferably from about 0.005% to about 0.1%, of detergent surfactant, preferably comprising said alkylpolyglucoside, more preferably the preferred alkyl polyglycoside containing a $C_{8-16}$ alkyl group and from about 1 to about 1.5, preferably from about 1.1 to about 1.4 glycosyl groups, and/or linear alkyl ethoxylate detergent surfactant (e.g., Neodol 1–5™, available from Shell Chemical Co.) and/or an alkyl sulfonate (e.g., Bioterge PAS-8s™, a linear $C_8$ sulfonate available from Stepan Co.); optionally, from about 0.001% to about 0.5%, preferably from about 0.01% to about 0.3 volatile buffer material, e.g., ammonia, 2-dimethylamino-2-methyl-1-propanol; optionally, from about 0.001% to about 0.05%, preferably from about 0% to about 0.02% non-volatile buffer material, e.g., potassium hydroxide, potassium carbonate, and/or bicarbonate; optionally, from about 0.001% to about 0.5%, preferably from about 0.05% to about 0.25%, of; other optional adjuvants such dyes and/or perfumes; and from about 99.9% to about 80%, preferably from about 99% to about 85%, more preferably from about 98% to about 90%, deionized or softened water. The exact level of deionized or softened water will depend on the nature of the application. Concentrates can have less than 80% deionized or soft water, depending on the concentration factor (e.g., 5X, 10X, 20X).

One embodiment of the invention also preferably comprises a detergent composition as disclosed herein in a container in association with instructions to use it with an absorbent structure comprising an effective amount of a superabsorbent material, and, optionally, in a container comprising the implement, or, at least, a disposable cleaning pad comprising a superabsorbent material. This invention also relates to the use of a composition with hydrophilic polymer and a cleaning pad comprising a superabsorbent material to effect cleaning of soiled surfaces, i.e., the process of cleaning a surface comprising applying an effective amount of a detergent composition, typically containing no more than about 1% detergent surfactant; a level of hydrophobic materials, including solvent, that is less than about 5%; and having a pH of more than about 9 and absorbing the composition in an absorbent structure comprising superabsorbent material.

Cleaning Implement

In one preferred aspect, the present invention relates to the use of the described detergent composition optionally containing a disappearing dye, with an implement for cleaning a surface of the type disclosed hereinbefore, the implement comprising:

a. removable cleaning pad comprising a superabsorbent material and having a plurality of substantially planar surfaces, wherein each of the substantially planar surfaces contacts the surface being cleaned, and preferably a pad structure which has both a first layer and a second layer, wherein the first layer is located between the scrubbing layer and the second layer and has a smaller width than the second layer; and b. optionally, a handle As discussed hereinbefore, in a preferred aspect of the invention, the pad preferably contains a superabsorbent material and preferably also provides significant cleaning benefits. The preferred cleaning performance benefits are related to the preferred structural characteristics described below, combined with the ability of the pad to remove solubilized soils. The preferred cleaning pad, as described herein, when used with the preferred detergent composition, as described hereinbefore, provides optimum performance.

The preferred pads provide multiple planar surfaces as discussed hereinbefore.

As used herein, all numerical values are approximations based upon normal variations; all parts, percentages, and ratios are by weight and by weight of the composition unless otherwise specified; and all patents and other publications referred to herein are incorporated herein by reference.

EXAMPLES

The present invention is further illustrated by the following examples and/or comparative examples. The following compositions are made by mixing the listed ingredients in the listed proportions in the listed order of addition.

COMPOSITION

Comparison products include those marketed under the following names with the indicated nominal compositions.

| | SCRUB FREE | SHOWER SHINE |
|---|---|---|
| Manufacturer | Benckiser | S. C. Johnson & Son |
| Anionic surfactants | — | 0.1% LAS(1)<br>Presence of NaXS(2) |
| Cationic surfactants | — | — |
| Non ionic surfactant | 0.4% $C_{12-13-14-15}$ ethoxylated alcohol | — |
| Acid | 0.4% Citric acid | — |
| Solvent | — | 3.6% Isopropanol<br>1.3% hexyl cellosolve<br>1.1% Butoxy ethanol<br>or<br>hexylene glycol |
| pH as is | 4.3 | 12.0 |

(1)LAS = Sodium Linear Alkylbenzene Sulfonate. The MW used for the calculation is 344 g/mol.
(2)NaXS = Sodium Xylene sulfonate.

| | TILEX FRESH SHOWER | CLEAN SHOWER |
|---|---|---|
| Manufacturer | Clorox | Clean Shower |
| Anionic Surfactant | Absent | Absent |
| Cationic surfactant | Absent | 0.1% BKC(1) |
| Non-ionic surfactant | Absent | Absent |
| Alkyl Polyglucoside | Presence of $C_{8-10-12}$APG | Present |
| Fatty Acid | Absent | Absent |
| Solvent | 2.3% isopropanol | 2.4% isopropanol<br>0.2% Butanol |
| pH as is | 12.0 | 5.2 |

(1)BKC = Benzalkonium Chloride. The MW used for the calculation is 351 g/mol.

EXAMPLE OF COMPOSITIONS OF THE PRESENT INVENTION

| | | |
|---|---|---|
| Sodium $C_{12-14}$alkyl sulfate | 0.20% | — |
| Alkylpolyglucoside[1] | — | 0.25% |
| PVNO[2] | 0.075% | 0.075% |
| Sodium carbonate | 0.015% | — |
| Water | Balance | Balance |
| Perfume | — | — |

[1]Alkylpolyglucoside = Primary Detergent Surfactant
[2]PVNO = polyvinyl pyridine n-oxide

TEST METHOD FOR PERFORMANCE OF DAILY SHOWER COMPOSITIONS:

Clean glazed ceramic tiles: Dal-Tile® glazed blue ceramic tile (P.O. Box 17130, Dallas, Tex., USA, dimensions 152 mm ×152 mm ×8 mm) and Dal-Tile® glazed black ceramic tile (105 mm ×105 mm ×8mm) are used in the daily shower product testing described below. Each tile is first wiped with paper tile, then rinsed with distilled water. Spray isopropyl alcohol on tile and wipe with a damp (wet) paper towel or cloth. Re-rinse with distilled water. Continue cleaning procedure until distilled water rinse results induces 90+% of water to bead or run off tile in less than 5 seconds (beading experiment is conducted by holding tile vertically). The tiles are then wiped to dryness, and gloss is recorded.

Gloss measurements: Five gloss readings are made (600 angle measurements using a micro-TRI-gloss glossmeter manufactured by BYK Gardner, Germany) for each tile and the average of the readings recorded. Measurements are conducted near each of the corners and at the center of the tile.

Tile treatment with Droduct: Each tile is positioned vertically against a wall (or a sink). It is then sprayed with 5 ml of test product (note: this corresponds to 5 sprays), applied from a distance of about 2 feet (60 centimeters) using T8500 sprayers manufactured by Continental Sprayers Inc., St. Peters, Mo., USA. Tile spraying (misting) is performed so as to maximize the product coverage on the tile. Following product treatment, tiles are allowed to air dry. Once dry, tile gloss is measured. The tiles are then visually inspected graded for spots, streaks and film left by the test product. On average, the difference between the gloss on the clean tile, and the gloss following product treatment corresponds to gloss loss due to product.

Simulated showers: Water of known hardness is used to simulate shower events. The tiles are positioned to stand vertically on a sink wall and are then sprayed with city warm city water (T ~100° F. or 37° C.) at a distance of about 2 feet (60 centimeters) using T8500 sprayers. Each tile is sprayed at a constant dosage rate of 80 sprays per minute for three minutes (240 ml) and then allowed to dry under ambient conditions. Tile spraying (misting) is performed so as to maximize the product coverage on the tile. Once dry, tiles are visually inspected and graded for spots and streaks (all product film is rinsed away over the three minute simulated shower event).

Cycles: The above procedure can be repeated a number of times in an effort to simulate the effects of continuous use of the product following each shower event. It is observed that some products perform better with additional uses, though performance does not tend to improve any more after the third cycle use.

Final gloss measurement (optional): After the last, simulated shower cycle, gloss measurements can be performed to estimate the cumulative effect of product treatment and shower rinsing.

Compositions: All raw materials are purchased from commercial sources. The PVNO used in the tests below is made by Reilly industries, and has a molecular weight of ~20,000 g/mole. The APG used in all tests is Plantaren 2000 from Henkel, a commercially available cosmetic grade $C_{8-16}$ polyalkylglucoside. The Tivoli-cyclodextrin complex described in example 2 is made by mixing perfume and β-cyclodextrin so as to saturate the cavity of the βeta-cyclodextrin. Excess perfume is then removed and the complex is dried to a solid.

Results on blue ceramic tile: sheeting, spotting and end result performance

| Cycle # | | Untreated Tile | .25% APG .01% Perfume | Clean Shower ™ | Shower Shine ™ | Tilex Fresh Shower ™ | Scrub Free ™ (Benckiser) |
|---|---|---|---|---|---|---|---|
| 0 | Tile Gloss reading prior to test (avg. of 5 readings) | 98.6 | 98.7 | 98.8 | 99.2 | 99.6 | 101.3 |
| 1 | Gloss reading after spraying tile with test product | N/A | 97.7 | 87.5 | 87.7 | 83.8 | 79.5 |
| | Dry tile appearance after spraying with test product | Spotty | Almost untreated | Oily (streaks) | Filmy | Oily (streaks) | Filmy |
| | % Sheeting at end of simulated shower event | 0% | 20% | 0% | 0% | 60% | 30% |
| | Tile appearance after simulated shower event (dry tile) | Spotty everywhere | Small spots on 1/2 of tile | Spotty everywhere | Spotty everywhere | Spots on 1/2 of tile | Spotty on 1/2 of tile |
| 2 | Gloss reading spraying after tile with test product | N/A | 98.0 | 88.8 | 88.0 | 83.8 | 82.7 |
| | Dry tile appearance after spraying with test product | Spotty | A few spots | Oily (streaks) | Filmy | Oily (streaks) | Filmy |
| | % Sheeting at end of simulated shower event % | 0% | 40% | 0% | 10% | 100% | 20% |
| | Tile appearance after simulated shower event (dry tile) | Spotty everywhere | Small spots on 1/2 of tile | Spotty everywhere | Spotty everywhere | No spots | Spots on 1/2 of tile |
| 3 | Gloss reading after spraying tile with test product | N/A | 97.9 | 89.0 | 89.9 | 83.8 | 82.5 |
| | Dry tile appearance after spraying with test product | Spotty | Untreated | Oily (streaks) | Filmy | Oily (streaks) | Filmy |
| | % Sheeting at end of simulated shower event | 0% | 40% | 10% | 50% | 100% | 80% |
| | Tile appearance after simulated shower event (dry tile) | Spotty everywhere | Small spots on 1/4 of tile | Spotty everywhere | Spots on 1/2 of tile | No spots | Spots on 1/4 of tile |

Results on blue ceramic tile: sheeting, spotting and end result performance - PVNO addition

| Cycle # | | .075% PVNO | .25% APG .01% .01% Perfume + 075% PVNO | Clean Shower ® + .075% PVNO | Shower Shine ® + .075% PVNO | Tilex Fresh Shower ® + .075% PVNO | Scrub Free ® (Benckiser) + .075% PVNO |
|---|---|---|---|---|---|---|---|
| 0 | Tile Gloss reading prior to test (avg. of 5 readings) | 99.6 | 99.2 | 98.0 | 99.0 | 98.0 | 97.3 |
| 1 | Gloss reading after spraying tile with test product | 99.4 | 98.7 | 90.5 | 88.7 | 85.9 | 80.8 |
| | Dry tile appearance after spraying with test product | Almost untreated | Untreated | Oily (streaks) | Filmy | Oily (streaks) | Filmy |
| | % Sheeting at end of simulated shower event | 100% | 100% | 10% | 100% | 90% | 95% |
| | Tile appearance after simulated shower event (dry tile) | Small spots on 1/5 of tile | Small spots on 1/2 of tile | Spotty everywhere | No spots | Oily (streaks) | Two small spots on tile |
| 2 | Gloss reading spraying after tile with test product | 97.2 | 98.0 | 90.6 | 86.9 | 86.8 | 85.8 |
| | Dry tile appearance after spraying with test product | Almost untreated | A few spots | Untreated | Filmy | Oily (streaks) | Filmy |
| | % Sheeting at end of simulated shower event % | 100% | 40% | 20% | 100% | 80% | 100% |
| | Tile appearance after simulated shower event (dry tile) | No spots | Small spots on 1/2 of tile | Spotty everywhere | No spots | A few spots | No spots |
| 3 | Gloss reading after spraying tile with test product | 97.0 | 97.9 | 91.4 | 85.9 | 89.9 | 85.1 |
| | Dry tile appearance after | No spots | Untreated | Untreated | No spots | Filmy | Filmy |

-continued

Results on blue ceramic tile: sheeting, spotting and end result performance - PVNO addition

| Cycle # | .075% PVNO | .25% APG .01% .01% Perfume + 075% PVNO | Clean Shower ® + .075% PVNO | Shower Shine ® + .075% PVNO | Tilex Fresh Shower ® + .075% PVNO | Scrub Free ® (Benckiser) + .075% PVNO |
|---|---|---|---|---|---|---|
| spraying with test product % Sheeting at end of simulated shower event | 100% | 40% | 30% | 100% | 100% | 100% |
| Tile appearance after simulated shower event (dry tile) | No spots | Small spots on 1/4 of tile | Spotty everywhere | No spots | No spots | Two small spots |

For each of the compositions above, addition of the hydrophilic polymer either improves water sheeting and tile spotting or leaves performance unchanged. The largest benefits are observed using PVNO alone, PVNO added to APG and PVNO added to the Benckiser product. Moreover, incorporation of PVNO to each of the formulations above does not deleteriously impact gloss.

In a separate test, 0.075% PVNO is added to Reckitt & Colman's Mist Away™ product. No sheeting or spotting advantages were observed from the hydrophilic polymer. Analysis of this product reveals the presence of quaternary ammonium salts. Quaternary surfactants are known to hydrophobically modify surfaces, thus increasing the contact angle between water and the surface. Addition of PVNO fails to reduce contact angle sufficiently to induce sheeting.

EXAMPLE

In the following example end result performance, as measured by streaking and filming was measured for several compositions of the present invention, and compared to commercially available product. Relevant bath shower substrates tested included blue and black Daltile® ceramic tiles and glass shower door (Company name, make and dimensions). Visual grades were assigned for Film/haze and spots/streaks based on the average of three expert graders. Grades were made on a 0–6 sliding scale, where "0" indicates a perfect end result and "6" suggests a terrible end result. End result was also dimensioned using glossmeter measurements. Each of the gloss measurements is performed following application of the product after each cycle. The protocol for the tests is identical to that described at the beginning of the experimental section.

Results on blue ceramic tile: Expert graders (0–6 scale)

| | .075% PVNO 2.0% C12–14AS .015% $Na_2CO_3$ 0.01% Perfume | 0.075% PVNO 3.0% Ethanol | 0.10% PVNO 0.05% Cyclodextrin + Perfume | 0.075% PVNO 0.25% APG 0.01% Perfume | Shower Shine | Fresh Shower | Clean Shower |
|---|---|---|---|---|---|---|---|
| End result Round 1 Film/Haze (0–6) | 2.3 | 1.0 | 0.7 | 1.0 | 4.3 | 4.5 | 5.0 |
| End result Round 1 Spots/streaks (0–6) | 4.3 | 4.8 | 4.8 | 1.2 | 1.7 | 4.2 | 3.0 |
| Overall end result Round 1 (0–6) | 4.0 | 5.0 | 4.8 | 1.3 | 3.3 | 5.2 | 5.3 |
| End result Round 2 Film/Haze (0–6) | 3.0 | 1.8 | 0.8 | 1.2 | 5.8 | 2.7 | 1.0 |
| End result Round 2 Spots/streaks (0–6) | 3.5 | 2.5 | 1.5 | 1.0 | 4.7 | 2.7 | 1.7 |
| Overall end result Round 2 (0–6) | 2.7 | 1.7 | 1.7 | 0.7 | 5.0 | 3.7 | 2.3 |

Results on Blue Ceramic Tile: Glossmeter readings

| | 0.075% PVNO 2.0% C12–14AS 0.015% $Na_2CO_3$ 0.01% Perfume | 0.075% PVNO 3.0% Ethanol | 0.10% PVNO 0.05% Cyclodex. + Perfume | 0.075% PVNO 0.25% APG 0.01% Perfume | Shower Shine | Fresh Shower | Clean Shower |
|---|---|---|---|---|---|---|---|
| Initial Gloss (60° angle) | 90.6 | 90.9 | 91.5 | 92.6 | 90.1 | 91.6 | 94.1 |
| Gloss Round 1 (60° angle) | 89.9 | 86.9 | 87.6 | 87.9 | 84.1 | 81.5 | 83.9 |
| Gloss Round 2 (60° angle) | 91.3 | 85.0 | 93.5 | 92.3 | 82.0 | 82.6 | 84.7 |

Results on Black Ceramic Tile: Expert grader readings (0–6 scale)

| | .075% PVNO 2.0% C12–14AS .015% $Na_2CO_3$ .01% Perfume | .075% PVNO 3.0% Ethanol | .10% PVNO .05% Cyclodex. + Perfume | .075% PVNO .25% APG .01% Perfume | Shower Shine | Fresh Shower | Clean Shower |
|---|---|---|---|---|---|---|---|
| End result Round 1 Film/Haze (0–6) | 1.2 | 1.3 | 2.0 | 1.2 | 5.3 | 3.7 | 4.3 |
| End result Round 1 Spots/streaks (0–6) | 3.0 | 4.8 | 5.2 | 3.0 | 4.8 | 3.7 | 4.0 |
| Overall end result Round 1 (0–6) | 3.0 | 4.8 | 5.2 | 3.0 | 4.8 | 3.7 | 4.0 |
| End result Round 2 Film/Haze (0–6) | 0.5 | 4.0 | 2.3 | 0 | 4.2 | 3.0 | 2.0 |
| End result Round 2 Spots/streaks (0–6) | 0.7 | 4.8 | 2.3 | 0 | 3.7 | 2.7 | 1.3 |
| Overall end result Round 2 (0–6) | 1.0 | 4.7 | 2.3 | 0 | 4.0 | 3.0 | 1.8 |

Results or Black Ceramic Tile: Glossmeter readings

| | 0.075% PVNO 20% C12–14AS 0.015% $Na_2CO_3$ 0.01% Perfume | 0.075% PVNO 3.0% Ethanol | 0.10% PVNO 0.05% β Cyclodextrin + Perfume | 0.075% PVNO 0.25% APG 0.01% Perfume | Shower Shine | Fresh Shower | Clean Shower |
|---|---|---|---|---|---|---|---|
| Initial Gloss (60° angle) | 90.6 | 90.9 | 91.5 | 92.6 | 90.1 | 91.6 | 94.1 |
| Gloss Round 1 (60° angle) | 89.9 | 86.9 | 87.6 | 87.9 | 84.1 | 81.5 | 83.9 |
| Gloss Round 2 (60° angle) | 91.3 | 85.0 | 93.5 | 92.3 | 82.0 | 82.6 | 84.7 |

Results on Glass Shower Door: Expert grader readings (0–6 scale)

| | 0.075% PVNO 2.0% C12–14AS 0.015% Na2CO3 0.01% Perfume | 0.075% PVNO 3.0% Ethanol | 0.10% PVNO 0.05% β Cyclodextrin + Perfume | 0.075% PVNO 0.25% APG 0.01% Perfume | Shower Shine | Fresh Shower | Clean Shower |
|---|---|---|---|---|---|---|---|
| End result Round 1 Film/Haze (0–6) | 3.0 | 1.8 | 0.8 | 1.2 | 5.8 | 2.7 | 1.0 |
| End result Round 1 Spots/streaks (0–6) | 3.5 | 2.5 | 1.5 | 1.0 | 4.7 | 2.7 | 1.7 |
| Overall end result Round 1 (0–6) | 2.7 | 1.7 | 1.7 | 0.7 | 5.0 | 3.7 | 2.3 |

The data above suggest that simple compositions comprising PVNO can be used to deliver excellent end result. All of these PVNO-compositions also provided unsurpassed sheeting benefits versus the competitive set.

There is considerable variation in end result performance, though the best results are achieved using either APG or with cyclodextrin in the absence of surfactant. Very good results are also generally achieved using alkyl sulfate surfactant in combination with PVNO. In all cases, end result delivered by the compositions comprising PVNO was superior to that of the competitive set, as measured by the glossmeter. Glossmeter tests on glass could not be measured due to instrumental limitations.

Examples in Context of Floor Cleaning Product Using Disposable Cleaning Pad

In addition to the benefits seen in a no-rinse shower/tub cleaning product/process, preferably for use on a regular, e.g., every shower, basis, the invention provides benefits of in a floor cleaning process which involves the use of a disposable pad that absorbs most, but not all, of the cleaning solution and in which there is no rinse step. This process is illustrated by the following examples. As part of this comparison, it is found that additional synergistic benefits are observed when the polymer, especially PVNO, is combined with specific types of surfactants and/or solvent. The following compositions are made by mixing the listed ingredients in the listed proportions in the listed order of addition:

| | $C_{8-16}$ APG Plantaren 2000 | $C_{10-16}$ APG Plantaren 1200 | $C_{8-12}$ APG Akzo AG6210 | $C_{11}$ EO5 Neodol | PVNO Reilly | Propoxy Propanol |
|---|---|---|---|---|---|---|
| Example 1 | 0.06 | — | — | — | — | — |
| Example 2 | 0.06 | — | | | 0.015 | — |
| Example 3 | 0.06 | — | — | — | 0.015 | 2.0 |
| Example 4 | — | 0.06 | — | — | — | — |
| Example 5 | | 0.06 | | | 0.015 | — |
| Example 6 | — | 0.06 | — | — | 0.015 | 2.0 |
| Example 7 | — | — | 0.06 | — | — | — |
| Example 8 | | | 0.06 | | 0.015 | — |
| Example 9 | — | — | 0.06 | — | 0.015 | 2.0 |
| Example 10 | — | — | — | 0.06 | — | — |
| Example 11 | | | | 0.06 | 0.015 | — |
| Example 12 | — | — | — | 0.06 | 0.015 | 2.0 |
| Example 13 | | | | | 0.015 | — |
| Example 14 | — | — | — | — | 0.015 | 2.0 |

Note:
Examples 1–14 each contain Dow Corning AF suds suppressor at 0.015%, Perfume at 0.04%, and deionized water balance to 100%.

Compositions: All raw materials are purchased from commercial sources. The PVNO used in the tests below is made by Reilly industries, and has a molecular weight of ~20,000 g/mole. The surfactants used are Plantaren 2000 from Henkel a commercially available, cosmetic grade, $C_{8-16}$ alkylpolyglucoside, Plantaren 1200 from Henkel is a commercially available cosmetic grade $C_{10-16}$ alkylpolyglucoside. AG-6210 from Akzo, a commercially available $C_{8-12}$ alkylpolyglucoside, Neodol C11 EO5 is a commercially available non-ionic alkylethoxylate containing an alkyl group with an average chain length of about 11 carbon atoms and about five ethoxy groups per molecule on the average. The solvent used is Propylene Glycol Propyl Ether from Sigma Aldrich.

TEST METHOD FOR FLOOR CLEANING WITH DISPOSABLE PAD

Clean glazed ceramic tiles: 332 mm ×332 mm Italian glazed ceramic tiles from Valentino Kerastone (Cermiche Piemme 41053 Maranello Italy) with smooth texture and light white and brown marble-like appearance are used for the tests. These tiles were chosen for use in testing because they are difficult to wet because of their high glaze..

Tile Preparation: Each tile is first wiped with a paper towel and a solution containing 20% isopropyl alcohol to remove any surface soil. Each tile is then re-wiped with distilled water until completely dry.

Soil Preparation: The soil used in the test is prepared by mixing 820 g of isopropyl alcohol with 320 g de-ionized water. To this add 28.1 g of sifted Vacuum cleaner soil (provided by Empirical), 0.78 g of Crisco oil. 0.09 g of polymerized Crisco oil (viscosity 1800 cps) and 1.25 g of Domino granulated sugar.

Soiling Procedure: Apply 3 mls. of soil solution to the center of each tile. Using a 3 inch nap paint roller, spread the soil out evenly across the tile until uniform coverage is achieved. Allow to dry.

Cleaning Pad: Cut an absorbent mopping pad to 100× 130mm. This pad is composed of a 3 layer density gradient core made by Buckeye Chemicals. The first layer (floor layer) has a density of 0.06 g/cc and a thickness of 4.5 mm and width of 63 mm. The middle layer has a density of 0.1 g/cc and a thickness of 3mm and width of 89 mm. The third layer (storage layer) has a density of 0.15 glcc and a thickness of 1 mm and width of 120 mm. Over the core on the floor side is an apertured formed film provided by Tredegar. On the outer edges on the floor sheet side there are 2×64 mm loops of Swiffer™ material (63 gsm Hydro-entangled polyester with scrim) attached to provide floating cuffs for scrubbing. On the back side is a poly barrier provided by Clopay and 2×25 mm wide attachment strips along the length of the pad to attach the pad to the implement.

Cleaning Implement: A Swiffer® dry dusting mop head is cut down to 100×130 mm dimension (includes swivel head to create mopping action). To this mop head, a male Velcro strip is glued to provide means for attaching the pad.

Cleaning Procedure:

Pad priming: On a separate clean 332 mm×332mm tile apply 3 mls. of a cleaning solution. Starting from the left and moving to the right, wipe up and down the tile for 6 cycles then back 6 cycles from right to left. Repeat wiping again such that 24 cycles of wiping are used.

Cleaning: Apply an additional 3 mls. of the same cleaning solution to the soiled test tile. Using a primed pad and again starting from left and moving to the right, wipe up and down 7 cycles and then back right to left 7 cycles. Repeat wiping until 28 cycles of wiping are used.

Grading: After the tiles have completely dried they are examined by expert graders for film/streaks. Using a 0 to 4 scale where 0 is none and 4 is severe film/streaks each tile is graded for end result appearance.

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| End result film/streak grade (0 = none 4 = severe | 1.5 | 1.1 | 0.8 | 1.8 | 1.4 | 1 | 2.5 | 2.3 | 1.8 | 2.9 | 2.5 | 2.3 | 2 | 1.8 |

The results above suggests that the addition of low levels of PVNO to simple compositions can improve end result to different degrees depending on other ingredients used. Furthermore, the results suggest that different surfactants can provide different degrees of performance benefits either on their own or in combination with PVNO. Specifically, the alkylpolyglucoside (APG) surfactants provide better performance than a standard ethoxylated nonionic, which is screened as being one of the better versions of this surfactant type. Even within the APG's themselves, the version with the broadest chain length range ($C_{8-16}$) provides the best performance (better than either $C_{10-16}$ or $C_{8-12}$). Finally, an additionally improvement is seen when surfactant, PVNO and a specific solvent is added (propylene glycol propyl ether. e.g., "PGPE").

GLIDE TEST METHOD ON GLASS

Equipment

INSTRON 4400 testing equipment and Computer with INSTRON software

INSTRON Slope Board (with pulley wheel) 7"w×20.5"|

INSTRON rectangle weighted block

7"×18" piece of window glass (clamped to slope board)

materials to be tested

Procedure

1. Place INSTRON slope board in position under cross head.
2. Attach window glass to slope board using C-clamps
3. Position block at beginning of slope.
4. Attach string to block and wrap around pulley wheel and attach to cross head loop.
5. Adjust cross head to 0 force so that string is taut but not registering force.
6. Turn on equipment and calibrate.
7. Using computer program, select "Tensile 06 Method—Wipes Glide" (Settings listed below)
8. Wrap material to be tested around weighted block.
9. Select run test and cross head will automatic move.
10. Once test is finish click on "reset" and cross head will automatic reposition to height.
11. Graph will show kilograms of force over entire testing time and maximum kgf. Maximum kgf is the number used to assess the material.
12. Repeat test three times per material. Clean glass between each repetition.

Options

1. Material can be tested wet or dry.
2. Glide test can be performed on other surfaces. Surfaces need to be cut to 7"×18". Use C-clamps to attach to INSTRON slope board.

Test Method Settings

Test Direction: UP

Cross Head Speed: 304.8 mm/minute

Metric measurement: kilograms of force—maximum force level calculated

Slope Board: angle 12.4°

Cross Head Travel: 350 mm

Testing The following premoistened wipes comprising the specified substrates are tested for glide performance on glass with the INSTROM apparatus described above. The specific substrates are: #1. Bounty paper towel (~100% cellulose); #2. 70% Cellulose 13% Polyester, 17% binder; #3. 75% cellulose, 25% polypropylene; #4. 70% polyester, 30% cellulose; #5. 100% polypropylene. Premoistened wipes are tested wet using a 1.7 loading factor, i.e., 1.7 grams of liquid (Cinche cleaning spray, available from The Procter & Gamble Company, is used as the liquid in all of this testing) per gram of dry substrate. The substrates are also tested dry, i.e., with no liquid on the dry wipe. Lower friction numbers are indicative of preferred glide performance. T groupings are used to establish significance between the friction readings.

| T Grouping | Mean | N CLASS |
|---|---|---|
| | Dry Substrate Testing Results | |
| A | 0.08053 | #1. |
| B A | 0.04027 | #5. |
| B | 0.03583 | #2. |
| B | 0.03583 | #3. |
| B | 0.03580 | #4. |
| | Premoistened Wipe Testing Results | |
| A | 0.147700 | #1. |
| B | 0.107400 | #3. |
| C | 0.085000 | #2. |
| C | 0.080500 | #5. |
| D | 0.040267 | #4. |

Dry or wet, the cellulosic substrate has the largest degree of friction on glass, and the high polyester and high polypropylene-content substrates display significantly better glide, i.e., lower friction on glass. Combinations of cellulosic or superabsorbent polymers and polyester, nylon, or polyakylene are desirable, especially so long as the hydrophobic fibers, spots, etc., are on the surface to provide glide.

What is claimed is:

1. A pre-moistened cleaning pad for cleaning a hard surface with minimal filming and streaking, said cleaning pad comprising;

a wet cleaning pad comprising at least an absorbent layer wherein said absorbent layer has a basis weight of from about 100 grams to about 500 grams per square meter and wherein said cleaning pad is impregnated with a cleaning solution, wherein said cleaning solution comprises:

a. an effective amount to reduce the contact angle between said hard surface and water, of an hydrophilic polymer that renders the treated surface hydrophilic;

b. from about 0.005 to about 0.5% by weight of an alkyl polyglucoside surfactant;

c. optionally, an effective amount to provide increased cleaning, of one, or more, organic cleaning solvents;

d. optionally, an effective amount to improve cleaning and/or antimicrobial action, of water soluble mono- or polycarboxylic acid;

e. optionally, an effective amount to provide bleaching, cleaning, and/or antibacterial action;

h. optionally, from about 0.005% to about 1%, of a thickening polymer selected from the group consisting of polyacrylates, gums and mixtures thereof;

i. optionally, an effective amount of perfume to provide odor effects and/or additional adjuvants;

j. optionally, from about 0.0001% to about 0.1%, of suds suppressor; and the balance being water, wherein said composition has a pH between about 2 to about 12.

2. The pre-moistened cleaning pad of claim 1 wherein said cleaning pad is wetted with said composition at a level from about 1.5 gram per gram of the dry weight substrate to about 15 gram per gram of the dry weight substrate.

3. The pre-moistened cleaning pad of claim 2 further comprising a perfume, wherein said perfume is directly or indirectly applied to said cleaning pad, and suds suppressor wherein said suds suppressor is directly applied to said cleaning pad at a level of from about 0.001 grams to about 0.01 grams of suds suppressor per gram of dry substrate.

4. The pre-moistened cleaning pad of claim 2 wherein said cleaning pad has a total fluid capacity of less than about 100 g.

5. The pre-moistened cleansing pad of claim 2 wherein said absorbent layer is substantially made of cellulosic fibers.

6. The pre-moistened cleansing pad of claim 5 wherein said cleaning pad comprises a laminate structure comprising a floor sheet and an inner absorbent layer which functions as a liquid reservoir.

7. The pre-moistened cleansing pad of claim 5 wherein said cleaning pad comprises a protective back layer.

8. The pre-moistened cleaning pad of claim 1 wherein said cleaning pad is attached to a cleaning implement comprising a handle and a mop head.

9. The pre-moistened cleaning pad of claim 7 wherein said alkyl polyglucoside comprises from about 1.0 to about 1.5 saccharide moieties, said saccharide moieties having a mixture of chain lengths with at least about 50% of the mixture having from about 10 carbon atoms to about 16 carbon atoms.

10. The premoistened cleaning pad of claim 1 wherein said hydrophilic polymer is selected from the group consisting of polystyrene sulfonate, polyvinyl pyrrolidone, polyvinyl pyrrolidone acrylic acid copolymer, polyvinyl pyrrolidone acrylic acid copolymer sodium salt, polyvinyl pyrrolidone acrylic acid copolymer potassium salt, polyvinyl pyrrolidone- vinyl imidazoline, polyvinyl pyridine, polyvinyl pyridine n-oxide, and mixtures thereof.

11. The pre-moistened cleaning pad of claim 10 wherein said hydrophilic polymer is a polyvinyl pyridine n-oxide wherein said polyvinyl pyridine n-oxide has a molecular weight of from about 5,000 to about 200,000 and wherein from about 50% to about 90% of the monomeric units comprise an amine oxide group.

12. A method of cleaning a hard surface comprising:

contacting said hard surface with a pre-moistened pad according to claim 7.

* * * * *